US010801821B2

(12) United States Patent
Hilko et al.

(10) Patent No.: US 10,801,821 B2
(45) Date of Patent: Oct. 13, 2020

(54) METHODS OF MASS-PRODUCING LUMINESCENT PROJECTILES AND LUMINESCENT PROJECTILES MASS-PRODUCED THEREBY

(71) Applicant: AMMO TECHNOLOGIES, INC., Scottsdale, AZ (US)

(72) Inventors: Steven Edward Hilko, Mesa, AZ (US); Colt Bailey Skinner, Payson, AZ (US)

(73) Assignee: AMMO TECHNOLOGIES, INC., Scottsdale, AZ (US)

( * ) Notice: Subject to any disclaimer, the term of this patent is extended or adjusted under 35 U.S.C. 154(b) by 0 days.

(21) Appl. No.: 16/539,920

(22) Filed: Aug. 13, 2019

(65) Prior Publication Data

US 2020/0049475 A1 Feb. 13, 2020

Related U.S. Application Data

(60) Provisional application No. 62/718,311, filed on Aug. 13, 2018.

(51) Int. Cl.
*F42B 12/38* (2006.01)
*F42B 33/02* (2006.01)
*F42B 30/02* (2006.01)

(52) U.S. Cl.
CPC ..... *F42B 33/02* (2013.01); *F42B 12/38* (2013.01); *F42B 30/02* (2013.01)

(58) Field of Classification Search
CPC ..... F42B 12/38
USPC ..... 102/513
See application file for complete search history.

(56) References Cited

U.S. PATENT DOCUMENTS

| | | | |
|---|---|---|---|
| 7,735,423 | B1 | 6/2010 | Gold |
| 8,402,896 | B1 | 3/2013 | Hollerman et al. |
| 8,919,255 | B1 | 12/2014 | Quintana et al. |
| 9,347,753 | B1 | 5/2016 | Horch et al. |

(Continued)

FOREIGN PATENT DOCUMENTS

| | | |
|---|---|---|
| GB | 257389 A | 9/1926 |
| JP | 2016102617 A | 6/2016 |

OTHER PUBLICATIONS

Form PCT/ISA/210 International Search Report and PCT/ISA/237 Written Opinion of the International Searching Authority from International Patent Application No. PCT/US2019/046418, which claims priority to U.S. Appl. No. 16/539,920.

*Primary Examiner* — Reginald S Tillman, Jr.
(74) *Attorney, Agent, or Firm* — Michael W. Goltry; Robert A. Parsons; Parsons & Goltry, PLLC

(57) ABSTRACT

A method of mass-producing one-way luminescent projectiles includes providing projectiles each including a body having a nose and a trailing end including a perimeter edge and a rear surface, and that is symmetrical about an axis that extends centrally through the body from the nose to the rear surface, securing the projectiles in a nose down, trailing end up orientation leaving the rear surfaces exposed, depositing a quantity of a hardenable photoluminescent material centrally on each rear surface, the quantities being identical and hardening over a period of time, and maintaining the projectiles in the nose down, trailing end up orientation during the period of time such that each quantity of photoluminescent material forms an identical solid photoluminescent body adhered to the respective rear surface, that is concentric with, and extends outwardly no further than, the perimeter edge, and radially symmetrical relative to the axis.

44 Claims, 36 Drawing Sheets

(56) References Cited

U.S. PATENT DOCUMENTS

| | | | |
|---|---|---|---|
| 9,500,457 | B1 | 11/2016 | Horch et al. |
| 2008/0196617 | A1 | 8/2008 | Reiss et al. |
| 2012/0204707 | A1 | 8/2012 | Park et al. |
| 2015/0308802 | A1 | 10/2015 | Chua et al. |
| 2016/0161217 | A1 | 6/2016 | Sullivan |
| 2018/0087882 | A1 | 3/2018 | Andersson et al. |
| 2018/0156590 | A1 | 6/2018 | Reuther et al. |

METHODS OF MASS-PRODUCING LUMINESCENT PROJECTILES AND LUMINESCENT PROJECTILES MASS-PRODUCED THEREBY

CROSS-REFERENCE TO RELATED APPLICATIONS

This application claims the benefit of U.S. Provisional Application No. 62/718,311, filed Aug. 13, 2018, the entire contents of which are incorporated herein by reference.

FIELD OF THE INVENTION

The present invention relates generally to projectiles and, more particularly, to methods of mass-producing luminescent projectiles, namely, projectiles with a luminescent feature that makes the projectile trajectory visible to the naked eye during nighttime and low-light conditions, and to luminescent projectiles manufactured thereby.

BACKGROUND OF THE INVENTION

Modern firearm ammunition includes an igniter or primer, a propellant, such as a smokeless powder, and a projectile or bullet. The igniter customarily includes a small charge of an explosive chemical mixture configured to be actuated by an impact, such as from a hammer of a trigger assembly, to ignite the propellant. The burning propellant releases gas, which expands and pushes against the base of the projectile thereby propelling the projectile along the path of least resistance, such as through a barrel of a firearm. The igniter, propellant, and projectile are customarily maintained in predetermined relative positions by a casing. The assemblage is typically referred to as a cartridge, or round. Caseless ammunition is also employed, particularly in conjunction with artillery.

Casings of small arms ammunition are customarily made of brass, steel, aluminum, or polymer material, whereas shot shells are typically made plastic or paper having a base covered in a metal. This ammunition is typically categorized as centerfire or rimfire. In centerfire ammunition, the base of the casing includes a cavity, known as a primer pocket, for receiving the primer, that communicates with the interior of the casing through a passage known as a flash hole. In rimfire ammunition, a priming compound is disposed within the rim of the casing base. A measured charge of propellant is disposed within the interior of the casing, and the projectile is pressed into a mouth of the casing. In shot shells, a gas seal or wad is positioned within the casing between the propellant and shot, small balls or pellets, often made of lead, to prevent the expanding gas from the burning propellant from escaping through the shot. The wad is typically formed of fiber or plastic, and often includes an upper cup where the shot is stored. The casing of a shot shell is customarily closed over the shot by crimping.

Of particular significance is tracer ammunition. Tracer ammunition, commonly referred to as tracers or tracer rounds, are configured with a chemical substance that causes a projectile to trail smoke or fire designed to make the projectile trajectory or path visible to the naked eye. This enables the shooter to make aiming corrections without observing the impact of the rounds fired and without using the sights of the weapon. Tracer fire can also be used to signal to other shooters where to concentrate fire. Tracers are customarily mixed among conventional rounds in a magazine or ammunition belt, such as one tracer every fifth round in ground-based applications, or one tracer every second or third round in aircraft guns. Tracers are also customarily placed two or three rounds from the bottom of magazines to alert shooters that their weapons are almost empty.

Historically, tracer rounds employed pyrotechnic flare material embedded in the projectile, typically disposed in a cavity in the projectile, which is ignited by the burning propellant of the round. Pyrotechnic tracers or tracer rounds have proven unsatisfactory. For example, the inherent incendiary characteristic of pyrotechnic tracers makes them a fire hazard and thereby unsuitable for most applications. Incendiary tracer rounds can also be viewed from 360°, enabling ordinary observers to easily locate the source of the round. Furthermore, pyrotechnic rounds inherently exhibit aerodynamic and ballistic properties that are different from the standard rounds with which they are used and change in flight due to loss of mass as the pyrotechnic material is consumed.

Another form of tracer round is the non-energetic tracer round. Non-energetic tracer rounds employ luminescent material deposited on the rear of the projectile. The luminescent material includes photoluminescence phosphors mixed with an epoxy or other chosen binder to enable the luminescent material to adhere to the projectile and to prevent it from oxidizing. The luminescent material is inherently excited by the burning propellant when the round is fired. Light from the burning propellant excites the photoluminescence phosphors in the luminescent material.

Known non-energetic tracers are preferable to pyrotechnic tracer because they do not present an inherent fire hazard and are uni-directional or one-way thereby enabling the projectile in flight to be viewed only from the perspective of the shooter viewing the intended target. Rounds of this type are described in, for example, U.S. Pat. No. 8,402,896 issued to Hollerman et al. on Mar. 26, 2013, and U.S. Pat. Nos. 9,347,753 and 9,500,457 issued to Horch et al. on May 24, 2016 and Nov. 22, 2016, respectively. However, in each instance the known non-energetic tracers are either individually made with the luminescent material disposed on the rear of each individual projectile by hand, or made in small batch quantities using a screen-printing process. In a typical process, a wooden tray is provided with a matrix of cavities into which projectiles are installed in a nose down, trailing or rear end up, orientation thereby leaving the rear surface of the rear end exposed. The cavities each have a diameter that corresponds to chosen caliber of the projectiles, and the openings of the cavities are chamfered to enable them to easily receive the projectiles in the nose down, trailing end up orientation. The rear surfaces of the projectiles are roughened manually with a wire brush and cleaned with an alcohol or other solvent while the projectiles are installed in the tray. A print screen, having a matrix of holes corresponding to the cavities in the tray, is disposed over the projectiles to align the holes with the rear surfaces of the projectiles. A luminescent material is spread over the silkscreen using a rigid spatula or spreader. After removing the print screen, the tray of projectiles is set aside to enable the luminescent material to cure. After the luminescent mixture has sufficiently cured, each projectile is examined, and any excess luminescent material that may have overrun the rear surface on the sides of the projectile is manually removed by drawing with a blade or other tool.

In practice, the prior art manufacturing process for known non-energetic tracer rounds described briefly above inherently results in a non-concentric and/or inconsistently thick distribution of the luminescent material on the rear surfaces of the projectiles. And so for each projectile, the luminescent material is either not concentric with the outer diameter of the projectile and/or not radially symmetrical, namely, not consistently thick around a radial distance from the center of the rear surface of the projectile. Further, the distribution of luminescent mixture is in inherently inconsistent from projectile to projectile, and from batch to batch. Precision in shooting, the ability to place successive rounds at a specific downrange target, necessarily requires that the rounds be consistent in weight, configuration, and balance, and pressure generated in the cartridge during discharge. Because the prior art process of manufacturing luminescent rounds inherently results in rounds having luminescent material that is not consistently concentric and not consistently radially symmetrical as described above, luminescent rounds manufactured according to the prior art techniques described above are inherently not consistent in weight, configuration, and balance, thereby being rounds unsuitable for precision shooting.

Rifling, the arrangement of spiral grooves on the inside of a rifle barrel, employed in the barrels of modern firearms causes a projectile, when discharged, to spin along its centerline axis to stabilize the projectile in flight and increase accuracy. Application of luminescent material on a rear surface of a projectile that is not concentric with the outer diameter of the projectile and/or not radially symmetrical relative to the long axis of the projectile inherently unfavorably influences the balance of the projectile, causing it to wobble, or, in extreme cases, tumble, thereby reducing downrange accuracy. Further, lack of concentricity and/or radial symmetry unfavorably influences the pressure generated in the cartridge during discharge, which can inherently alter expected muzzle velocities and energy, particularly in small caliber rounds. Variation in muzzle velocities and energies from round to round inherently unfavorably influences downrange accuracy.

The larger the area of the rear surface of a projectile covered by the luminescent material the more visible is the trajectory of the projectile in flight. At the same time, however, it is important that the luminescent material not extend over the perimeter edge or periphery of the rear surface, or not come into direct contact against the cartridge casing during the process of assembling the cartridge, or with the firearm barrel when the projectile is discharged from the firearm. Contact of the luminescent material directly against the casing or the barrel can dislodge the luminescent material from the rear surface of the projectile thereby disabling the projectile from working for its intended purpose. Prior art processes for manufacturing luminescent tracers are inherently unable to consistently result in an application of luminescent material that does not extend over the periphery of the rear surface, thereby necessitating tedious and costly manual removal and shaping of the deposited luminescent material to ensure none of the luminescent material extends beyond the rear surface periphery.

Given these and other deficiencies inherent in processes for manufacturing luminescent tracers and the tracers manufactured thereby, there is a continuing and ongoing need for an improved process for manufacturing luminescent tracers by consistently depositing precise amounts of luminescent material on the rear surfaces of projectiles that are not only concentric with the outer diameters of the projectiles but also radially symmetrical relative to the long axes of the projectiles, i.e. uniformly, circumferentially thick around a given radial distance from the central longitudinal axis of each of the various projectiles, and that extend outwardly to predetermined circumferences from the longitudinal axes of the various projectiles without extending beyond the peripheries of the rear surfaces for disabling the luminescent material of the projectiles from coming into direct contact against the casings during assembly of the cartridges and the barrel of the firearm from which the round is discharged, and that sufficiently adhere to the rear surfaces of the rounds to enable the luminescent material to withstand deformation of the rounds that can occur when the rounds are filed, all without the need for manual removal of excess luminescent material to ensure no luminescent material extends over the peripheries of the rear surfaces and for resulting in mass-produced luminescent rounds that are consistently uniform, being of consistent balance, weight, and configuration, and being particularly useful for precision shooting.

SUMMARY OF THE INVENTION

A

According to the principle of the invention a method of mass-producing one-way luminescent projectiles, and one-way luminescent projectiles mass-produced thereby, comprises providing projectiles each including a body having a nose and a trailing end including a perimeter edge and a rear surface, wherein the body is symmetrical about an axis that extends centrally through the body from the nose to the rear surface and the rear surface extends radially outward from the axis toward the perimeter edge, securing the projectiles each in a nose down, trailing end up orientation leaving each rear surface exposed, depositing a quantity of a hardenable photoluminescent material centrally on each rear surface, the quantities being identical and hardening over a period of time, and maintaining the projectiles in the nose down, trailing end up orientation during at least the period of time such that each quantity of photoluminescent material forms an identical solid photoluminescent body adhered to the respective rear surface, that is concentric with, and extends outwardly no further than, the perimeter edge, and radially symmetrical relative to the axis. The step of depositing the quantity of the hardenable photoluminescent material centrally on the rear surface of each projectile comprises depositing a quantity of the hardenable photoluminescent material having a chosen operating viscosity causing each quantity to automatically slump by gravity uniformly and radially outward on the rear surface from the axis to no further than the perimeter edge. The chosen operating viscosity is preferably established by maintaining the hardenable photoluminescent material at an operating temperature. The operating temperature is from 67 to 73° F. in an illustrative embodiment.

In one embodiment, the step of depositing the quantity of the hardenable photoluminescent material centrally on the rear surface of each projectile comprises depositing a blob consisting of a precise quantity of the hardenable photoluminescent material centrally on the rear surface of each projectile.

Another embodiment of depositing the quantity of the hardenable photoluminescent material centrally on the rear surface of each projectile comprises establishing a confining central volume on a central area of the rear surface of each projectile, the volume being concentric with the perimeter edge and symmetrical about the axis of the projectile, filling each volume with the quantity of the hardenable photoluminescent material, the quantity of the hardenable material contacting the central area of each rear surface, and releasing the hardenable material from the confining volume. Establishing a confining central volume comprises masking a circumferential area of each rear surface extending radially outwardly to the perimeter edge defining the central volume in the interior of the masked circumferential area, and the releasing step comprises unmasking each circumferential area. The step of masking comprises providing a masking plate including an upper surface, a lower surface, and receiving voids formed through the masking plate from the lower surface to the upper surface, each receiving void comprises a socket extending into the masking plate from the lower surface to an inwardly-directed annular end wall between the lower surface of the masking plate and the upper surface of the masking plate, and an opening extending from the annular end wall to the upper surface of the masking plate, wherein for each projectile the annular end wall is configured to directly contact and mask the circumferential area of the rear surface, the socket is configured to center the opening over the central area of the rear surface, and the opening is configured to cooperate with the central area of the rear surface to define the volume, when the projectile is installed trailing end first into the socket, and applying the masking plate over the projectiles thereby installing the projectiles trailing ends first into the respective sockets. The step of filling each volume with the quantity of the hardenable photoluminescent material comprises spreading the hardenable photoluminescent material over the upper surface of the masking plate and each volume. The step of spreading the hardenable photoluminescent material comprises depositing a mass of the hardenable photoluminescent material on the upper surface of the masking plate and scraping a spreader over the upper surface of the masking plate and each volume. Unmasking the projectiles comprises withdrawing the masking plate from over the projectiles thereby withdrawing the projectiles from the receiving voids.

In a preferred embodiment, the method additionally comprises texturizing each rear surface uniformly before the depositing step. The step of texturizing each rear surface comprises roughening each rear surface on embodiment, such as by abrasive-blasting each rear surface. In another embodiment, the step of texturizing each rear surface comprises cutting a texture into each rear surface, such as by laser-cutting the texture into each rear surface. An additional step includes cleaning each rear surface after the texturizing step and before the depositing step.

An exemplary embodiment additionally includes stabilizing the projectiles and isolating the trailing ends thereof before the step of texturing each rear surface. Stabilizing the projectiles and isolating the trailing ends thereof comprises providing a stabilizer plate including an upper surface, a lower surface, and stabilizer holes formed through the stabilizer plate from the upper surface to the lower surface, each of the stabilizer holes being configured to receive therethrough one of the projectiles between the nose and the trailing end, and applying the stabilizer plate over the projectiles inserting the projectiles trailing ends first into and through the respective stabilizer holes such that the projectiles extend through the respective stabilizer holes from the lower surface to the upper surface and the trailing ends extend upright beyond the upper surface, which is followed by withdrawing the stabilizer plate from over the projectiles thereby withdrawing the projectiles from the stabilizer holes of the stabilizer plate after the texturizing step and before the depositing step.

According to the principle of the invention a method of mass-producing one-way luminescent projectiles, and one-way luminescent projectiles mass-produced thereby, comprises providing projectiles each comprising a body having a nose and a trailing end including a perimeter edge and a rear surface, wherein the body is symmetrical about an axis that extends centrally through the body from the nose to the rear surface and the rear surface extends radially outward from the axis toward the perimeter edge, providing a baseplate including an upper surface and cavities that open upwardly to the upper surface, each of cavities configured to receive and hold one of projectiles in a nose down, trailing end up orientation, depositing the projectiles nose down into the respective cavities, each cavity holding one projectile in the nose down, trailing end up orientation extending upright from the nose in the cavity to and beyond the upper surface to the trailing end and the rear surface exposed above the upper surface, depositing a quantity of a hardenable photoluminescent material centrally on each rear surface, the quantities being identical and hardening over a period of time, and maintaining the projectiles in the nose down, trailing end up orientation during at least the period of time such that each quantity of photoluminescent material forms an identical solid photoluminescent body adhered to the respective rear surface, that is concentric with, and extends outwardly no further than, the perimeter edge, and radially symmetrical relative to the axis. The step of depositing the quantity of the hardenable photoluminescent material centrally on the rear surface of each projectile comprises depositing a quantity of the hardenable photoluminescent material having a chosen operating viscosity causing each quantity to automatically slump by gravity uniformly and radially outward on the rear surface from the axis to no further than the perimeter edge. The chosen operating viscosity is preferably established by maintaining the hardenable photoluminescent material at an operating temperature. The operating temperature is from 67 to 73° F. in an illustrative embodiment.

In one embodiment, the step of depositing the quantity of the hardenable photoluminescent material centrally on the rear surface of each projectile comprises depositing a blob consisting of a precise quantity of the hardenable photoluminescent material centrally on the rear surface of each projectile.

Another embodiment of depositing the quantity of the hardenable photoluminescent material centrally on the rear surface of each projectile comprises establishing a confining central volume on a central area of the rear surface of each projectile, the volume being concentric with the perimeter edge and symmetrical about the axis of the projectile, filling each volume with the quantity of the hardenable photoluminescent material, the quantity of the hardenable material contacting the central area of each rear surface, and releasing the hardenable material from the confining volume. Establishing a confining central volume comprises masking a circumferential area of each rear surface extending radially outwardly to the perimeter edge defining the central volume in the interior of the masked circumferential area, and the releasing step comprises unmasking each circumferential area. The step of masking comprises providing a masking plate including an upper surface, a lower surface, and receiving voids formed through the masking plate from the lower surface to the upper surface, each receiving void comprises a socket extending into the masking plate from the lower surface to an inwardly-directed annular end wall between the lower surface of the masking plate and the upper surface of the masking plate, and an opening extending from the annular end wall to the upper surface of the masking plate, wherein for each projectile the annular end wall is configured to directly contact and mask the circumferential area of the rear surface, the socket is configured to center the opening over the central area of the rear surface, and the opening is configured to cooperate with the central area of the rear surface to define the volume, when the projectile is installed trailing end first into the socket, and applying the masking plate over the baseplate and the projectiles thereby installing the projectiles trailing ends first into the respective sockets. Guide elements are carried by the baseplate, complemental guide elements are carried by the masking plate, and the guide elements interact with the complemental guide elements coaxially aligning the sockets with the respective trailing ends in response to applying the masking plate over the baseplate and the projectiles. The step of filling each volume with the quantity of the hardenable photoluminescent material comprises spreading the hardenable photoluminescent material over the upper surface of the masking plate and each volume. Spreading the hardenable photoluminescent material comprises depositing a mass of the hardenable photoluminescent material on the upper surface of the masking plate and scraping a spreader over the upper surface of the masking plate and each volume. Unmasking the projectiles comprises withdrawing the masking plate from over the baseplate and the projectiles thereby withdrawing the projectiles from the receiving voids.

In a preferred embodiment, the method additionally comprises texturizing each rear surface uniformly before the depositing step. The step of texturizing each rear surface comprises roughening each rear surface on embodiment, such as by abrasive-blasting each rear surface. In another embodiment, the step of texturizing each rear surface comprises cutting a texture into each rear surface, such as by laser-cutting the texture into each rear surface. An additional step includes cleaning each rear surface after the texturizing step and before the depositing step.

An exemplary embodiment additionally includes stabilizing the projectiles and isolating the trailing ends thereof before the step of texturing each rear surface. Stabilizing the projectiles and isolating the trailing ends thereof comprises providing a stabilizer plate including an upper surface, a lower surface, and stabilizer holes formed through the stabilizer plate from the upper surface to the lower surface, each of the stabilizer holes being configured to receive therethrough one of the projectiles between the nose and the trailing end, and applying the stabilizer plate over the baseplate and the projectiles inserting the projectiles trailing ends first into and through the respective stabilizer holes such that the projectiles extend through the respective stabilizer holes from the lower surface of the stabilizer plate to the upper surface of the stabilizer plate and the trailing ends extend upright beyond the upper surface of the stabilizer plate. Guide elements are carried by the baseplate, complemental guide elements are carried by the stabilizer plate and the guide elements interacting with the complemental guide elements coaxially aligning the stabilizer holes with the respective trailing ends in response to applying the stabilizer plate over the baseplate and the projectiles. The method additionally includes withdrawing the stabilizer plate from over the baseplate and the projectiles thereby withdrawing the projectiles from the stabilizer holes of the stabilizer plate after the texturizing step and before the depositing step.

BRIEF DESCRIPTION OF THE DRAWINGS

Referring to the drawings.

DETAILED DESCRIPTION

Figure 1:
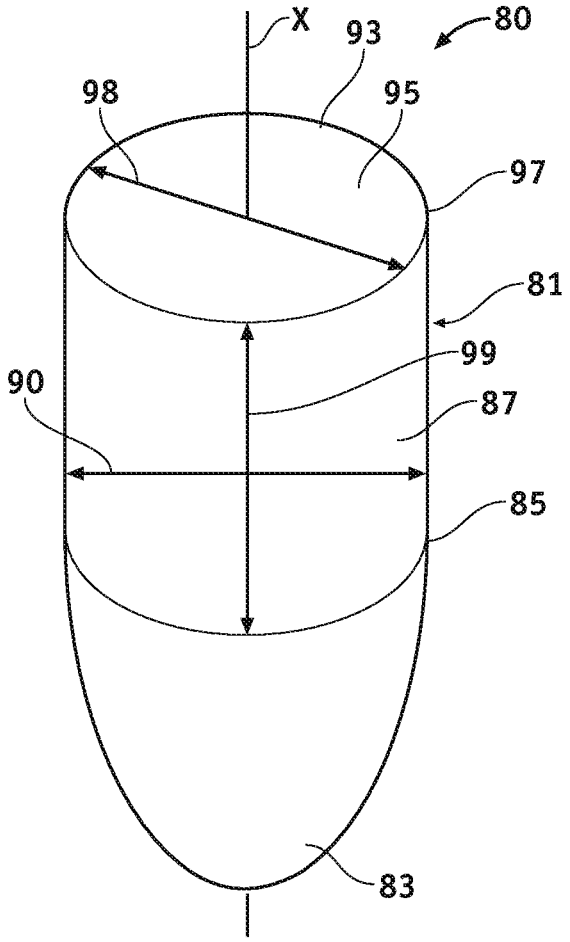
FIG. 1 Prior Art
FIG. 1 is a side elevation view of a prior art projectile including a body having a nose and a trailing end including a perimeter edge and a rear surface, a plurality of which being useful in methods mass-producing one-way luminescent projectiles disclosed herein.

Disclosed herein are efficient, cost-effective, and easily repeatable methods that do not require specialized skill, of mass-producing one-way luminescent projectiles that are consistent in weight, configuration, and balance, and thereby uniform and inherently suitable for precision shooting, described and illustrated throughout this specification in reference to the drawings, in which like reference characters indicate corresponding elements throughout the several views.

Mass production, also known as flow production or continuous production, is the production of large amounts of standardized products, which are one-way luminescent projectiles according to this disclosure. The mass-production methods disclosed throughout this specification utilize uniform projectiles/bullets, which can be conventional and readily-available uniform projectiles, and mass-produce them into standard or uniform one-way luminescent projectiles or tracers especially suitable for precision shooting. The projectiles each have a chosen and identical configuration and caliber and are thereby identical and uniform, and are each a body or mass of copper, lead, steel, or other chosen metal or metal composite customarily used for projectiles, i.e. bullets.

FIG. 1 illustrates an example of a prior art projectile useful in the various methods disclosed throughout this specification. Projectile 80 includes a body 81 having a nose 83, a shoulder 85, a cylindrical caliber section 87 and a rear, base, or trailing end 93. Trailing end 93 includes a rear surface 95 and perimeter edge 97. Caliber section 87 defines a caliber diameter 90, and extends forwardly from trailing end 93 to shoulder 85, a distance generally indicated as 99 in FIG. 1. Nose 83 extends forwardly from shoulder 85. In this example, nose 83 is ogive in shape. Nose 83 can be provided in other standard configurations well known in the art, such as round, hollow point, spire point or Spitzer, conical, flat, or other chosen shape. Body 81 is symmetrical about an axis X that extends centrally through body 81 from nose 83 to rear surface 95. In the exemplary projectile 80 of FIG. 1, rear surface 95 extends radially outward from axis X toward perimeter edge 97 and has diameter 98 and is flat. Rear surface 95 can be provided in other configurations, such as at least those illustrated in FIGS. 39-46 and others. Rear surface 95 can be provided in any desired or standard configuration known in the art. Projectile 80 is generally representative of a standard, prior art projectile/bullet having an inherent weight, further details of which are well-known to the person having ordinary skill in the art. In this example, bullet 80 is generally representative of a standard .45 caliber bullet, in which caliber diameter 90 is 0.45 inch. In the example of FIG. 1., diameter 98 of rear surface is substantially the same as caliber diameter 90, but can be less than caliber diameter 90 in alternative configurations of trailing end 93. The methods disclosed throughout this specification can be carried out with projectiles/bullets having any chosen caliber and any chosen configuration consistent with the teaching presented herein.

Figure 10:
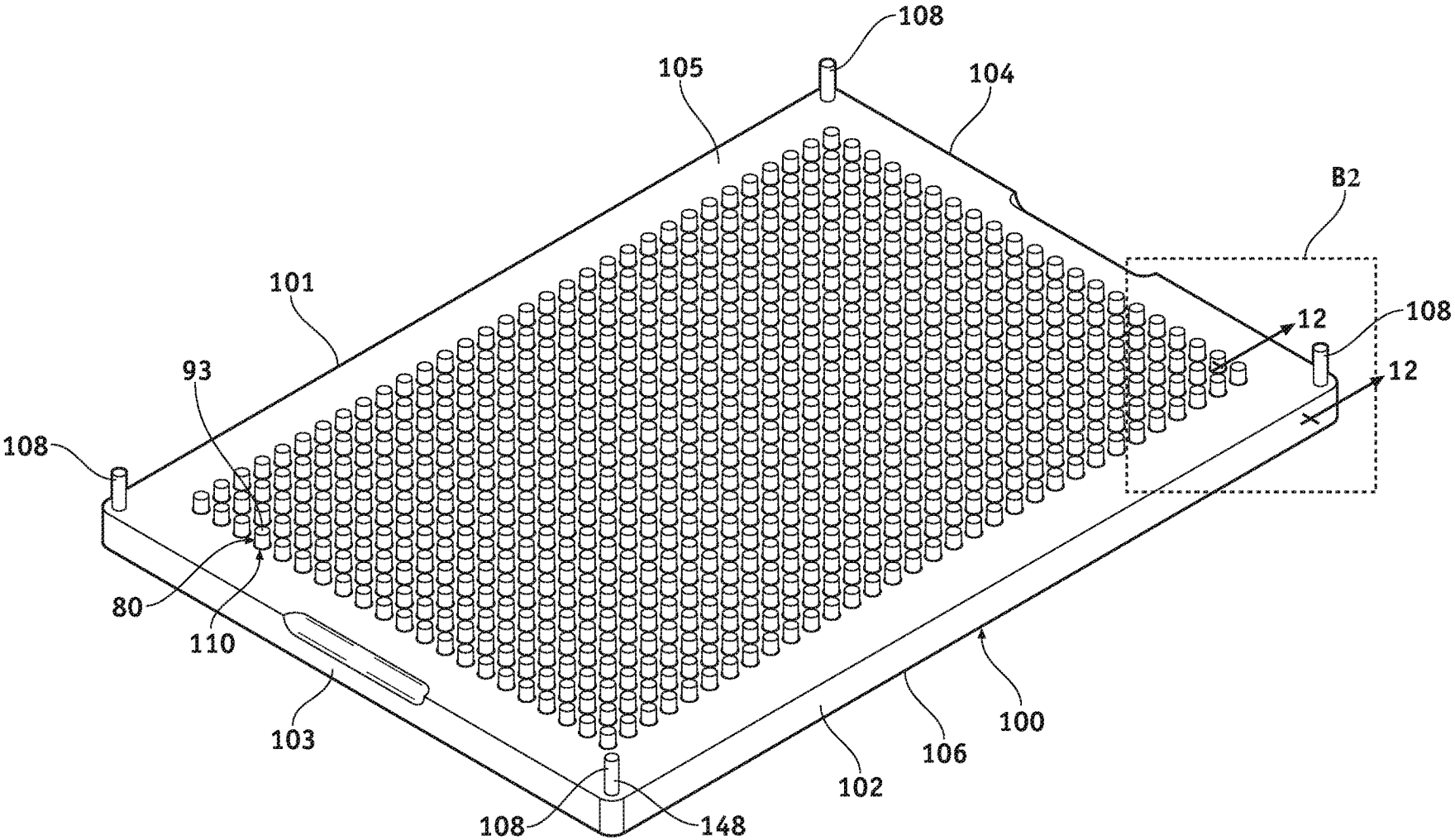
FIG. 10 illustrates the embodiment of FIG. 8 without the loading plate.
Figure 25:
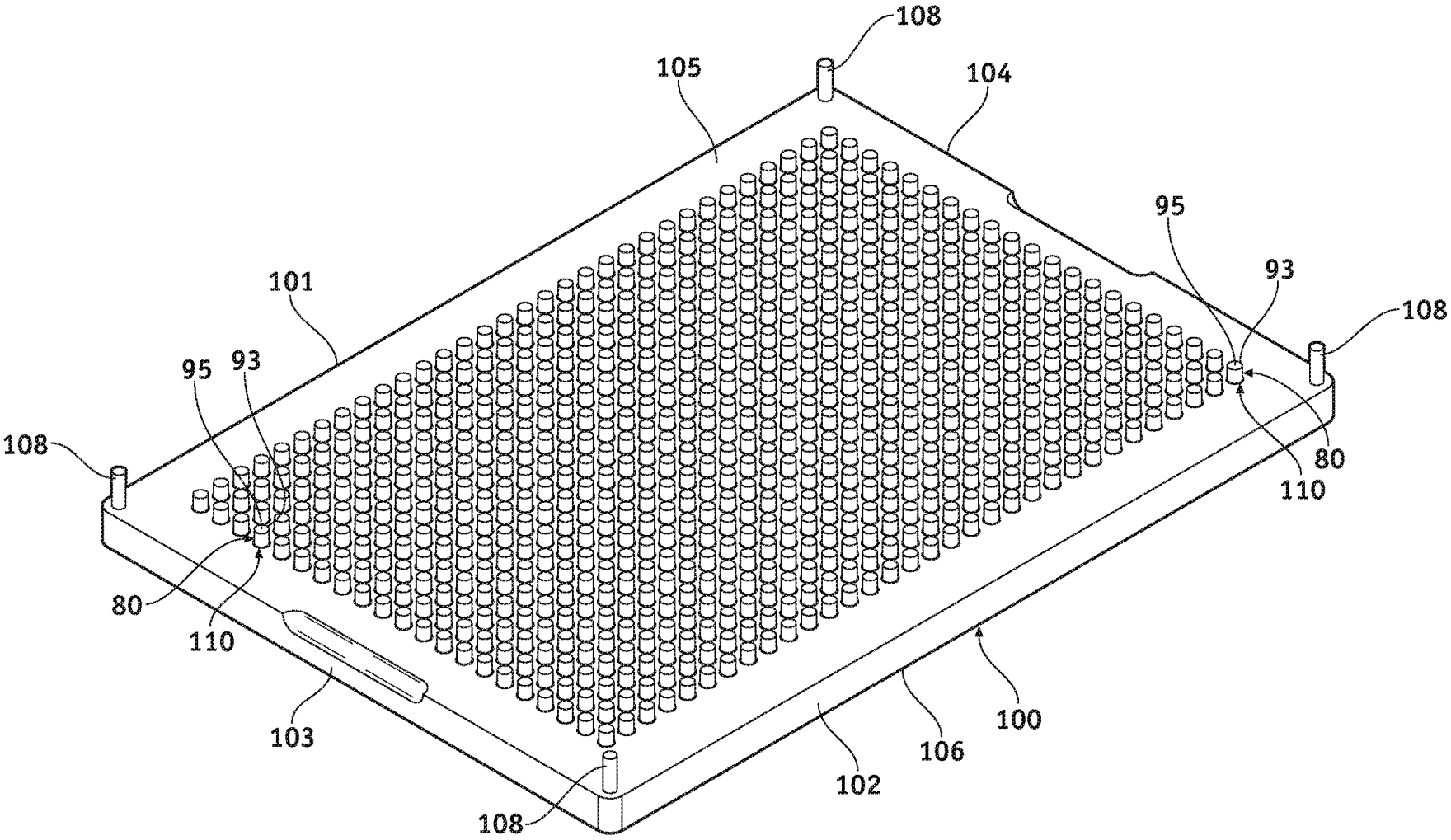
FIG. 25 is a view like FIG. 10 illustrating the projectiles secured in the baseplate in the nose down, trailing end up orientation following the cleaning of the projectiles, including the rear surfaces thereof, according to FIGS. 18-22.
Figure 38:
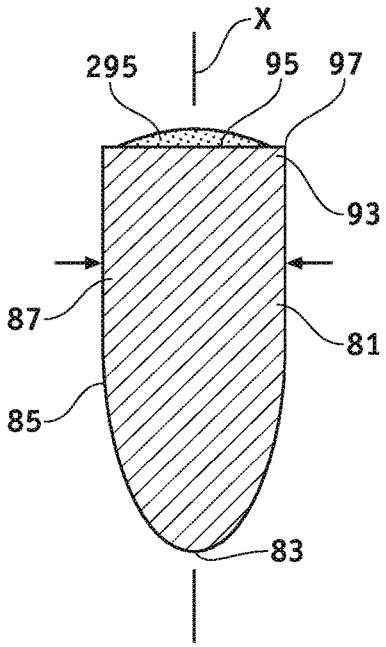
FIG. 38 is a vertical section view of the one-way luminescent projectile of FIG. 36 withdrawn from the baseplate.

Briefly, a preferred method of mass-producing one-way luminescent projectiles includes, in general, the following steps. A plurality of substantially uniform projectiles 80, are provided. Each projectile 80 is secured in a nose 83 down, trailing end 93 up orientation such that each rear surface 95 is identically exposed, level, and preferably coplanar as shown in FIG. 10 and FIG. 25. A precise quantity of a hardenable photoluminescent material is deposited centrally on rear surface 95 of each projectile 80. The quantities deposited on the respective projectiles 80 are identical and correspond to diameter 98 of the projectile 80. Projectiles 80 are retained in the nose 83 down trailing end 93 up orientation for a period sufficient for the photoluminescent material to harden into a solid photoluminescent body 295 that adheres to rear surface 95 of each projectile 80. As shown in FIG. 38, solid photoluminescent body 295 is concentric with, and extends outwardly no further than, perimeter edge 97, and is radially symmetrical relative to axis X. These and various additional method steps in the various embodiments of the invention are described in detail in conjunction with the accompanying illustrations.

Figure 2:
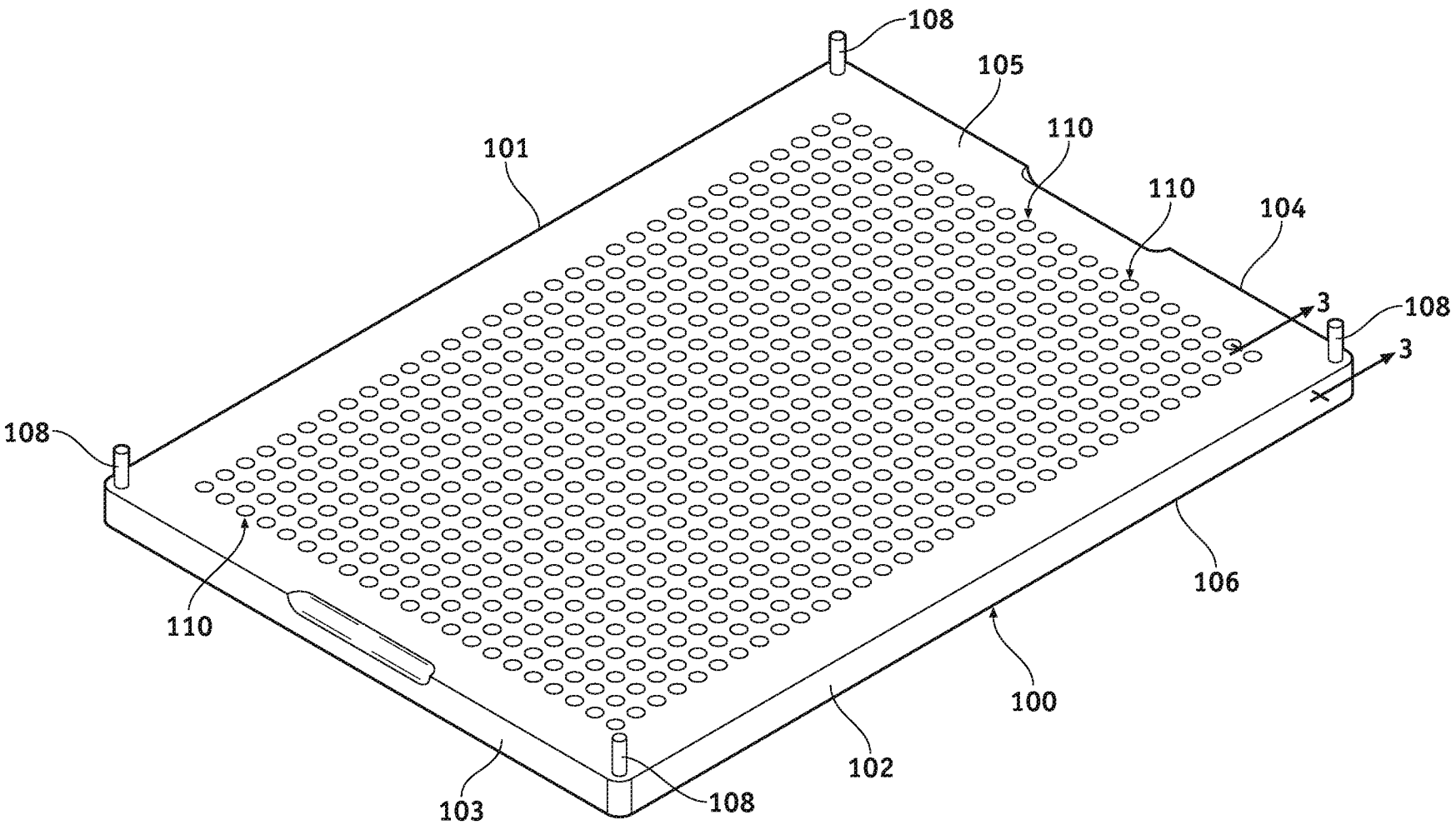
FIG. 2 is a perspective view of a baseplate.
Figure 12:
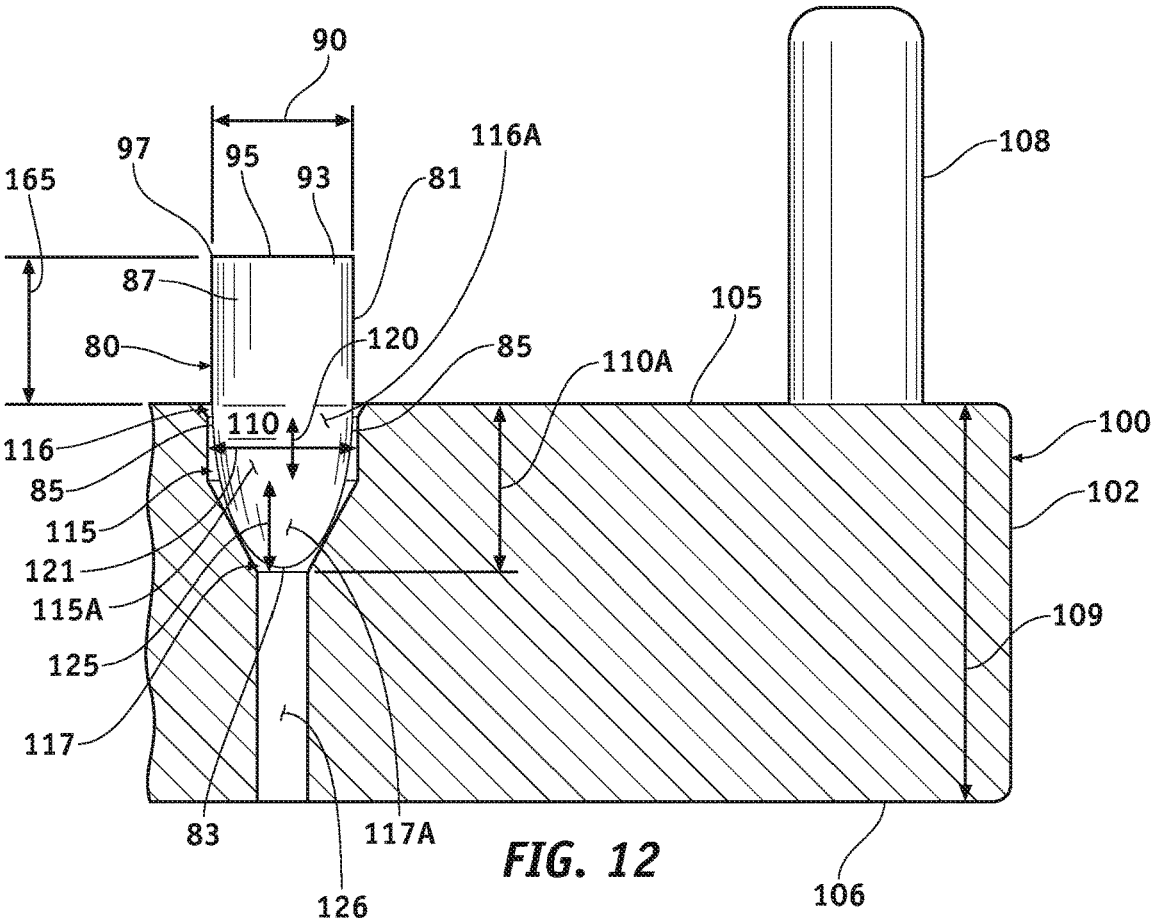
FIG. 12 is a section view taken along line 12-12 of FIG. 10, projectile not being sectioned for illustrative purposes.

Referring to FIGS. 2 and 12, securing each projectile 80 in a nose 83 down, trailing end 93 up orientation leaving each rear surface 95 identically exposed according to an exemplary method includes providing baseplate 100. Baseplate 100, a fixture, is fashioned of a material or combination of materials having inherently rigid, resilient, rugged, wear-resistant, chemical-resistant, and thermally-conductive material characteristics, such as anodized aluminum, steel, or other metal or metal composite. Baseplate 100 is configured to concurrently secure projectiles 80 each in a nose 83 down, trailing end 93 up orientation such that each trailing end 93 and rear surface 95 thereof is identically exposed while concurrently minimizing tilt and lateral displacement of each projectiles 80, such that the rear surfaces of the respective projectiles 80 are essentially level and coplanar. Baseplate 100 is suitably portable, easily carried or moved about by hand.

Figure 3:
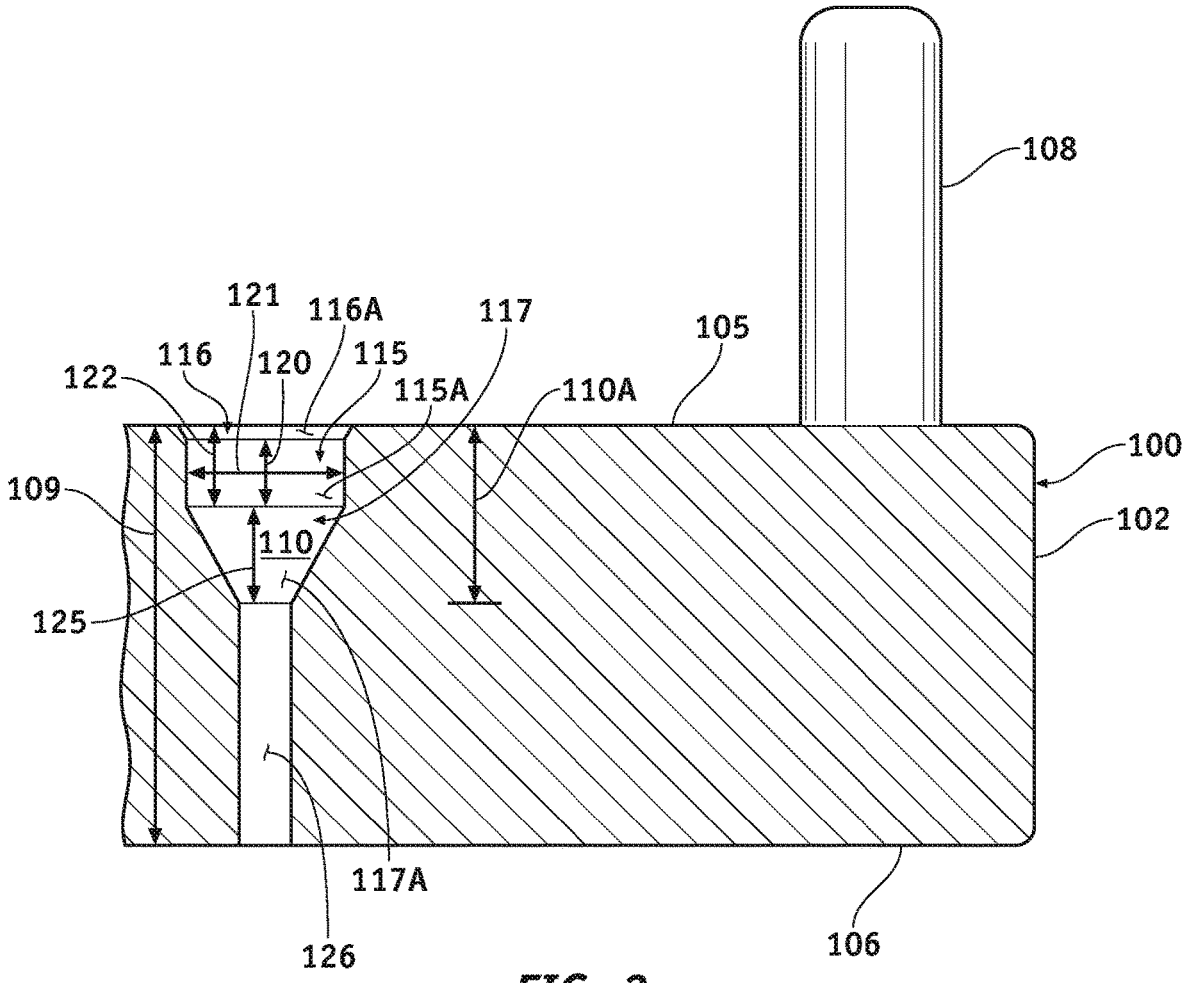
FIG. 3 is a section view taken along line 3-3 of FIG. 2.

Referring to FIGS. 2 and 3 in relevant part, baseplate 100 is broad, flat, and generally rectangular in overall shape in this example and includes opposed, parallel, identical elongate sides 101 and 102 extending between opposed, parallel, identical, and comparatively shorter elongate ends 103 and 104, and opposed, coextensive and parallel upper and lower surfaces 105 and 106. Sides 101 and 102 converge with ends 103 and 104 at four respective corners of baseplate 100. Identical guide pins 108, rigidly affixed to baseplate 100, extend upright from upper surface 105 proximate to the respective corners, and are configured to accept corresponding guide holes of respective fixtures, e.g., respective loading, stabilizer, and masking plates disclosed herein, for properly aligning each fixture relative to baseplate 100. Guide pins 108 are sufficiently long to be received in the corresponding fixture guide holes before any contact between the fixture and other parts of the baseplate or projectiles held by the baseplate. The corresponding holes in the fixtures receive the guide pins and bring all of the various features of the fixture into alignment with the corresponding features of the baseplate. In this manner, such fixtures may be independently and easily stacked over baseplate 100, all without requiring specialized skill or equipment.

Referring now to FIGS. 2 and 3, baseplate 100 is configured with cavities 110 each opening upwardly to upper surface 105 and configured to identically receive and hold/secure a projectile in the nose 83 down, trailing end 93 up orientation, while at the same time minimizing tilt or lateral displacement such that the rear surfaces 95 of each of projectile 80 is substantially level and coplanar with the rear surfaces of the other projectiles 80. Cavities 110 are formed in thickness 109 of baseplate 100, are identical, and arranged in a chosen pattern, preferably equally spaced-apart. As shown in FIG. 3, thickness 109 of baseplate 100 extends from upper surface 105 to lower surface 106. In this example, cavities 110 are arranged in pattern of rows that are parallel to ends 103 and 104 and perpendicular to sides 101 and 102. Each row from side 101 to side 102 includes twenty-one cavities 110, and there are thirty-two parallel rows of cavities 110 from end 103 to end 104. Accordingly, baseplate 100, in this example, incorporates six-hundred and seventy-two identical cavities 110 each for identically receiving and holding a projectile in the nose down, trailing end up orientation. A baseplate constructed and arranged in accordance with the principle of the invention can have varying dimensions and less or more cavities arranged in a chosen pattern commensurate with this disclosure, the size and shape of the chosen projectiles, and the chosen number of luminescent projectiles desired to be mass-produced. Again, cavities 110 are identical. Accordingly, the details of one cavity 110 are discussed in detail in conjunction with FIG. 3, a section view taken along line 3-3 of FIG. 1, with the understanding that the ensuing discussion of cavity 110 in FIG. 3 applies in every respect to each cavity 110 of baseplate 110 of FIG. 2.

Referring to FIG. 3, each cavity 110 is a hollow space milled, molded, or otherwise formed in thickness 109 of the material of baseplate 100 between upper surface 105 and lower surface 106. Cavity 110 opens upwardly to upper surface 105, extending downwardly a chosen distance 110A from surface 105 and includes an intermediate portion 115, a lower portion 117, and, suitably, an upper portion 116. Intermediate portion 115, upper portion 116, and lower portion 117 are coaxial and cooperate to define cavity 110. Upper portion 116 extends downwardly from upper surface 105 to an upper part of intermediate portion 115. Lower portion 117 extends downwardly a chosen distance 125 from a lower part of intermediate portion 115 to an intermediate position in the thickness of baseplate 100 between upper surface 105 and lower surface 106.

Upper portion 116 is suitably a countersunk or chamfered hole 116A that enlarges the upper part of cylindrical hole 115A and opens upwardly from the upper part of cylindrical hole 115A to upper surface 105 to facilitate reception of a projectile 80 in cavity 110. Countersunk hole 116A has an inherent depth from upper surface 105 to the upper part of intermediate portion 115. Intermediate portion 115 is configured in accordance with caliber section 87 of projectile 80, preferably a cylindrical hole 115A that extends upwardly from the bottom of upper portion 116 a chosen distance 120 to the top of lower portion 117 (equating to a chosen distance 122 from upper surface 105).

Lower portion 117 configured to facilitate the reception and seating therein of nose 83 of a projectile 80 advanced downwardly through countersunk hole 116A and cylindrical hole 115A. Lower portion 117 is suitably a frustoconical hole 117A.

Intermediate portion 115 and lower portion 117 cooperate to receive and secure a projectile 80 in the nose 83 down, trailing end 93 up orientation while concurrently minimizing projectile tilt and lateral displacement. Cylindrical hole 115A has a chosen depth 120 and diameter 121. Depth 120 is chosen in accordance with the length of projectile 80. Diameter 121 corresponds to caliber diameter 90 of a projectile 80 with a chosen clearance, suitably approximately five thousandths inch larger than the nominal caliber diameter 90.

Frustoconical hole 117A is configured to receive, and seat and hold, nose 83 of a projectile 80. Frustoconical hole 117A is suitably a hole that is chamfered downwardly at a chosen chamfer angle to a chosen depth 125 located between the lower part of cylindrical hole 115A and lower surface 106 of baseplate 100. The chamfer angle, is 45° in this embodiment. The chamfer angle and depth 125 are chosen to provide for precise seating of nose 83 of a projectile 80 in frustoconical hole 117A. Frustoconical hole 117A can inherently accommodate a variety of different projectile nose shapes, such as a round nose, a Spitzer nose, a semi-Spitzer nose, hollow point, ballistic tip, and other conical and frustoconical nose configurations.

The frustoconical configuration of hole 117A inherently defines an intermediate diameter that is less than diameter 121 of the overlying cylindrical hole 115A. As a result, when a projectile is received in cavity 110 trailing end 93 down rather than correctly nose 83 down, trailing end 93 of projectile 80 will inherently make arresting contact directly against the sides of the material of baseplate 100 defining frustoconical hole 117A at a higher elevation than would projectile 80 correctly received nose 83 down in frustoconical hole 117A such that the upwardly facing nose of the projectile will extend upwardly from upper surface 105 of baseplate 100 a greater distance compared to the tailing end 93 of a projectile 80 correctly received nose 83 down in frustoconical hole 117A. This enables an ordinary observer to visually identify a projectile 80 received incorrectly in cavity 110 trailing end 93 down, and re-orient the projectile 80 to the correct nose 83 down, trailing end 93 up orientation before proceeding further.

Depth 110A of cavity 110 is the sum of depths 120 and 125 and the inherent depth of upper portion 116 from upper surface 106 of baseplate 100 to the upper part of intermediate portion 115. This overall depth 110A of cavity 110 from upper surface 105 of baseplate 100 to the lower part of frustoconical hole 117A defining lower portion 117 is specifically chosen to relate to a corresponding length of projectile 80, which in this example is from and including caliber section 87 adjacent to shoulder 85 to the end of nose 83. Accordingly, when a projectile 80 is received nose 83 first into cavity 110 and nose 83 is received by and is seated in frustoconical hole 117A of cavity 110, the projectile 80 is secured by cavity 110 in the nose 83 down, trailing end 93 of orientation. Projectile 80 extends upright from nose 83 seated in frustoconical hole 117A, with shoulder 85 disposed in cylindrical hole 115A, and caliber section 87, in turn, extending upright through the upper part of cylindrical hole 115A and countersunk hole 116A to upper surface 105 of baseplate 100 and beyond upper surface 105 of baseplate 100 a chosen distance to dispose trailing end 93 and rear surface 95 a chosen distance above upper surface 105. Trailing end 93, including rear surface 95 and perimeter edge 97 thereof, and a length of caliber section 87 extending downwardly from trailing end 93 is thus exposed above to upper surface 105 of baseplate 100. This enables each projectile 80 loaded nose 83 down, trailing end 93 up in a cavity 110 in baseplate 100 to interact with various fixtures such as the stabilizer plate and the masking plate discussed in detail below. When employed in connection with projectiles 80, such as rifle projectiles, that have a caliber section 87 that is relatively longer than that of the 45 caliber projectile shown in FIG. 1, length 120 of intermediate section 115 would typically be greater, such that shoulder 85 with be disposed in cylindrical hole 115 a with a greater portion of caliber section 87 of projectile 80 received in hole 115A.

In the embodiment of FIG. 3, a lower hole 126 is formed through thickness 109 from the lower part of frustoconical hole 117A defining lower portion 117 of cavity 110 to lower surface 106 of baseplate 100. Frustoconical hole 117A enlarges downwardly-extending lower hole 126. Hole 126 acts as a drain for enabling debris in cavity 110 to drain therefrom to into hole 126 from cavity 110 and drop therethrough by gravity outwardly from lower surface 106. This keeps cavity 110 free of debris that that could otherwise interfere with a projectile 80 properly seating in cavity 110.

Thickness 109 of baseplate 100 in FIG. 3 is chosen to ensure that cavities 110 have sufficient, identical depths to identically receive and hold projectiles 80 each in the described nose 83 down, trailing end 93 orientation without affecting the structural integrity of baseplate 100. In this example, and for accommodating most common pistol rounds, thickness 109 is approximately 0.50 of an inch. Those having regard for the art will readily appreciate that thickness 109 can be increased or decreased depending on the chosen caliber of projectiles to be mass-produced luminescent projectiles, i.e., tracers.

Figure 4:
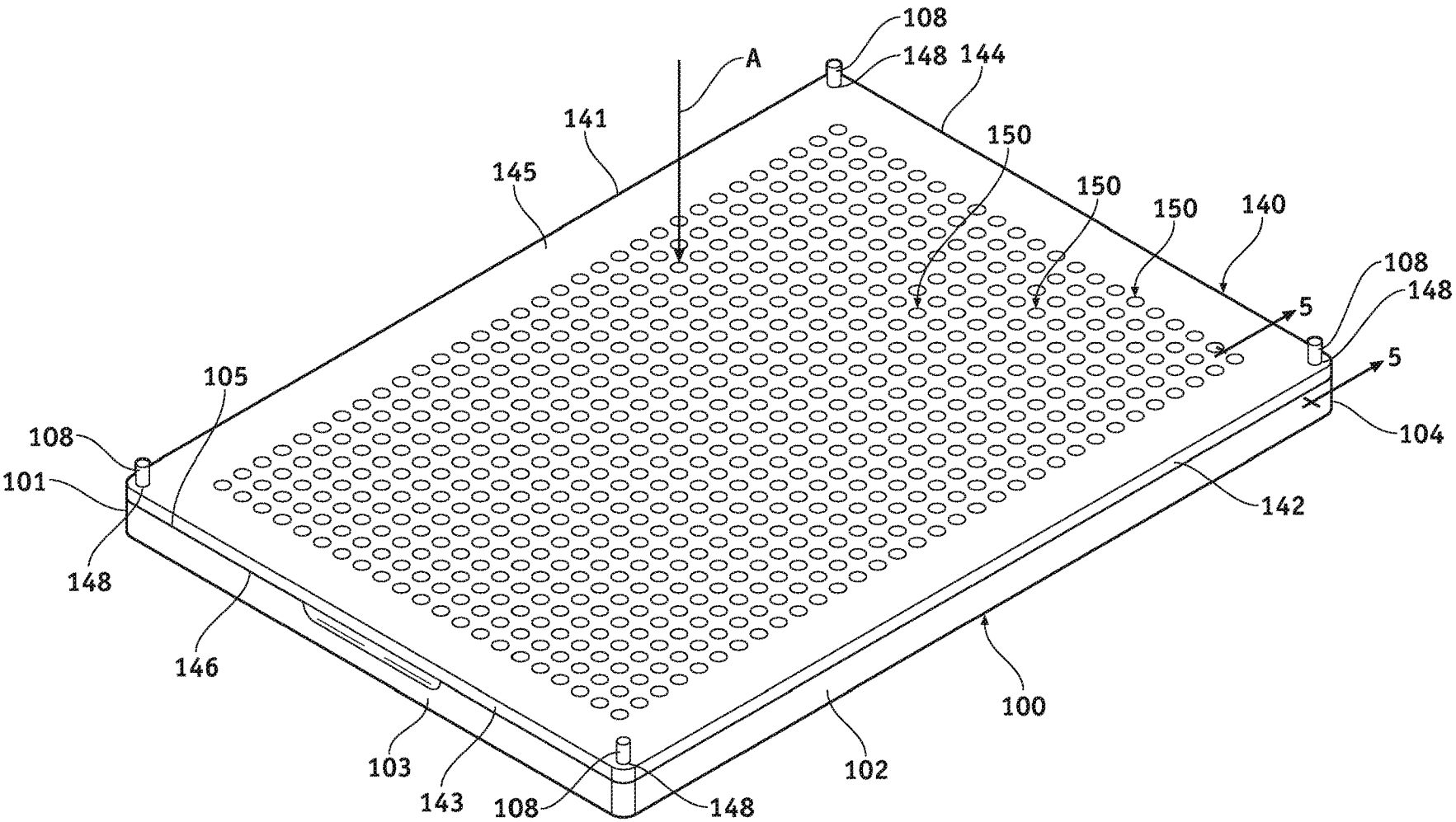
FIG. 4 is a perspective view of a loading plate stacked over the baseplate first illustrated in FIG. 2.
Figure 5:
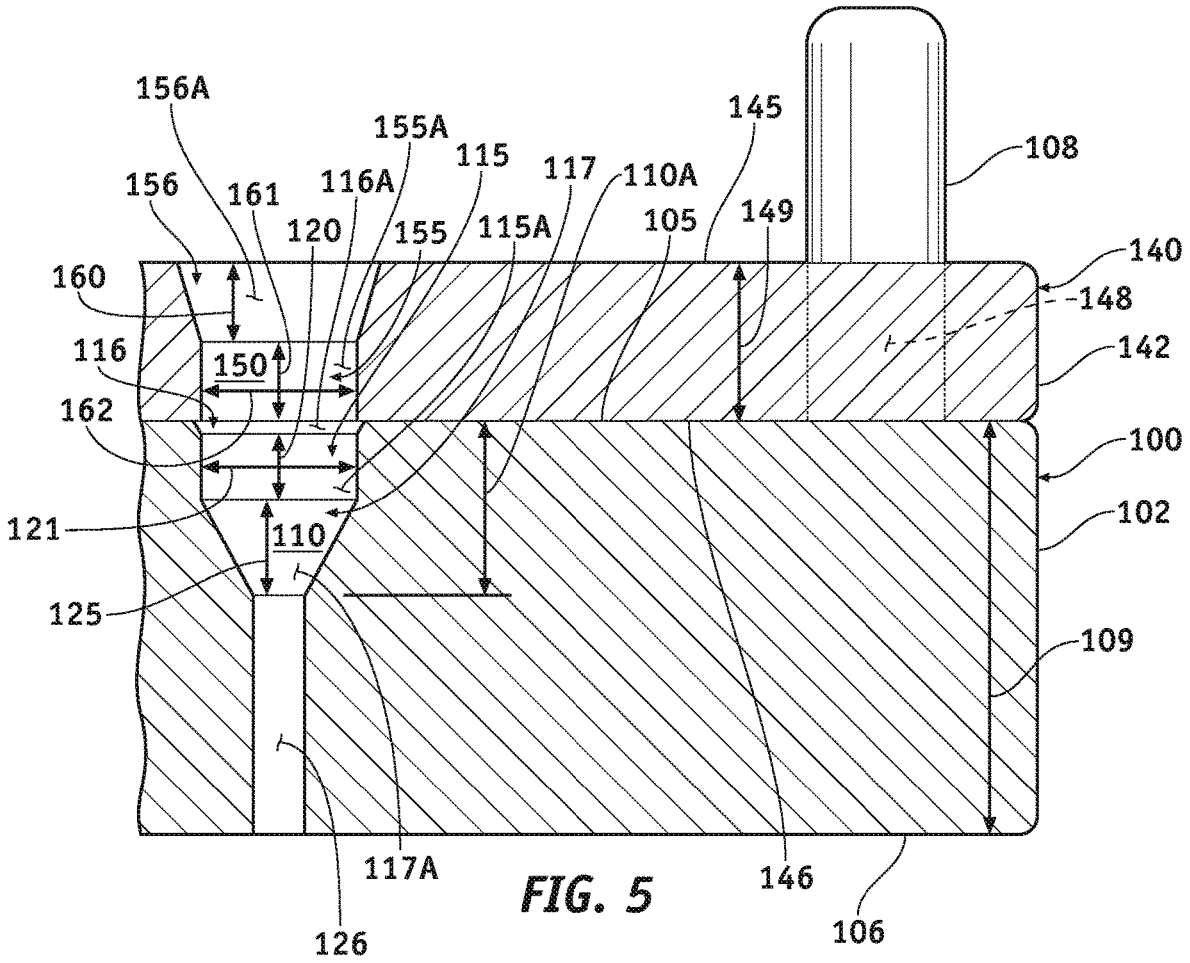
FIG. 5 is a section view taken along line 5-5 of FIG. 4.

Projectiles 80 are deposited nose 83 down into the respective cavities 110, This can be easily and efficiently done by hand or perhaps by an automated handler or depositor. Referring to FIGS. 4 and 5, in one exemplary method, which is inexpensive, efficient, and which does not require specialized skill or expensive equipment, depositing projectiles 80 nose 83 down into the respective cavities 110 is facilitated by utilizing a loading plate 140 that provides a relatively larger chamfered opening to receive and funnel projectiles 80 nose down into corresponding cavities 110 of baseplate 100. Loading plate 140 is disposed/stacked over baseplate 100, as shown in in FIG. 4, and projectiles 80 loaded into baseplate 110 via loading plate 140 each in the nose 83 down, trailing end 93 up orientation. Loading plate 140 is configured to be repeatedly applied over or otherwise stacked onto baseplate 100 in FIGS. 8 and 9 and unstacked or otherwise withdrawn from baseplate 100 for hastening loading baseplate 100 with projectiles 80, without having to make modifications to either loading plate 140 or baseplate 100. Loading plate 140 can be manipulated by hand, or by mechanized handling equipment.

Loading plate 140 is portable, being able to be easily carried or moved about by hand, is fashioned of a material or combination of materials having inherently rigid, resilient, rugged, wear-resistant, chemical-resistant, and thermally-conductive material characteristics, such as anodized aluminum, steel, or other metal or metal composite, and is configured to be applied over or otherwise stacked on baseplate 100. Loading plate 140 is broad, flat, and generally rectangular in overall shape in this example, being substantially coextensive with respect to baseplate 100, and includes opposed, parallel, identical elongate sides 141 and 142 extending between opposed, parallel, and comparatively shorter identical elongate ends 143 and 144, and opposed, coextensive and parallel upper and lower surfaces 145 and 146. Sides 141 and 142 converge with ends 143 and 144 at four respective corners of loading plate 140. Identical guide holes 148 extend through thickness 149 (FIG. 5) of loading plate 140 from upper surface 145 to lower surface 146 proximate to the respective corners of loading plate 140. Guide openings 148 of loading plate 140 are configured to receive therethrough guide pins 108 of baseplate 100 when loading plate 140 is stacked atop baseplate 100 in FIG. 4 for properly aligning loading plate 140 with baseplate 100 as described in detail below. Thickness 149 of loading plate 140 from upper surface 145 to lower surface 146 in FIG. 5 is less than thickness 109 of baseplate 100 in this example.

Loading plate 140 is configured with respective identical alignment or loading holes 150 extending therethrough, each corresponding to one of the cavities 110 of baseplate 100. When in position over baseplate 110 each loading hole 150 overlies and is in axial alignment with a corresponding cavity 110 of baseplate 100. Loading holes 150 are each configured to receive a projectile 80 therein nose 83 down in a direction from upper surface 145 and convey the projectile 80 nose down therethrough from upper surface 145 to lower surface 146 and downwardly beyond lower surface 146 nose 83 down into the corresponding axially-aligned cavities 110. In this example, loading holes 150 are equal in number to cavities 110 of baseplate 100, and are arranged/patterned identically to cavities 110 of baseplate 110, namely, in rows that are parallel relative ends 143 and 144 and perpendicular relative to sides 141 and 142. Each row from side 141 to side 142 includes twenty-one loading holes 150, and there are thirty-two parallel rows of loading holes 150 from end 143 to end 144. Accordingly, in this embodiment baseplate 100 incorporates a pattern of six-hundred and seventy-two cavities 110 each for identically receiving and holding a projectile 80 in the nose 83 down, trailing end 93 up orientation, and loading plate 140 incorporates an identical pattern and number, six-hundred and seventy-two in this example, of loading holes 150 each for identically receiving and guiding a projectile 80 in the nose 83 down, trailing end 93 up orientation to into an axially-aligned one of cavities 110 of baseplate 100 when loading plate 140 is disposed over or otherwise stacked on baseplate 100. A loading plate constructed and arranged in accordance with the principle of the invention can have varying dimensions and less or more loading holes to match the number of cavities of a baseplate constructed and arranged in accordance with the invention. Loading holes 150 are identical. Accordingly, the details of one loading hole 150 are discussed in detail in conjunction with FIG. 5, a section view taken along line 5-5 of FIG. 4, with the understanding that the ensuing discussion of loading hole 150 in FIG. 5 applies in every respect to each loading hole 150 of loading plate 140 of FIG. 4.

Referring to FIG. 5, loading hole 150 is exemplary of a countersunk hole and is a hollow space milled, molded, or otherwise formed through thickness 149 of the material of loading plate 140 from upper surface 145 to lower surface 146. Loading hole 150 opens upwardly to upper surface 145, opens downwardly to lower surface 146, and includes lower portion 155, and upper portion 156. Lower and upper portions 155 and 156 are coaxial. Lower portion 155 extends downwardly from a lower part of upper portion 156, at an intermediate position between upper surface 145 and lower surface 146, to lower surface 146, and upper portion 156 extends upwardly from an upper part of lower portion 155, at an intermediate position between upper surface 145 and lower surface 146, to upper surface 145. Lower portion 155 is a cylindrical hole 155A that extends from upper portion 156. Upper portion 156 is a countersunk or chamfered hole 156A that enlarges the upper part of cylindrical hole 155A and opens upwardly from the upper part of cylindrical hole 155A to upper surface 145 to facilitate reception of a projectile 80 into and through loading hole 150 to into an axially one of cavities 110 of baseplate 100 onto which loading plate 140 is stacked.

Countersunk hole 156A has a depth 160 from upper surface 145 to the upper part of lower portion 155 and, again, enlarges the upper part of cylindrical hole 155A and opens upwardly from the upper part of cylindrical hole 155A to upper surface 145 to facilitate reception of a projectile 80 into and through loading hole 150. Cylindrical hole 155A has a depth 161 and a diameter 162. Depth 161 and diameter 162 correspond to a length of caliber section 87 and the caliber diameter 90 thereof, respectively, of a projectile 80 with a chosen clearance of approximately five thousandths inch larger than the nominal caliber diameter 90 to enable the reception of a projectile 80. In this embodiment, diameter 162 of cylindrical hole 155A is identical to diameter 121 of cylindrical hole 115A of each cavity 110 of baseplate 110.

Countersunk hole 156A is configured to receive a projectile 80 nose 83 down and convey the projectile 80 therefrom nose 83 down to into cylindrical hole 155A, which is configured to drop the projectile 80 nose 83 down therefrom to into an underlying cavity 110 of baseplate 100 when loading plate 140 is stacked on baseplate 100. Countersunk hole 156A is chamfered upwardly at chosen depth 160 between upper part of cylindrical hole 155A and upper surface 145 of loading plate 140 at a chosen chamfer angle, which is 45° in this embodiment. The chamfer angle and depth 160 of countersunk hole 156A are chosen to facilitate reception of a projectile 80 therein nose 83 down and orienting of the projectile in the nose 83 down, trailing end 93 up orientation for reception downwardly to into and through cylindrical hole 155A. Countersunk hole 156A can inherently accommodate a variety of different projectile nose shapes, such as a round nose, a Spitzer nose, a semi-Spitzer nose, and other conical and frustoconical nose configurations.

As noted above, depositing projectiles 80 nose 83 down into the respective cavities 110 of baseplate 100 is facilitated by applying/stacking loading plate 140 onto baseplate 100 as shown in FIG. 4. To do this, loading plate 140 is oriented parallel to baseplate 100 with lower surface 146 disposed over and adjacent to upper surface 105 of baseplate 100, axially-aligning side 141 of loading plate 140 with side 101 of baseplate 100, side 142 of loading plate 140 with side 102 of baseplate 100, end 143 of loading plate 140 with end 103 of baseplate 100, end 144 of loading plate 140 with end 104 of baseplate 100, and guide openings 148 of loading plate 140 with guide pins 108 of baseplate 100. While maintaining this aligned position of loading plate 140 relative to baseplate 100, loading plate 140 is lowered/applied downwardly in the direction of arrow A over and onto baseplate 100 in FIG. 4 thereby lowering guide holes 148 over the respective guide pins 108 which slide therethrough while loading plate 140 is lowered toward baseplate 100 in the direction of arrow A until lower surface 146 comes to rest directly atop and in direct contact against upper surface 105 of baseplate 105 resulting in loading plate 140 stacked on baseplate 100. Importantly, reception of guide pins 108 in guide holes 148 automatically aligns loading holes 150 with the respective cavities 110 coaxially, which causes loading holes 150 to come together coaxially with the respective underlying cavities 110 in identical operative relationships when loading plate 140 is applied/stacked onto baseplate 100 to enable loading holes 150 to translate projectiles therethrough to into corresponding, coaxially-aligned, underlying cavities 110.

Guide pins 108 received into and through the respective complementing guide holes 148 in FIG. 4 ensure that each loading hole 150 is stacked coaxially atop a corresponding cavity 110 of baseplate 100 when loading plate 140 is lowered or otherwise stacked onto baseplate 100 as shown in FIG. 5. Guide pins 108 and guide holes 148 provide precision alignment in stacking loading plate 140 onto baseplate 100 to ensure each loading hole 150 of loading plate 140 is stacked atop a corresponding cavity 110 of baseplate 100 coaxially thereby operatively positioning each loading hole 150 to receive a projectile 80 nose 83 down and drop the projectile 80 in the nose 83 down, trailing end 93 up orientation to into a corresponding underlying cavity 110.

Guide pins 108 of baseplate 100 are one of guide elements and complemental guide elements, and guide holes 148 of loading plate 140 are the other one of the guide elements and the complemental guide elements, wherein the guide elements interact with the complemental guide elements coaxially aligning loading holes 150 with the respective cavities 110 coaxially in response to applying loading plate 140 over baseplate 100. Each guide pin 108 and corresponding guide hole 148 are complementing alignment pairs. Although for each alignment pair the guide pin 108 is carried by baseplate 100 and the guide hole 148 is carried by loading plate 140, this can be reversed.

FIG. 5 is a section view taken along line 5-5 of FIG. 4 illustrating loading plate 140 stacked onto baseplate 100, and a loading hole 150 stacked coaxially atop an underlying cavity 110 in baseplate 100. Each loading hole 150 of loading plate 140 identically relates to an underlying cavity 110 as shown in FIG. 5 when loading plate 140 is stacked atop baseplate 100, and the ensuing discussion of the stacked loading hole 150 and cavity 110 in FIG. 5 applies to each stacked loading hole 150 and cavity 110 of the stacked loading plate 140 and baseplate 100. In FIG. 5, loading hole 150 is aligned coaxially with an underlying cavity 110. Lower hole 126 extends upwardly from lower surface 106 of baseplate 106 to frustoconical hole 117A.

Figure 9:
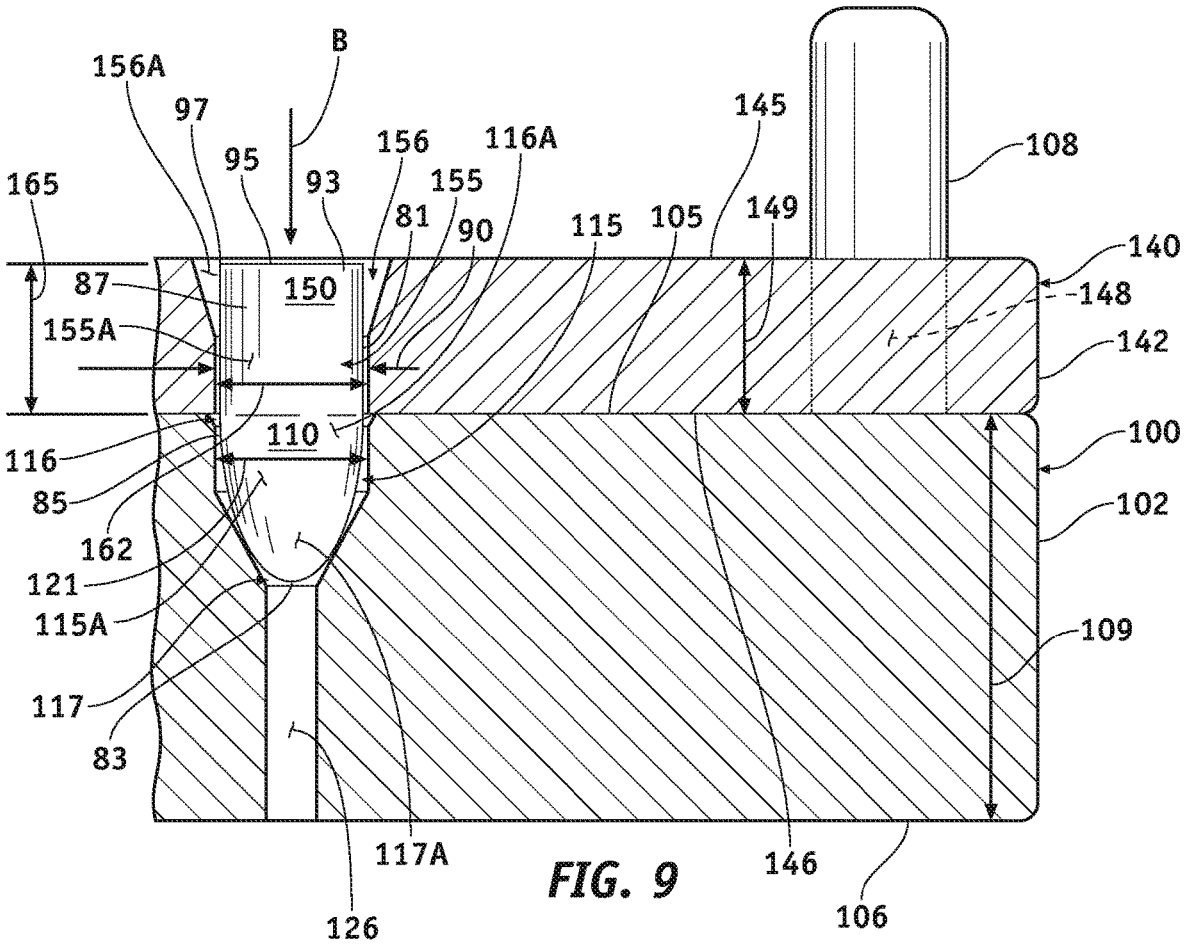
FIG. 9 is a section view taken along line 9-9 of FIG. 8 illustrating a projectile according to FIG. 1 loaded into the loading plate and the baseplate, the projectile (shown un-sectioned for illustrative purposes) being loaded nose down into a cavity of the baseplate through a countersunk hole of the overlying loading plate and held in a nose down, trailing end up orientation.

After applying loading plate 140 to baseplate 100 as shown in in FIG. 4, forming stacked loading and baseplate 140 and 100 and coaxially stacked loading holes 150 and cavities 110, projectiles 80 are introduced nose 83 first into the loading holes 150 through the countersunk holes 156A thereof, which enables projectile 80 to drop downwardly by gravity in the nose 83 down, trailing end 93 up orientation through the corresponding loading holes 150 and to into the corresponding underlying cavities 110. In a particular example, shown in FIG. 6 projectiles are spread across upper surface 145 of loading plate 140 and manipulated, such as by hand and/or by tilting and/or by vibrating the stacked plates 100 and 140, nose 83 down to into the loading holes 150 through each countersunk hole 156A. Referring to FIG. 9, s each projectile 80 drops downwardly by gravity in the direction of arrow B in FIG. 9 in the nose 83 down, trailing end 93 up orientation through a loading hole 150 and to into a corresponding underlying cavity 110. In another embodiment, shown in FIG. 7 stacked loading and baseplates 140 and 100 according to FIG. 4 are placed on an inclined base 171 of a loading box or hopper 170. Projectiles 80 are poured into hopper 170 over upper surface 145 of loading plate 140. As projectiles 80 slide downwardly over upper surface 145 of loading plate 140, most of projectiles 80 will be received in loading holes 150 and directed nose 83 down into the corresponding baseplate cavities 110 each as in FIG. 9. Loose projectiles 80 that collect in hopper 170 are moved over upper surface 145 of loading plate 140 and recirculated to repeatedly slide over upper surface 145, such as by hand as shown and/or by tilting and/or vibrating stacked plates 140 and 100 until each cavity 110 of baseplate 100 is loaded with a projectile 80. Any projectiles 80 not seated in cavities 110 in the nose 83 down, trailing end 93 up orientation are then reoriented, such as by hand. As previously noted, when a projectile 80 is received in a cavity 110 of baseplate 100 trailing end 93 down, the projectile 80 nose 83 will extend a greater distance above upper surface 105 of baseplate 100 compared to a properly nose 83 down, trailing end 93 up oriented projectile 80, which enables an ordinary observer to visually identify and correct any improperly-oriented projectiles 80.

Figure 6:
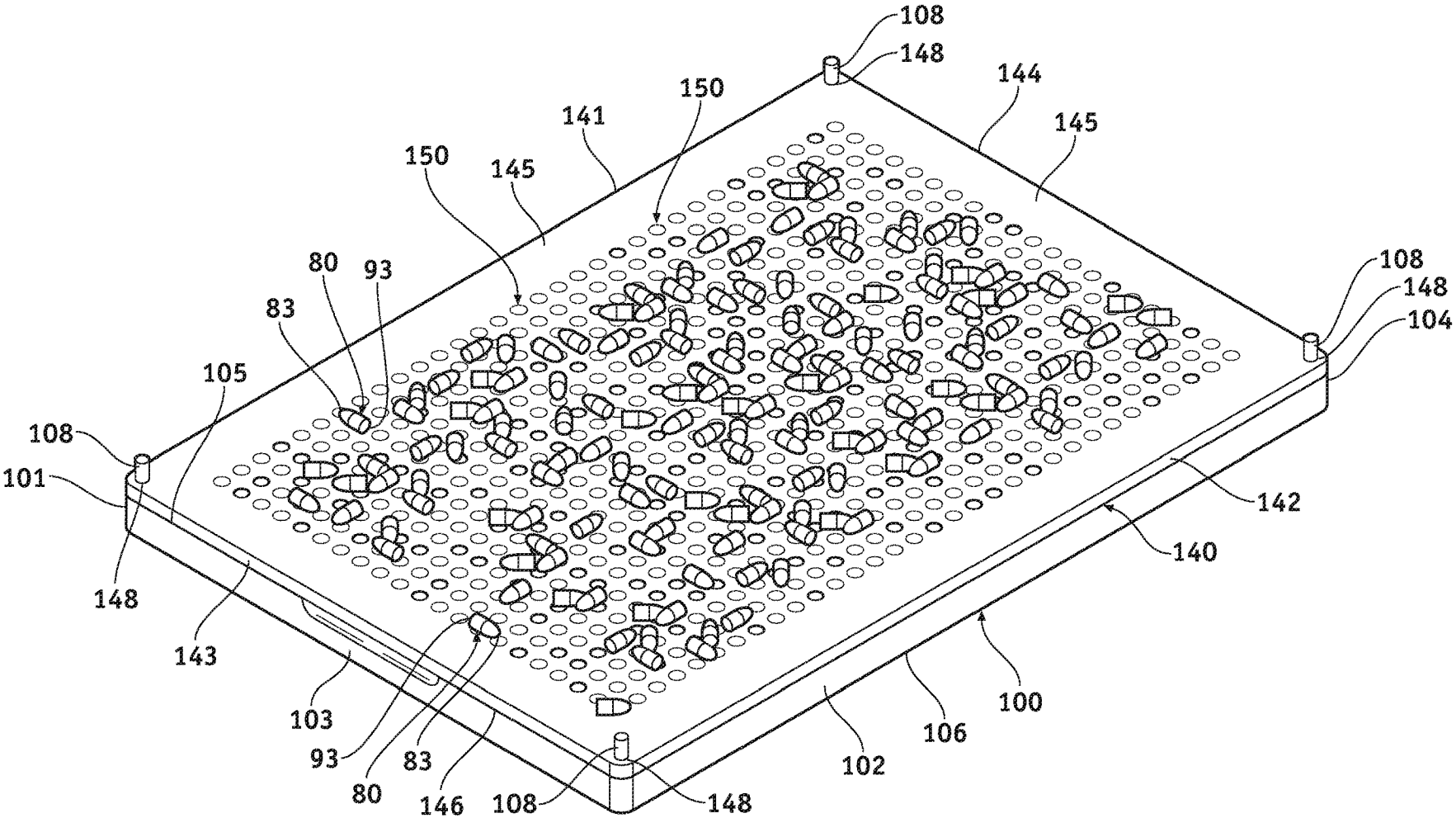
FIG. 6 is a perspective view of the embodiment of FIG. 4 and projectiles each according to FIG. 1 scattered across the loading plate in a method of loading the baseplate with the projectiles.
Figure 7:
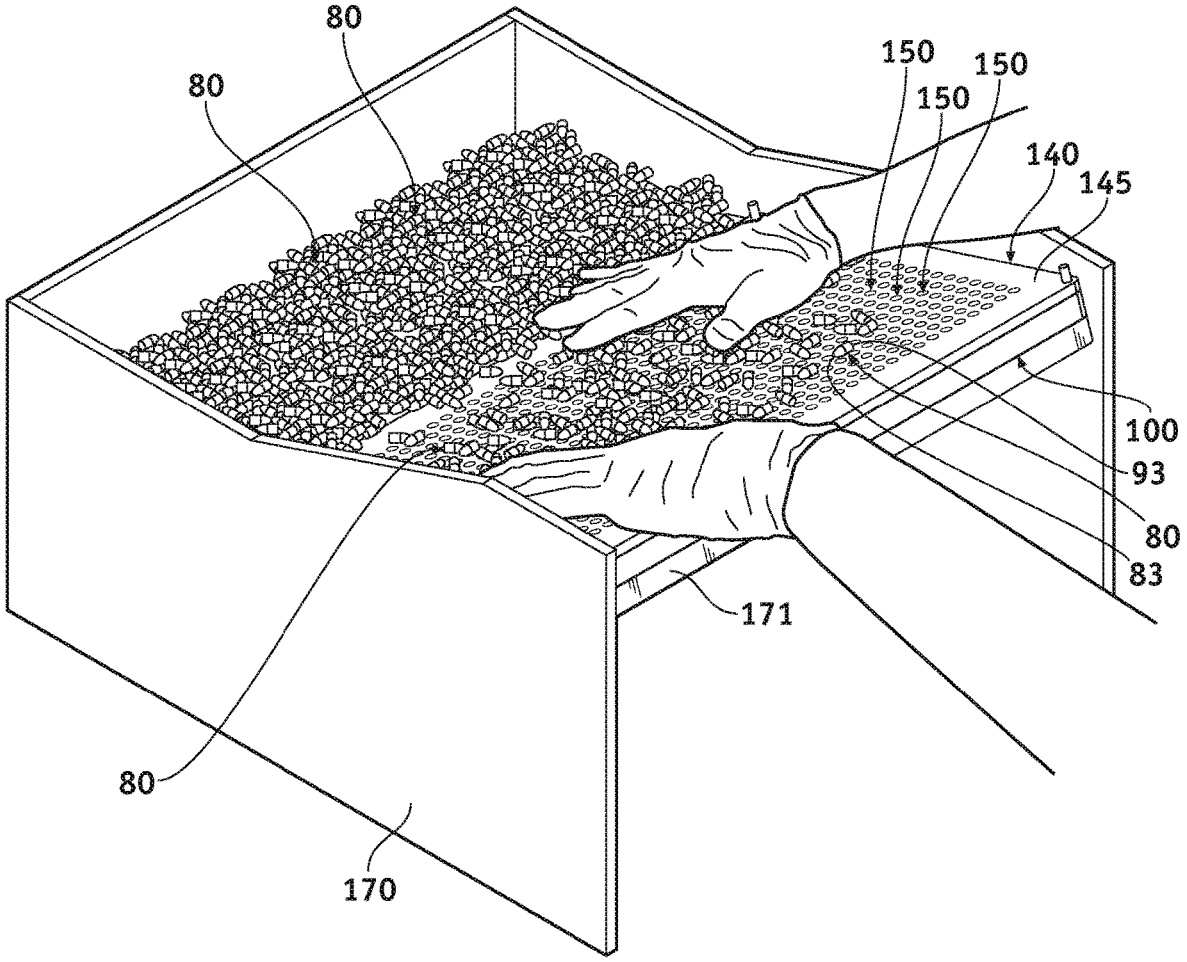
FIG. 7 is a perspective view of the embodiment of FIG. 4 positioned in a loading box or hopper charged with projectiles each according to FIG. 1 and shown being manually scattered across the loading plate in an alternate method of loading the baseplate with the projectiles.
Figure 8:
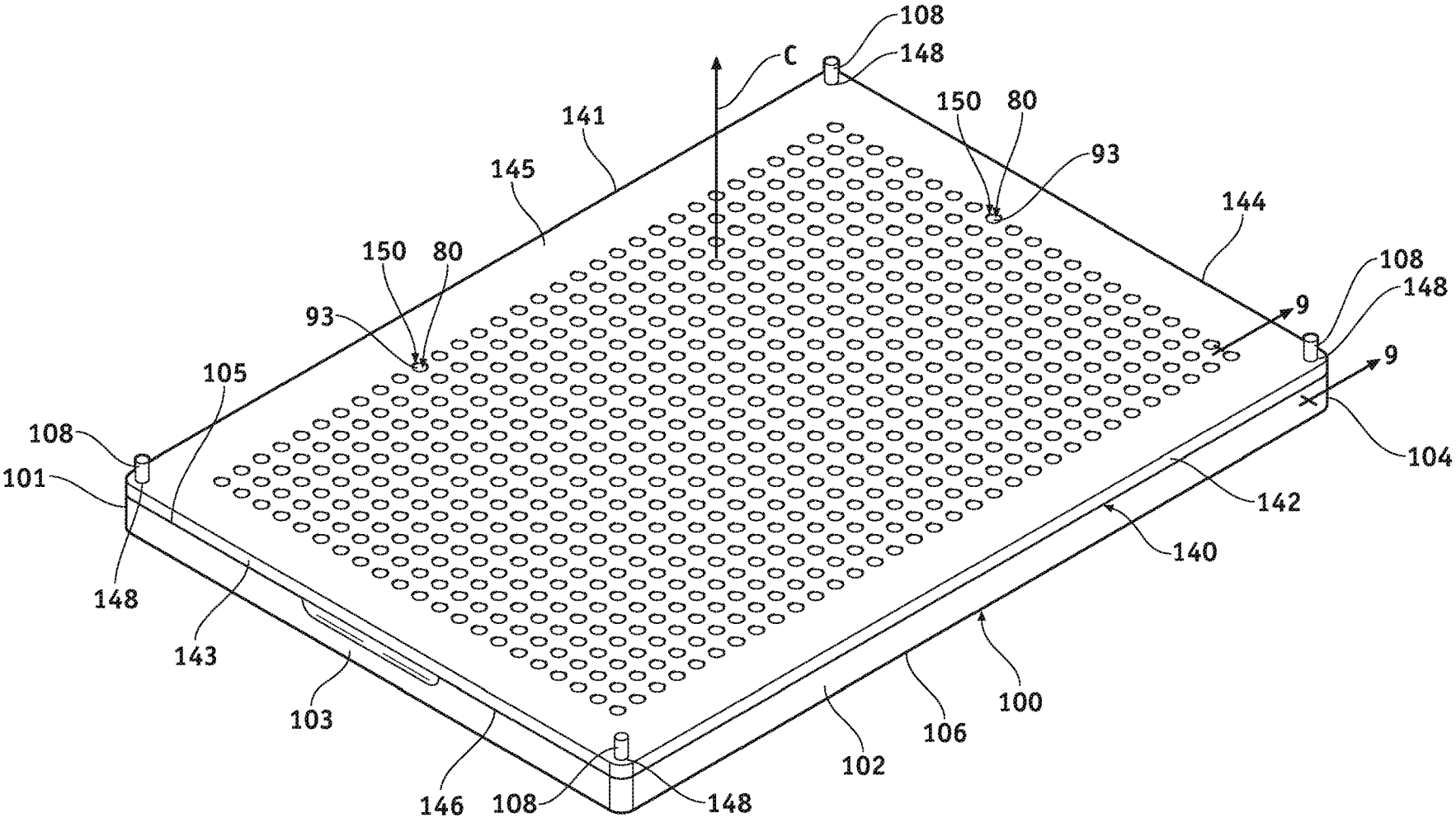
FIG. 8 is a perspective view illustrating the baseplate and the loading plate stacked thereon, as illustrated in FIG. 4, loaded with projectiles each according to FIG. 1.

FIG. 8 is a perspective view illustrating baseplate 100 and loading plate 140 stacked thereon loaded with projectiles 80, as by the methods shown FIGS. 6 and 7. FIG. 9 is a section view taken along line 9-9 of FIG. 8 illustrating a projectile 80 loaded into loading plate 140 and baseplate 100, namely, into a loading hole 150 of loading plate 140 and an underlying coaxially-aligned cavity 110 of baseplate 100. Each projectile 80 in the embodiment of FIG. 8 is identically loaded into a loading hole 150 and a coaxially-aligned cavity 110 of stacked loading plate 140 and baseplate 100 as precisely shown in FIG. 9. In FIG. 9, projectile 80 is loaded nose 83 down into a cavity 110 of baseplate 100 through an overlying coaxially-aligned countersunk loading hole 150 of loading plate 140 and held by cavity 110 and loading hole 150 in the nose 83 down, trailing end 93 up orientation, the projectile 80 in FIG. 9 having been dropped downwardly in the direction of arrow B nose 83 down into and through loading hole 150 from countersunk hole 156A to cylindrical hole 155A and from cylindrical hole 155A to into frustoconical hole 117A through countersunk hole 116A and cylindrical hole 115A, respectively. As best seen in FIG. 9, nose 83 is received by and is seated in frustoconical hole 117A of cavity 110, and extends upright to and through the lower part of cylindrical hole 115A with shoulder 85 disposed in cylindrical hole 115A. Caliber section 87, in turn, extends upright through countersunk hole 116A from shoulder 85 and the upper part of cylindrical hole 115A through and beyond upper surface 105 of baseplate 100. Caliber section 87 extends beyond surface 105 by a chosen distance 165 into and through cylindrical hole 155A through lower surface 146 of loading plate 140 and upwardly beyond cylindrical hole 155A to into countersunk hole 155A such that trailing end 93 is positioned proximate to upper surface 145 of loading plate 140.

Figure 11:
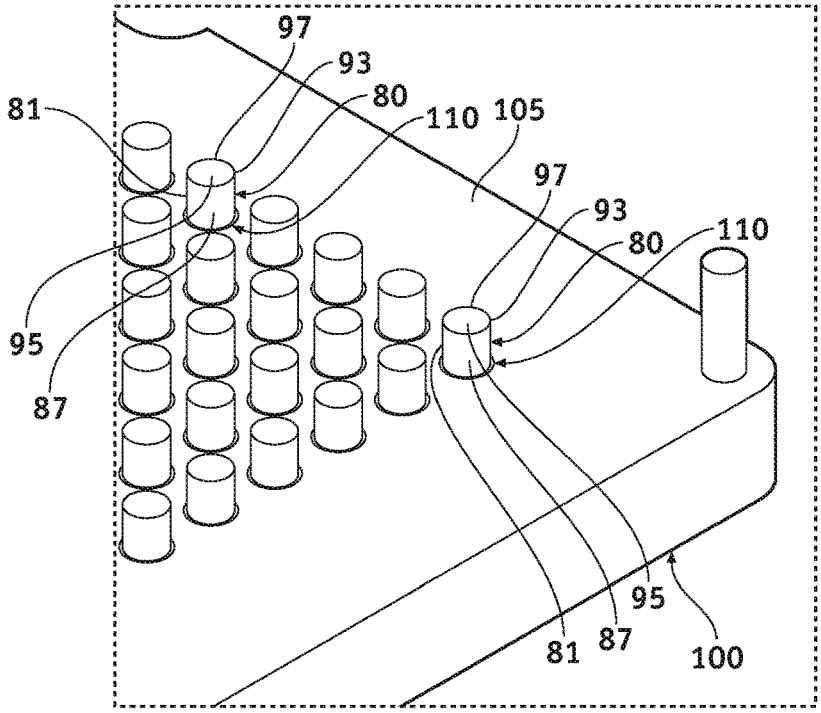
FIG. 11 is an enlarged, fragmentary view of an area designated by a dotted line box in FIG. 10 to better illustrate the projectiles loaded into the baseplate in the nose down, trailing end up orientation extending upright from the baseplate to the trailing ends and the rear surfaces thereof exposed above the baseplate.

When each cavity 110 is identically loaded with a projectile 80 as in FIG. 8 in the nose 83 down, trailing end 93 up orientation as shown in FIG. 9, the method next includes withdrawing loading plate 140 from over baseplate 100 and projectiles 80 loaded in cavities 110 in preparation for further operations. Loading plate 140 is raised upwardly in the direction of arrow C in FIG. 8, such as by hand, thereby withdrawing projectiles 80 from the loading holes 150 while leaving projectiles 80 installed in and secured by the respective cavities 110 each in the nose 83 down, trailing end 93 up orientation as shown in in FIG. 10. Rear surfaces 95 of projectiles 80 are identically secured in the nose 83 down, trailing end 93 up orientation are coplanar. As best seen in FIG. 11 (an enlarged, fragmentary view of an area designated by a dotted line box B1 of FIG. 10) and FIG. 12 (a section view taken along line 12-12 of FIG. 11 illustrating one projectile 80 installed in a cavity 110 of baseplate 100) projectiles 80 are identically loaded into and secured in respective cavities 110 of baseplate 100 in the nose 83 down, trailing end 93 up orientation extending upright from the respective cavities 110 to above upper surface 105 of baseplate 100 with trailing ends 93 and rear surfaces 95 thereof identically exposed, coplanar above upper surface 105 of baseplate 100 by distance 165.

With specific reference to FIG. 12, projectile 80 is seated in cavity 110 of baseplate 100 as described in connection with FIG. 9 and extends vertically upright beyond upper surface 105 of baseplate 100 chosen distance 165, thereby leaving a length of caliber section 87 extending downwardly from trailing end 93, including rear surface 95 and perimeter edge 97 thereof, exposed to a distance 165 above upper surface 105 of baseplate 100. This enables the projectiles to interact with the stabilizer plate and the masking plate discussed in detail below. Depth 110A of cavity 110, the sum of depths 120 and 125 and the inherent depth of upper portion 116 from upper surface 106 of baseplate 100 to the upper part of intermediate portion 115, corresponds to a corresponding length of projectile 80 from caliber section 87 adjacent to shoulder 85 to the end of nose 83. Diameter 121 corresponds to caliber diameter 90 of projectile 80 with a chosen clearance, e.g., of approximately five thousandths inch larger than the nominal caliber diameter 90. Such configuration enables the reception and securing of a projectile 80 by cavity 110 in the nose 83 down, trailing end 93 up orientation when seated nose 83 down in frustoconical hole 117A as shown in FIG. 12. Reference is repeatedly made throughout this specification to the nose 83 down, trailing end 93 up orientation of a projectile 80. When reference is made to the nose 83 down, trailing end 93 up orientation of a projectile 80, FIG. 12 is exemplary of that orientation.

Having provided projectiles 80 and baseplate 100 and having deposited projectiles 80 nose 83 down into the respective cavities 110 as shown in FIG. 10, the cavities 110 identically securing/holding the projectiles 80 with trailing ends 93 and rear surfaces 95 identically exposed above upper surface 105, enhanced bond strength of the hardenable photoluminescent material to rear surfaces 95 of projectiles 80 results from uniformly texturizing each rear surface 95. An appropriate texture on rear surface 95 inherently and uniformly increases the surface area of rear surface 95, enabling an aggressive adhesion of the hardenable photoluminescent material to be subsequently deposited on each rear surface 95. In one embodiment, the step of texturizing each rear surface 95 includes roughening each rear surface 95, such as by abrading or abrasive-blasting each rear surface 95, wherein the roughening of each rear surface 95 is uniform. In another embodiment, the step of texturizing each rear surface 95 includes cutting a texture into each rear surface 95, such as by laser-cutting, wherein the texture of each rear surface 95 is uniform. Texturing rear surface 95 is preferably carried out while projectiles 80 are secured by baseplate 100 in the nose 83 down, trailing end 93 up orientation to ensure projectiles rear surfaces 95 are textured uniformly.

Figure 13:
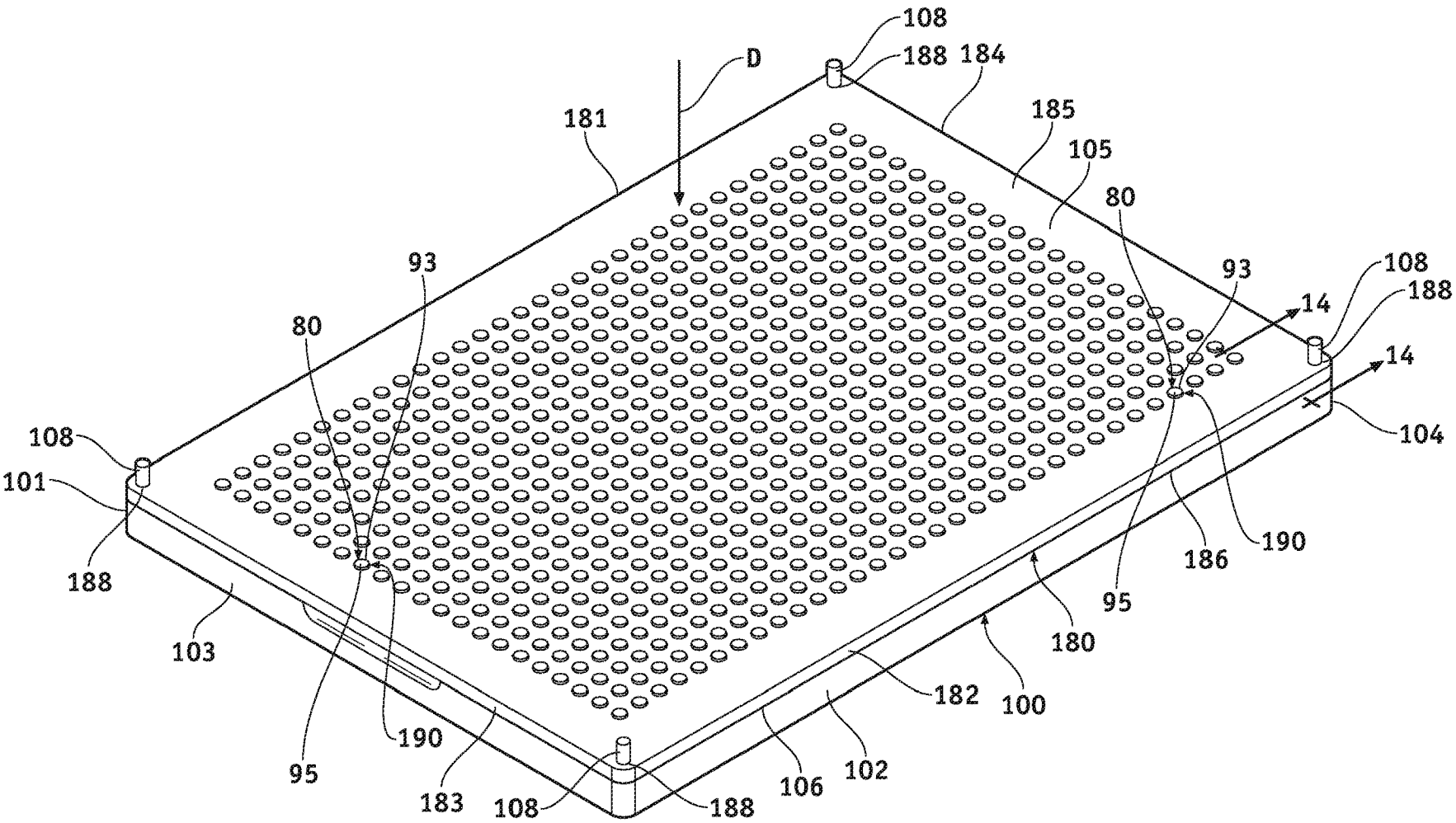
FIG. 13 is a perspective view of a stabilizer plate positioned over the baseplate and the projectiles of the embodiment of FIG. 10.

Texturing rear surfaces 95 while projectiles 80 are held by baseplate 100 each in the nose 83 down, trailing end 93 up orientation, whether by roughening rear surfaces 95 or cutting a texture into rear surfaces 95, preferably first includes stabilizing projectiles 80 relative to baseplate 100 and concurrently isolating trailing ends 93 and their respective rear surfaces 95 for preventing the balance of the projectiles from interacting with the texturing process that could otherwise render the projectiles unsuitable. In exemplary method, which is inexpensive, efficient, and which does not require specialized skill or expensive equipment, this is done by providing a stabilizer plate 180 and applying/stacking stabilizer plate 180 over baseplate 100 and projectiles 80. Referring to FIG. 13, stabilizer plate 180 is configured to be repeatedly applied over or otherwise stacked onto baseplate 100 loaded with projectiles 80 for stabilizing projectiles 80 and isolating trailing ends 93 and rear surfaces 95 thereof in preparation for texturing, whether by roughening or cutting a texture into rear surfaces 95, and unstacked or otherwise withdrawn from baseplate 100 and projectiles 80, and without having to make modifications to either stabilizer plate 180 or baseplate 100, and leaving projectiles 80 in place on baseplate 100. Stabilizer plate 180 can be manipulated by hand, or by mechanized handling equipment.

Stabilizer plate 180 is portable, being able to be easily carried or moved about by hand, is fashioned of a material or combination of materials having inherently rigid, resilient, rugged, wear-resistant, chemical-resistant, and thermally-conductive material characteristics, such as anodized aluminum, steel, or other metal or metal composite. Stabilizer plate 180 is broad, flat, and generally rectangular in overall shape in this example, substantially coextensive with respect to baseplate 100 (and the previously-described loading plate 140), and includes opposed, parallel, identical elongate sides 181 and 182 extending between opposed, parallel, and comparatively shorter and identical elongate ends 183 and 184, and opposed, coextensive and parallel upper and lower surfaces 185 and 186. Sides 181 and 182 converge with ends 183 and 184 at four respective corners of stabilizer plate 180. Identical guide holes 188 extend through thickness 189 (FIGS. 14 and 15) of stabilizer plate 180 from upper surface 185 to lower surface 186 proximate to the respective corners. Guide openings 188 of stabilizer plate 180 are configured to receive therethrough guide pins 108 of baseplate 100 when stabilizer plate 180 is applied over and installed atop, i.e. stacked on, baseplate 100 as in FIG. 13 for properly aligning stabilizer plate 180 with baseplate 100. Thickness 189 of stabilizer plate 180 in FIGS. 14 and 15 from upper surface 185 to lower surface 186 is less than thickness 149 of the previously-described loading plate 140, and is less than distance 165 of the length of caliber section 87 of a projectile 80 loaded in baseplate 100 extending above upper surface 105 of baseplate 100.

Stabilizer plate 180 is configured with respective stabilizer holes 190 each corresponding to a cavity 110 in baseplate 100, configured to receive therethrough a caliber section 87 of a projectile 80 loaded nose 83 down, trailing end 93 up in baseplate 100 when stabilizer plate 180 is stacked on baseplate 100. Stabilizer holes 190 are formed through thickness 189 of stabilizer plate 180, are identical, and are equally spaced-apart. In this example, stabilizer holes 190 are numbered and arranged/patterned identically to cavities 110 of baseplate 110, namely, in rows that are parallel relative ends 183 and 184 and perpendicular relative to sides 181 and 182. Each row from side 181 to side 182 includes twenty-one stabilizer holes 190, and there are thirty-two parallel rows of stabilizer holes 190 from end 183 to end 184. Accordingly, in this embodiment baseplate 100 incorporates a pattern of six-hundred and seventy-two cavities 110 each for identically receiving and holding a projectile in the nose down, trailing end up orientation, and stabilizer plate 180 incorporates an identical pattern and number, six-hundred and seventy-two in this example, of stabilizer holes 190 each for identically receiving therethrough a caliber section 87 of a projectile 80 loaded nose 83 down, trailing end 93 up in baseplate 100. A stabilizer plate constructed and arranged in accordance with the principle of the invention can have varying dimensions and less or more stabilizer holes to match the number of cavities of a baseplate constructed and arranged in accordance with the invention. Stabilizer holes 190 are identical. Accordingly, the details of one stabilizer hole 190 are discussed in detail in conjunction with FIGS. 14 and 15, with the understanding that the ensuing discussion of stabilizer hole 190 in FIGS. 14 and 15 applies in every respect to each stabilizer hole 190 of stabilizer plate 180 of FIG. 13.

Figure 14:
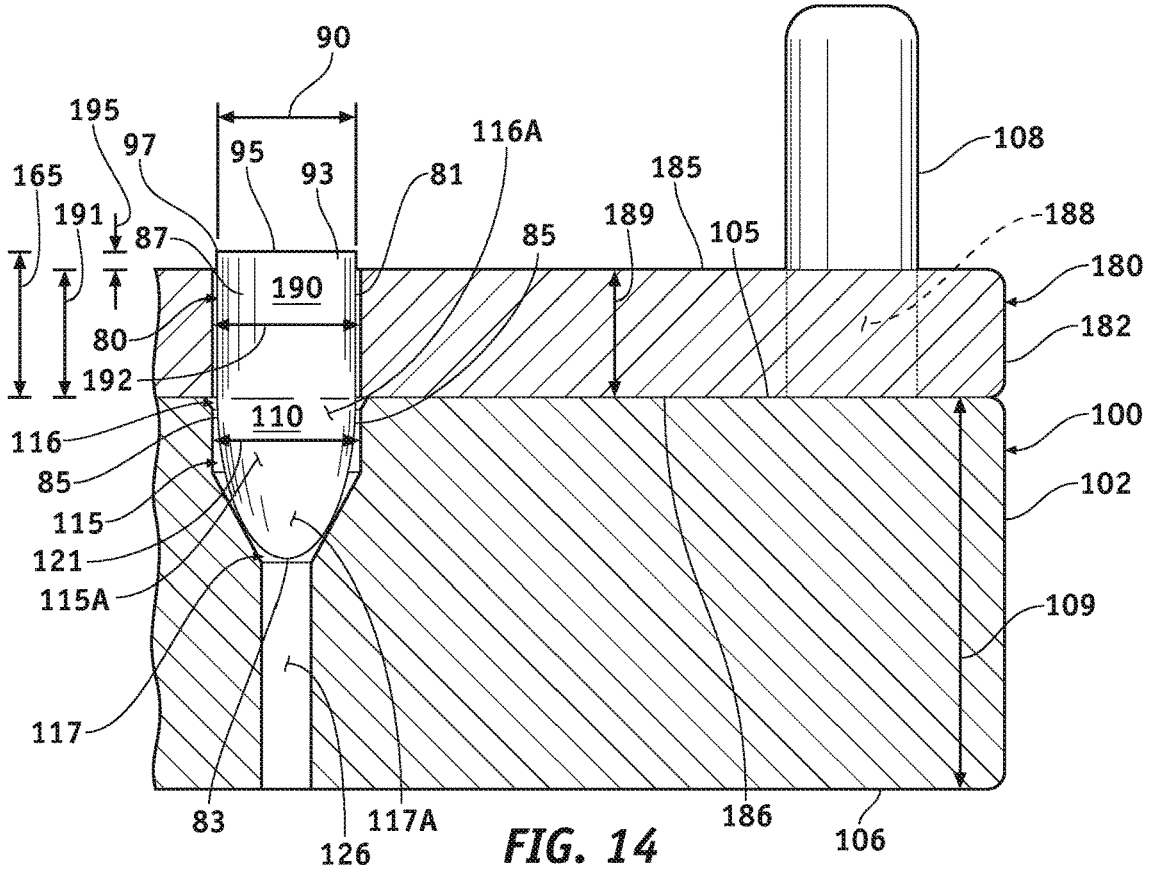
FIG. 14 is a section view taken along line 14-14 of FIG. 13 illustrating a projectile according to FIG. 1 loaded into the stabilizer plate and the baseplate, the projectile (shown un-sectioned for illustrative purposes) being loaded nose down into a cavity of the baseplate and a stabilizer hole of the stabilizer plate and held in a nose down, trailing end up orientation, and a length of the projectile extending upright from the underlying baseplate through the stabilizer hole and upwardly beyond the stabilizer plate to the trailing end and the rear surface thereof exposed above the stabilizer plate.
Figure 15:
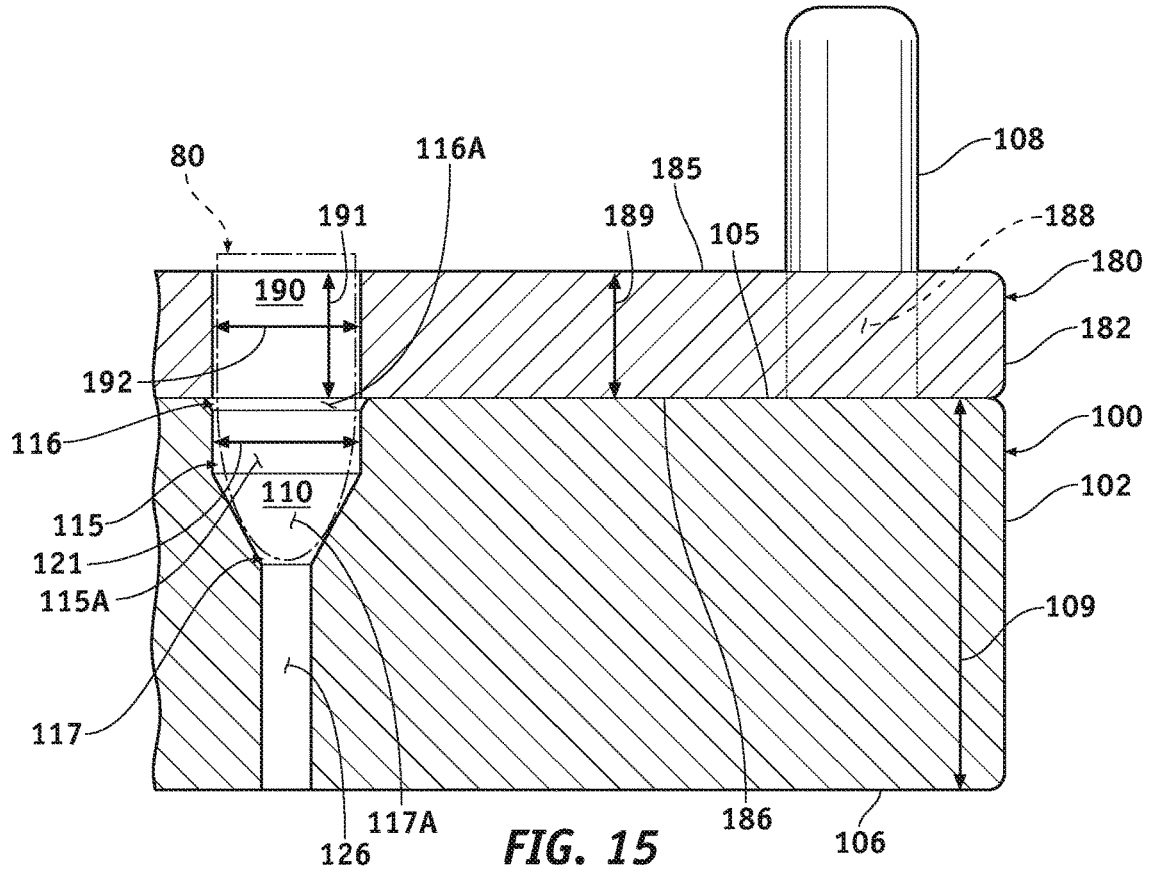
FIG. 15 is a view like that of FIG. 14 illustrating the projectile in phantom line to better illustrate the relationship between the stabilizer hole of the stabilizer plate and the cavity of the underlying baseplate.

Referring to FIGS. 14 and 15, stabilizer hole 190 is a hollow space milled, molded, or otherwise formed in thickness 189 of the material of stabilizer plate 180 from upper surface 185 to lower surface 186. Stabilizer hole 190 is a cylindrical hole that extends through thickness 189 of stabilizer plate 180 from upper surface 185 to lower surface 186. Stabilizer hole 190 has a depth 191, corresponding to thickness 189 of stabilizer plate 180, from upper surface 185 to lower surface 186, and a diameter 192. Depth 191 corresponds to length of caliber section 87 extending above surface 105 of baseplate 100 and diameter 192 corresponds to caliber diameter 90 of caliber section 87 of a projectile 80 with a chosen clearance of approximately five thousandths inch larger than the nominal caliber diameter 90 to enable the reception of a projectile 80. In this embodiment, diameter 192 of stabilizer hole 190 is identical to diameter 121 of cylindrical hole 115A of each cavity 110 of baseplate 110, and depth 191 of stabilizer hole 190 is less than distance 165. W. If desired, the bottom of stabilizer holes 190 may be chamfered in a manner analogous to upper portion 116 of cavity 110, to facilitate receiving the trailing ends of projectiles 80 therethrough.

Having provided stabilizer plate 180, the step of stabilizing projectiles 80 relative to baseplate 100 and concurrently isolating trailing ends 93 in advance of texturing further includes applying/stacking stabilizer plate 180 onto baseplate 100 and over projectiles 80. Referring to FIG. 13, stabilizer plate 180 is oriented parallel to baseplate 100 with lower surface 186 over upper surface 105 of baseplate 100, such that guide openings 188 of stabilizer plate 180 receive guide pins 108 of baseplate 100. Guide pins 108 extend higher than the ends of projectiles 80 extending above surface 105 of the baseplate. The corresponding guide openings 188 receive the guide pins 108 and bring all of the various features of stabilizer plate 180 into alignment with the corresponding features of baseplate 100. This axially-aligns side 181 of loading plate 180 with side 101 of baseplate 100, side 182 of loading plate 180 with side 102 of baseplate 100, end 183 of loading plate 180 with end 103 of baseplate 100, end 184 of loading plate 180 with end 104 of baseplate 100, and the respective stabilizer holes 190 with the corresponding cavities 110 on baseplate 100 as stabilizer plate 180 is lowered/applied downwardly in the direction of arrow D over and onto baseplate 100. Stabilizer holes 190 are thus concurrently lowered over the respective projectiles 80, which slide therethrough trailing ends 93 first, until lower surface 186 comes to rest directly atop and in direct contact against upper surface 105 of baseplate 105. More specifically, lengths of caliber sections 87 of the respective projectiles 80 extend upright from upper surface 105 of baseplate 100 through the respective stabilizer holes 190 (from lower surface 186 of stabilizer plate 180 to upper surface 185 of stabilizer plate 180) and beyond upper surface 185 of stabilizer plate 180 such that trailing ends 93 are disposed above upper surface 186 by a chosen distance 195. Reception of guide pins 108 in guide holes 188 automatically aligns stabilizer holes 190 with the respective cavities 110 and projectiles 80 therein coaxially, which causes stabilizer holes 190 to identically accept the respective projectiles therethrough trailing ends 93 first and to come together coaxially with the respective cavities 110 in identical operative relationships when stabilizer plate 180 is applied/stacked onto baseplate 100 loaded with projectiles 80.

Guide pins 108 of baseplate 100 are one of guide elements and complemental guide elements, and guide holes 188 of stabilizer plate 180 are the other one of the guide elements and the complemental guide elements, wherein the guide elements interact with the complemental guide elements coaxially aligning stabilizer holes 190 with the respective cavities 110 and trailing ends 93 coaxially in response to applying stabilizer plate 180 over baseplate 100 and projectiles 80. Each guide pin 108 and corresponding guide hole 188 are complementing alignment pairs. Although for each alignment pair the guide pin 108 is carried by baseplate 100 and the guide hole 188 is carried by stabilizer plate 140, this can be reversed.

FIG. 14 is a section view taken along line 14-14 of FIG. 13 illustrating stabilizer plate 180 stacked onto baseplate 100, and a stabilizer hole 190 stacked coaxially atop an underlying cavity 110 in baseplate 100 and applied over a projectile 80 loaded in the underlying cavity 110 of baseplate 100 in the nose 83 down, trailing end 93 up orientation. Each projectile 80 in the embodiment of FIG. 13 is identically loaded into a stabilizer hole 190 and a coaxially-aligned cavity 110 of stacked loading plate 140 and baseplate 100 as precisely shown in FIG. 14. FIG. 15 is the same as FIG. 14, only that the projectile 80 is depicted in phantom line to better illustrate the stacked, coaxial relationship between the stabilizer hole 190 and the underlying cavity 110.

As shown in FIG. 14, projectile 80 is seated in cavity 110 of baseplate 100, secured in a nose down tail end up orientation, as previously described in conjunction with FIGS. 9-12, with a portion of caliber section 87 upright beyond upper surface 105 of baseplate 100 distance 165. This portion of caliber section 87 extends into and through depth 191 of stabilizer hole 190 of stabilizer plate 186 and upwardly beyond upper surface 185 of stabilizer plate 180 such that trailing end 93, and upper surface 95 and perimeter edge 97 thereof, are disposed a relatively small distance 195 above upper surface 185 of stabilizer plate 180. As explained above, thickness 189 of stabilizer plate 180 in FIGS. 14 and 15 from upper surface 185 to lower surface 186 is slightly less than distance 165 of the length of caliber section 87 of projectile 80 extending above upper surface 105 of baseplate 100. Thus, only rear surface 95 and perimeter edge 97 and a relatively short length of caliber section 87 extending downwardly adjacent to trailing end 93, (corresponding to distance 195) are exposed above upper surface 185 of stabilizer plate 180. This isolates trailing end 93 at its rear surface 95 above upper surface 185 of stabilizer plate 180 from the rest of projectile 80 extending downwardly into stabilizer hole 190. Depth 191 and diameter 192 of stabilizer hole 190 through which caliber section 87 extends are sufficient to stabilize projectile 80 in advance of texturing and to conceal that length of caliber section 87 from being exposed to the texturing process. Distance 195, which is approximately 1 mm in this example, is sufficient to ensure that stabilizer plate 180 does not interfere with the texturizing of projectile 80 rear surface 95 and that trailing end 93 and rear surface are isolated from the rest of projectile 80 and sufficiently exposed above upper surface 185 of stabilizer plate 180 to enable the texturing of rear surface 95.

Figure 16:
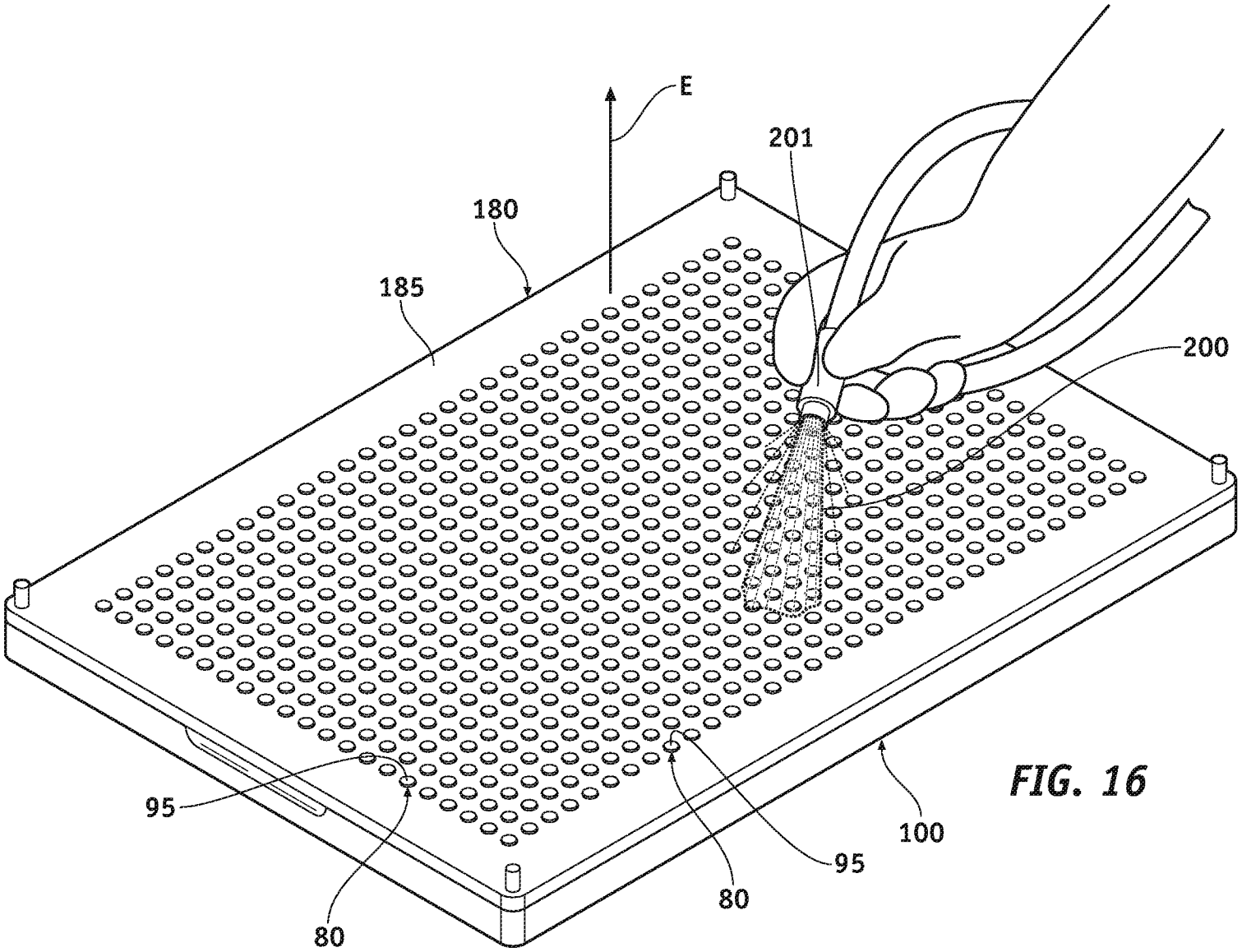
FIGS. 16 and 17 are views corresponding to FIG. 13 illustrating methods of texturizing the rear surfaces of the projectiles, by roughening the rear surfaces uniformly in FIG. 16, and by cutting a uniform texture into the rear surfaces in FIG. 17.
Figure 17:
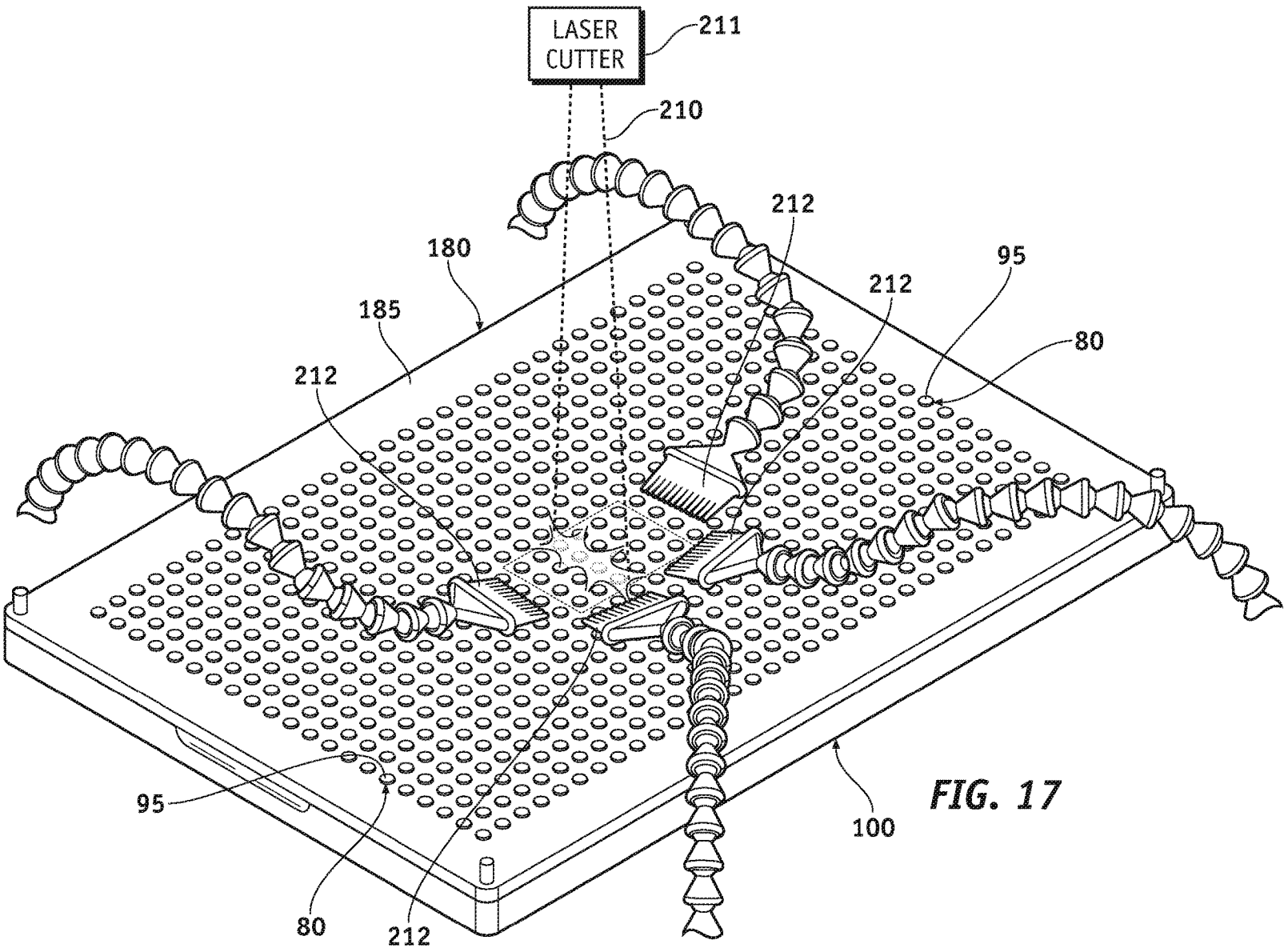

Having installed projectiles 80 in the nose 83 down, trailing end 93 up orientation in baseplate 100 and stabilized projectiles 80 with stabilizer plate stacked on baseplate 100 and over projectiles 80 as shown in FIG. 13, the step of texturing each rear surface 95 uniformly by roughening each rear surface 95 can include abrasive-blasting each rear surface 95 as illustrated in FIG. 16. In another embodiment, the step of texturizing each rear surface 95 uniformly by cutting a texture into each rear surface 95 can include laser-cutting the texture into each rear surface 95 as illustrated in FIG. 17.

Roughening rear surfaces 95 can include abrasive brushing, sanding, or milling. In an exemplary embodiment shown in FIG. 16, abrasive blasting is preferred because it is easy, efficient, and ensures rear surfaces 95 are roughened uniformly to enable hardenable material applied thereon to spread/slump uniformly. Abrasive blasting rear surfaces 95 includes forcibly propelling a stream 200 of abrasive material, such as from a hand-held nozzle 201, against rear surfaces 95 under high pressure to inherently roughen rear surfaces 95 uniformly and remove surface contaminants. The amount of time that the abrasive stream is held on each projectile can be uniform to ensure uniform patterns. The blasting material, often called the media, is typically propelled by compressed air or a centrifugal wheel. Abrasive blasting is simple, efficient, cost-effective, and readily produces uniform roughening of rear surfaces 95, and is thereby preferred. Although nozzle 201 is hand-held in this example, it can be part of a mechanized abrasive blaster.

Figure 18:
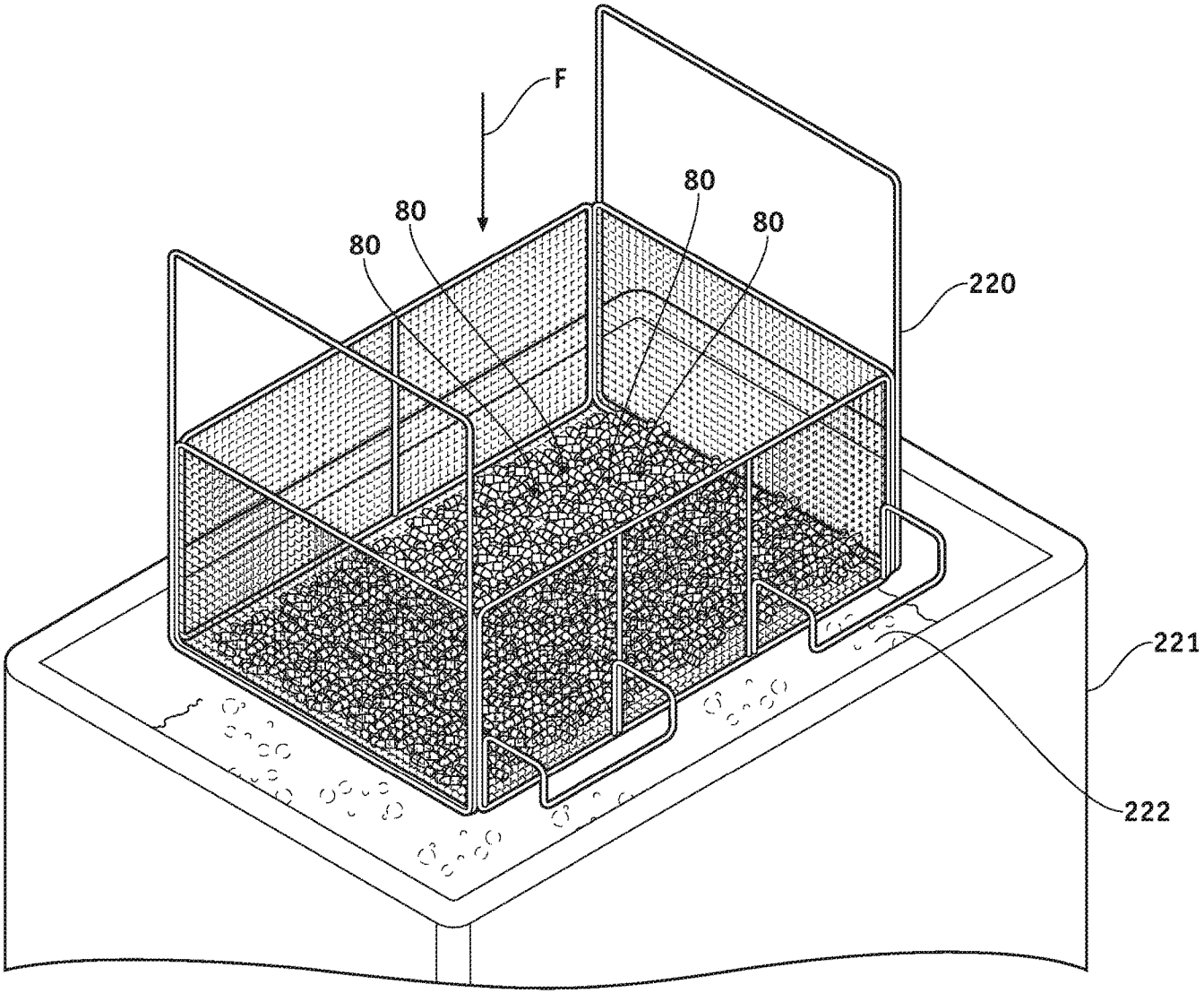
FIGS. 18-22 illustrate steps of cleaning the projectiles, inherently including the rear surfaces of the projectiles, following texturing the rear surfaces of the projectiles illustrated in FIGS. 16 and 17 and after the projectiles have been withdrawn from the baseplate.
Figure 19:
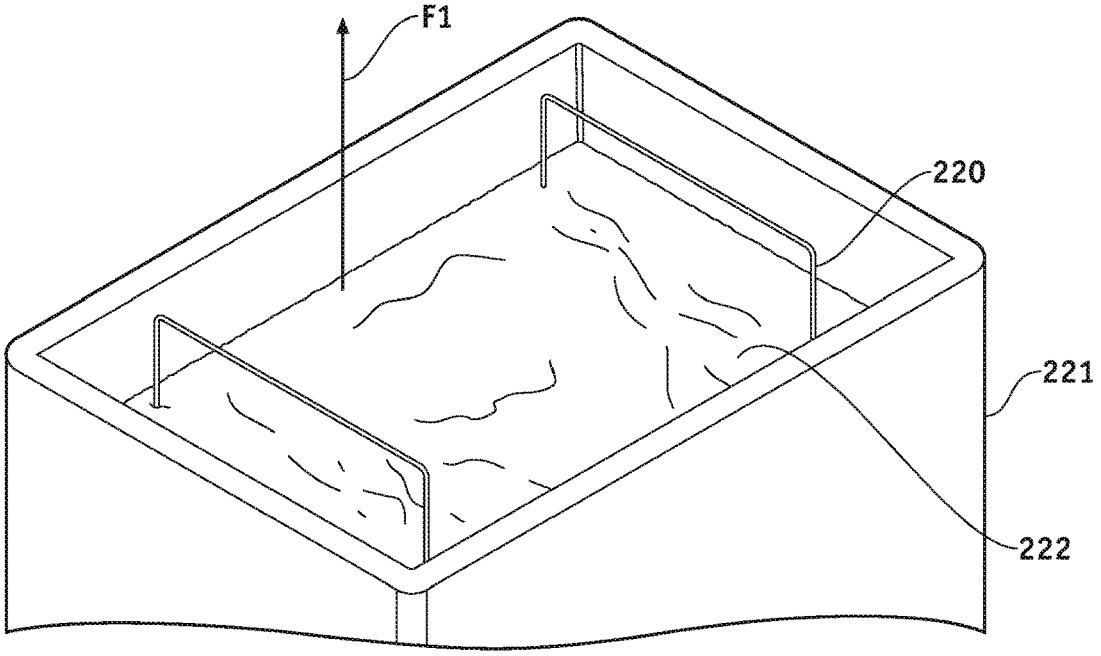
Figure 20:
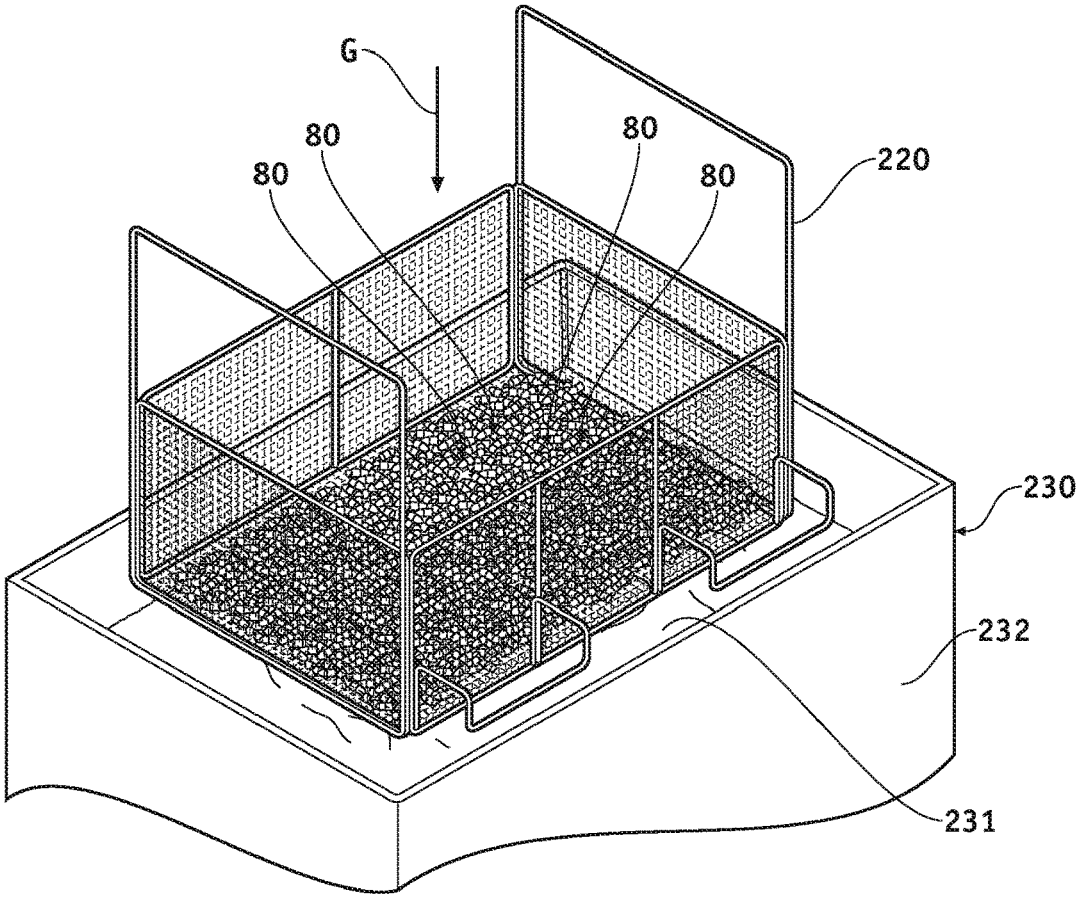
Figure 21:
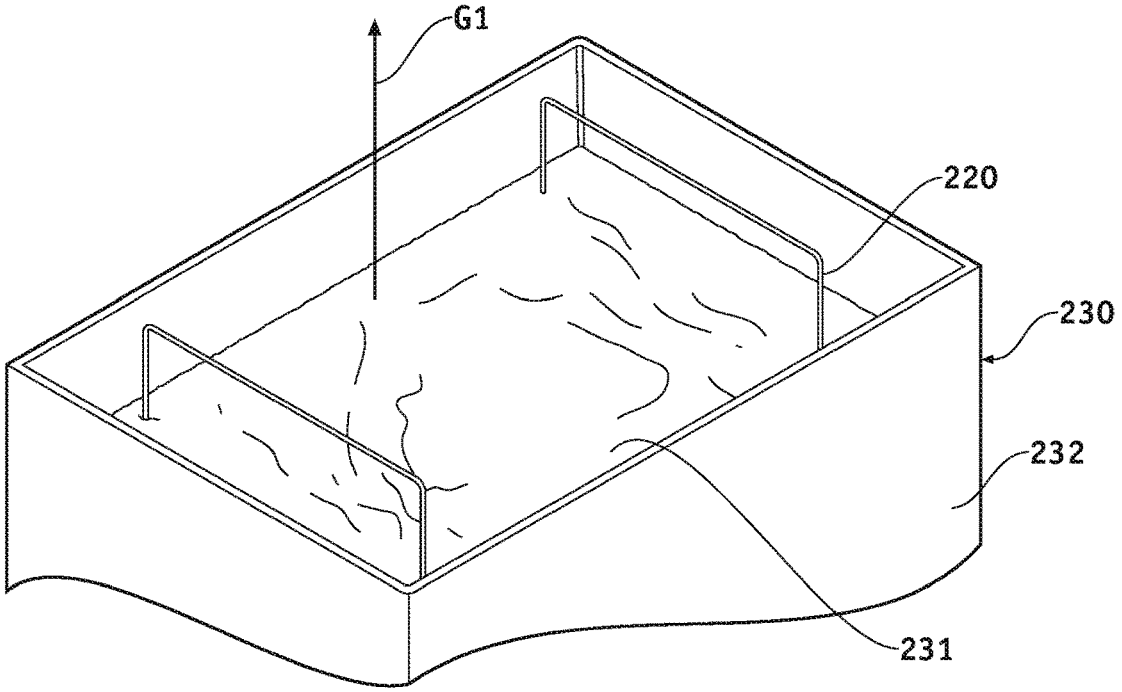
Figure 22:
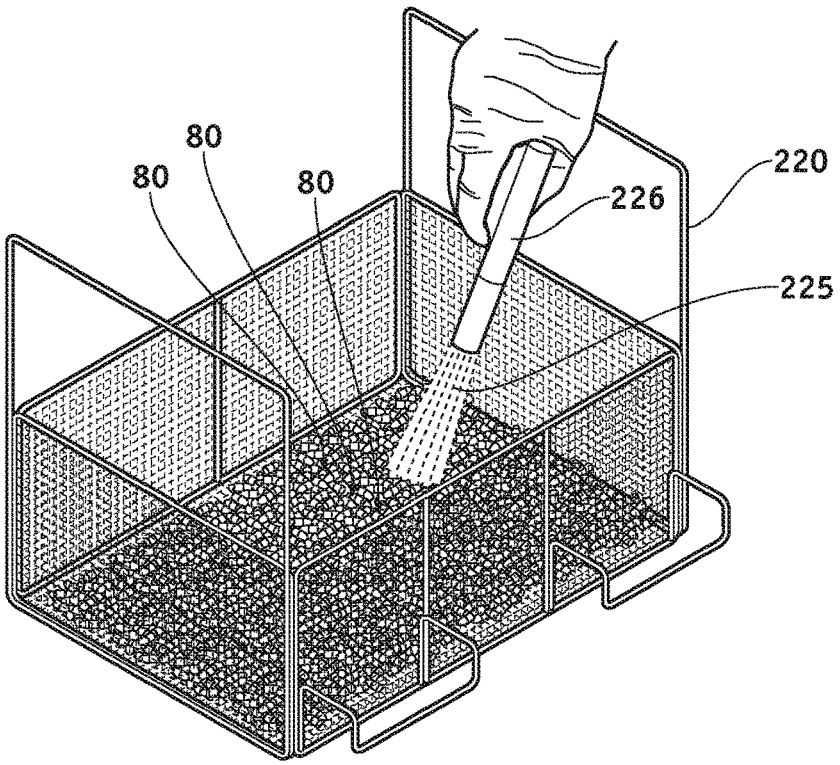

After abrasive blasting rear surfaces 95 in a particular embodiment, the method further includes cleaning projectiles 80, and thus their roughened rear surfaces 95, to remove any debris, oils, contaminants, or residue, such as by washing projectiles 80 with a solvent as shown in in FIGS. 18 and 19 on one embodiment, ultrasonic cleaning projectiles 80 as shown in FIGS. 20 and 21 with an ultrasonic cleaner in another embodiment, or both in yet another embodiment, and then drying projectiles 80 as shown in FIG. 22. To wash projectiles 80 with a solvent involves withdrawing stabilizer plate 180 from over baseplate 100 and projectiles 80 in the direction of arrow E in FIG. 16 thereby withdrawing stabilizer holes 190 from projectiles 80, removing projectiles 80 from baseplate 100, such as by simply inverting baseplate 100 to enable projectiles 80 to fall outwardly from the respective cavities 110 by gravity, placing projectiles 80 in basket 220 in FIG. 18 positioned over tub 221 of a solvent 222, such as distilled water or, if desired, alcohol or acetone or other low-residue solvent, lowering basket 220 of projectiles 80 in the direction of arrow F of FIG. 18 into solvent 222 held by tub 221 as shown in FIG. 19, waiting for an amount of time sufficient to enable solvent 222 to clean projectiles 80, such as from 5 to 15 minutes, withdrawing basket 220 of projectiles 80 from solvent 222 in tub 221 in the direction of arrow F1 in FIG. 19, and drying projectiles 80 held by basket 220 in FIG. 22, such as blowing a stream 225 of air, such as from a hand-held blower 226, over projectiles 80 for a duration of time sufficient to dry projectiles 80 from solvent 222. If desired, baseplate 100 and projectiles 80 installed therein can be altogether lowered into solvent 222 for cleaning, withdrawn after cleaning, and dried according to FIG. 22, all without withdrawing projectiles from baseplate 100.

To ultrasonically clean projectiles 80 involves withdrawing stabilizer plate 180 from over baseplate 100 and projectiles 80 in the direction of arrow E in FIG. 16 thereby withdrawing stabilizer holes 190 of stabilizer plate 180 from projectiles, removing projectiles 80 from baseplate 100, such as by simply inverting baseplate 100 to enable projectiles 80 to fall outwardly from the respective cavities 110 by gravity, placing projectiles 80 in basket 220 in FIG. 20 positioned over a standard ultrasonic cleaner 230, distilled water maintained by an ultrasound-generating basin, lowering basket 220 of projectiles 80 in the direction of arrow G of FIG. 20 into ultrasonic cleaner 230 in FIG. 21, waiting for an amount of time sufficient to enable ultrasonic cleaner 230 to clean projectiles 80, such as from 5-15 minutes, withdrawing basket 220 of projectiles 80 from ultrasonic cleaner 230 in the direction of arrow G1 in FIG. 21, and drying projectiles 80 held by basket 220 in FIG. 22, such as blowing stream 225 of air, such as from hand-held blower 226, over projectiles 80 for a duration of time sufficient to dry projectiles 80 from being ultrasonically cleaned. If desired, baseplate 100 and projectiles 80 installed therein can be altogether lowered into ultrasonic cleaner 230 for cleaning, withdrawn after cleaning, and dried according to FIG. 22, all without withdrawing projectiles from baseplate 100.

Figure 23:
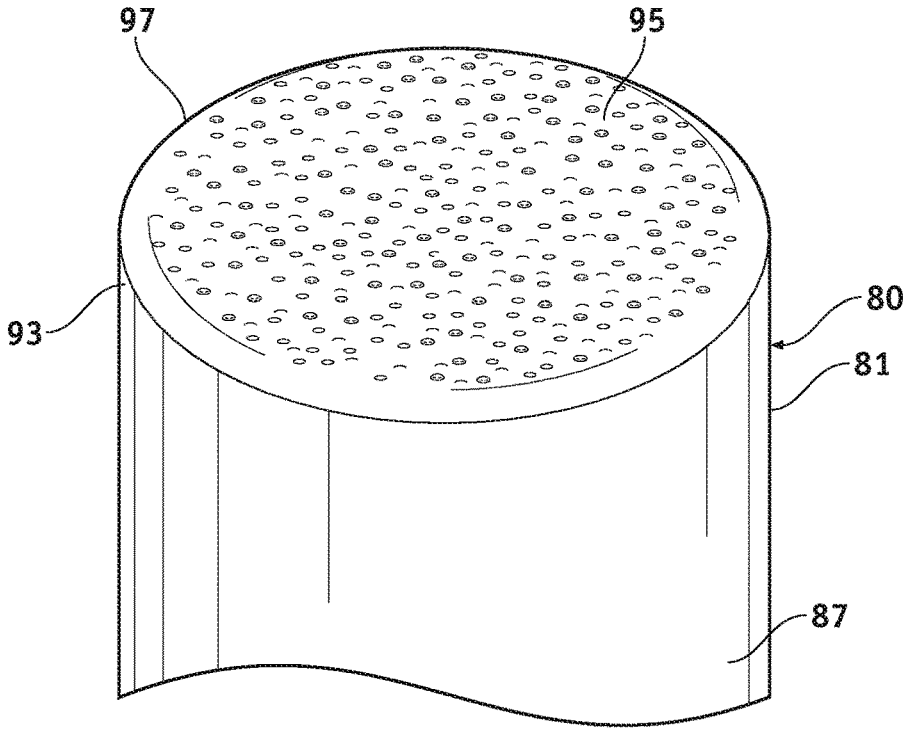
FIG. 23 is a greatly enlarged, fragmentary view of a projectile according to FIG. 1 illustrating the rear surface thereof as it would appear roughened according to FIG. 16.

Cleaning projectiles 80 and their roughened rear surfaces 95 to remove any debris, oils, contaminants, or residue, whether by washing projectiles 80 according FIGS. 18 and 19, ultrasonic cleaning projectiles 80 according to FIGS. 20 and 21, or both, frees rear surfaces 95 of any contaminants that could otherwise interfere with adhesion of the hardenable photoluminescent material to be subsequently deposited on the rear surfaces 95. Groups of projectiles from more than one baseplate 100 can be cleaned at the same time. FIG. 23 is a greatly enlarged fragmentary view of a projectile 80 illustrating rear surface 95 of trailing end 95 as it would appear roughened via abrasive-blasting described briefly above.

Figure 24:
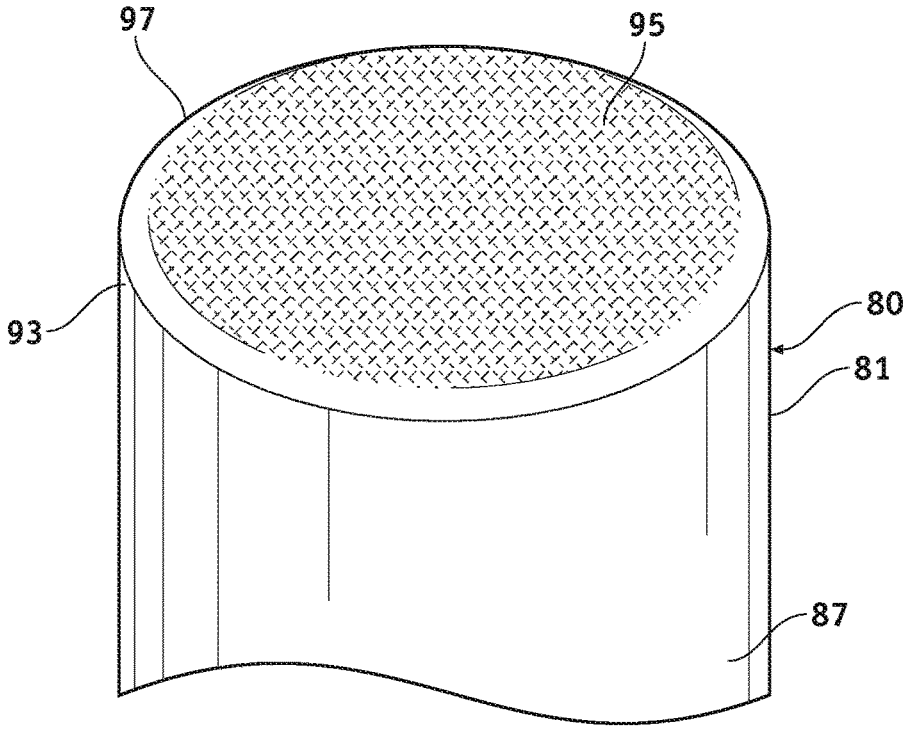
FIG. 24 is a greatly enlarged, fragmentary view of a projectile according to FIG. 1 illustrating the rear surface thereof as it would appear having a uniform texture cut therein according to FIG. 17.

Cutting the texture into rear surfaces 95 of projectiles can be done by mechanical milling or other chosen cutting process. In an exemplary embodiment shown in FIG. 17, laser-cutting is preferred because it is easy, efficient, and ensures rear surfaces 95 are textured uniformly to enable hardenable material applied thereon to spread/slump uniformly. In an exemplary embodiment, laser-cutting the uniform texture into rear surfaces 95 includes targeting rear surfaces 95 with laser light 210 from a standard and well-known laser cutter 211 for an amount of time and in a chosen pattern of passes sufficient to cut a uniform texture into rear surfaces 95. The texture can be any chosen texture, and, again, is preferably uniform to enable hardenable material applied thereon to spread uniformly. In a particular embodiment, targeting rear surfaces 95 with laser light 210 from standard laser 211 includes actuating laser 211 to generate laser light 210, and passing laser light 210 generated by laser 211, such as at an 85-micron spread at 20 kHz through a lens having a size from 160 mm to 254 mm, over rear surfaces 95 in a chosen pattern of passes for from one to fifteen minutes. At the same time, air nozzles 212 are provided and are actuated to concurrently blow air across rear surfaces 95 for cleaning rear surfaces 95 of generated debris by blowing away any debris from rear surfaces 95 of projectiles 80. After texturizing rear surfaces 95 by cutting a uniform texture into rear surfaces 95 by the described laser-cutting, the hardenable photoluminescent material may be deposited onto rear surfaces 95. However, in addition to or in lieu of cleaning rear surfaces 95 simply by blowing air across rear surfaces 95, rear surfaces 85 can be cleaned by washing projectiles 80 according FIGS. 18 and 19, ultrasonic cleaning projectiles 80 according to FIGS. 20 and 21, or both, if desired. FIG. 24 is a greatly enlarged fragmentary view of a projectile 80 illustrating rear surface 95 of trailing end 95 as it would appear having a uniform texture cut therein via laser-cutting described briefly above. In FIG. 24, the texture cut into rear surface 95 is a uniform cross-hatch texture. Any chosen uniform texture can be cut into rear surface 95, such as a spiral texture, a wavy texture, a texture of coaxial circles, etc.

Figure 32:
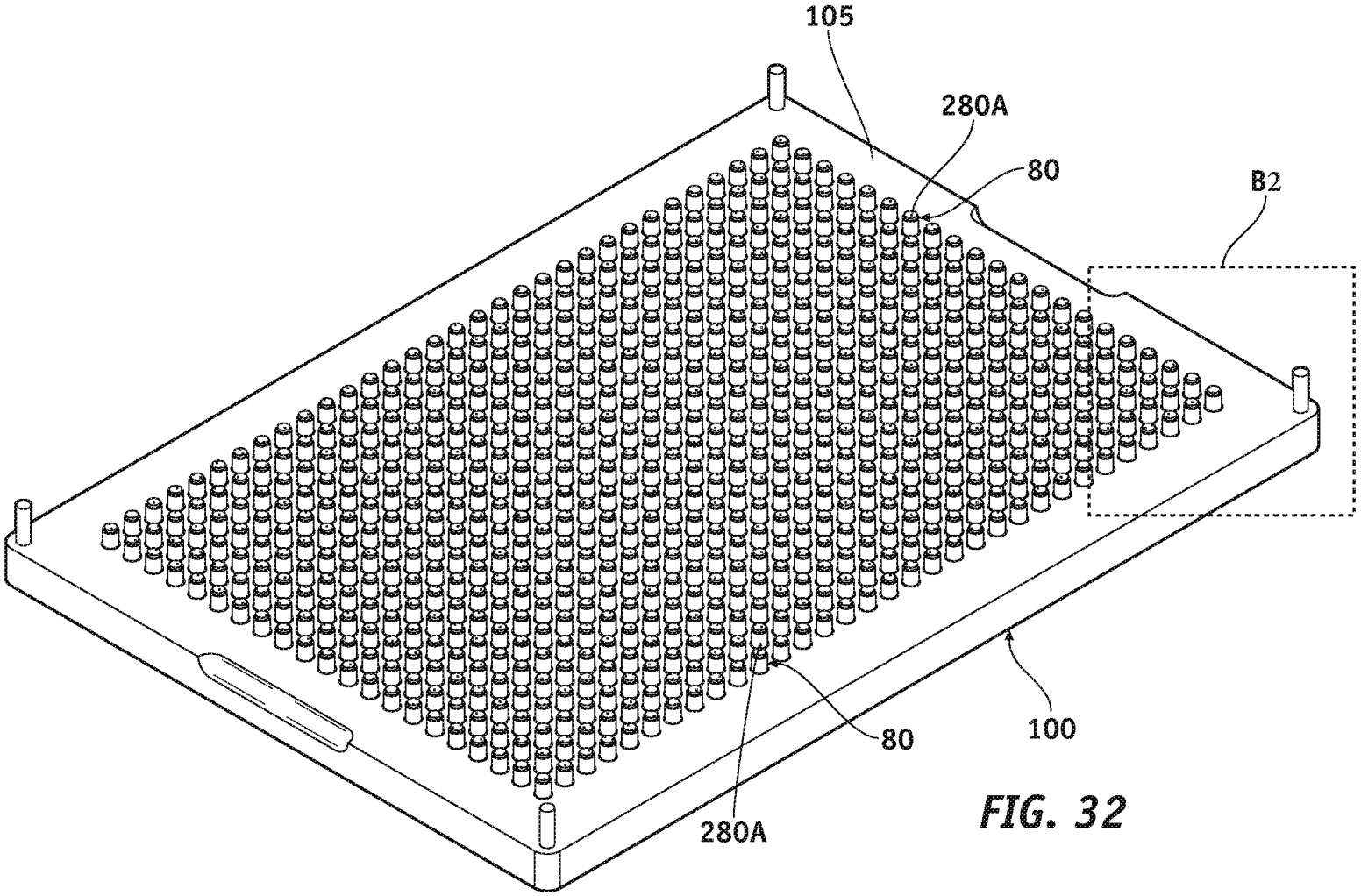
FIG. 32 illustrates the embodiment of FIG. 31 without the masking plate.

After texturizing each rear surface 95 uniformly, whether by roughening each rear surface 95 or cutting the texture into each rear surface 95, and cleaning each rear surface 95 of projectiles 80 as described above, the method further includes securing the textured and cleaned projectiles 80 in the nose down 83, trailing end 93 up orientation leaving rear surfaces 95 identically exposed in preparation for further processing, preferably by returning/reloading projectiles 80 in cavities 110 of baseplate 100 each in the nose 83 down, trailing end 93 up orientation as previously described and as shown in FIG. 25 (if they were removed from baseplate 100 for cleaning), A quantity of the hardenable photoluminescent material is deposited centrally on rear surface 95 of each projectile 80 as shown in FIG. 32. The quantities are precise and are identical and correspond to diameter (FIG. 1) of each projectile 80. The projectiles are retained, secured in the nose down, trailing end up orientation with rear surfaces 95 level for a period of time, during which the photoluminescent material hardens to form a solid photoluminescent body adhered to the rear surface, that is concentric with and extends outwardly no further than, perimeter edge 97, and is radially symmetrical relative to axis X.

Before hardening the hardenable photoluminescent material is inherently viscous. To enable the hardenable photoluminescent material to exhibit consist flow and hardening characteristics, especially from batch to batch, the method preferably includes providing hardenable photoluminescent material with an operating or initial viscosity within a predetermined range during depositing that is consistent from projectile to projectile and from batch to batch, thereby causing each quantity to automatically slump under the influence of gravity uniformly, predictably, and radially outward on rear surface 95 from axis X to no further than perimeter edge 97 during the time period required for it to harden into a solid photoluminescent body.

The hardenable photoluminescent material is preferably a standard material including a standard mixture of a photoluminescent material and a binder, which hardens into a solid photoluminescent body over time and inherently has a temperature-dependent viscosity before it hardens. Accordingly, providing the hardenable photoluminescent material with the desired operating viscosity during depositing involves maintaining the hardenable photoluminescent material at a relatively consistent operating temperature within a specific range of temperatures from at least the point in the process where photoluminescent material is deposited, until it has hardened into a solid photoluminescent body. In this example, the range of operating temperatures is from 67 to 73° F. The depositing step is, therefore, temperature-controlled, according to one aspect of the invention. Maintaining the operating temperature of the hardenable photoluminescent material is readily accomplished by performing the depositing step in a room or other enclosed space maintained at the operating temperature, namely, from 67 to 73° F., and using thermally conductive materials, e.g. anodized aluminum, for baseplate 100 and cooperating fixtures, e.g. a masking plate 240, as will be described, facilitates maintaining mixture 500 at a constant temperature within the desired range.

Projectiles 80 are maintained in the described vertically upright nose 83 down, trailing end 93 up orientation by baseplate 100, with rear surfaces 95 level and the operating temperature are concurrently maintained not only during depositing but also during the time period required for the photoluminescent material to sufficiently harden. This prevents the deposited quantities of the hardenable photoluminescent material from slumping irregularly and hardening irregularly or otherwise deforming and thereby not forming a solid photoluminescent body on rear surface 95 that is concentric with, and extends outwardly no further than, perimeter edge 97, and that is radially symmetrical relative to axis X. The operating temperature maintained during the waiting step is, like the operating temperature during the depositing step, from 67 to 73° F. in this example.

Figure 26:
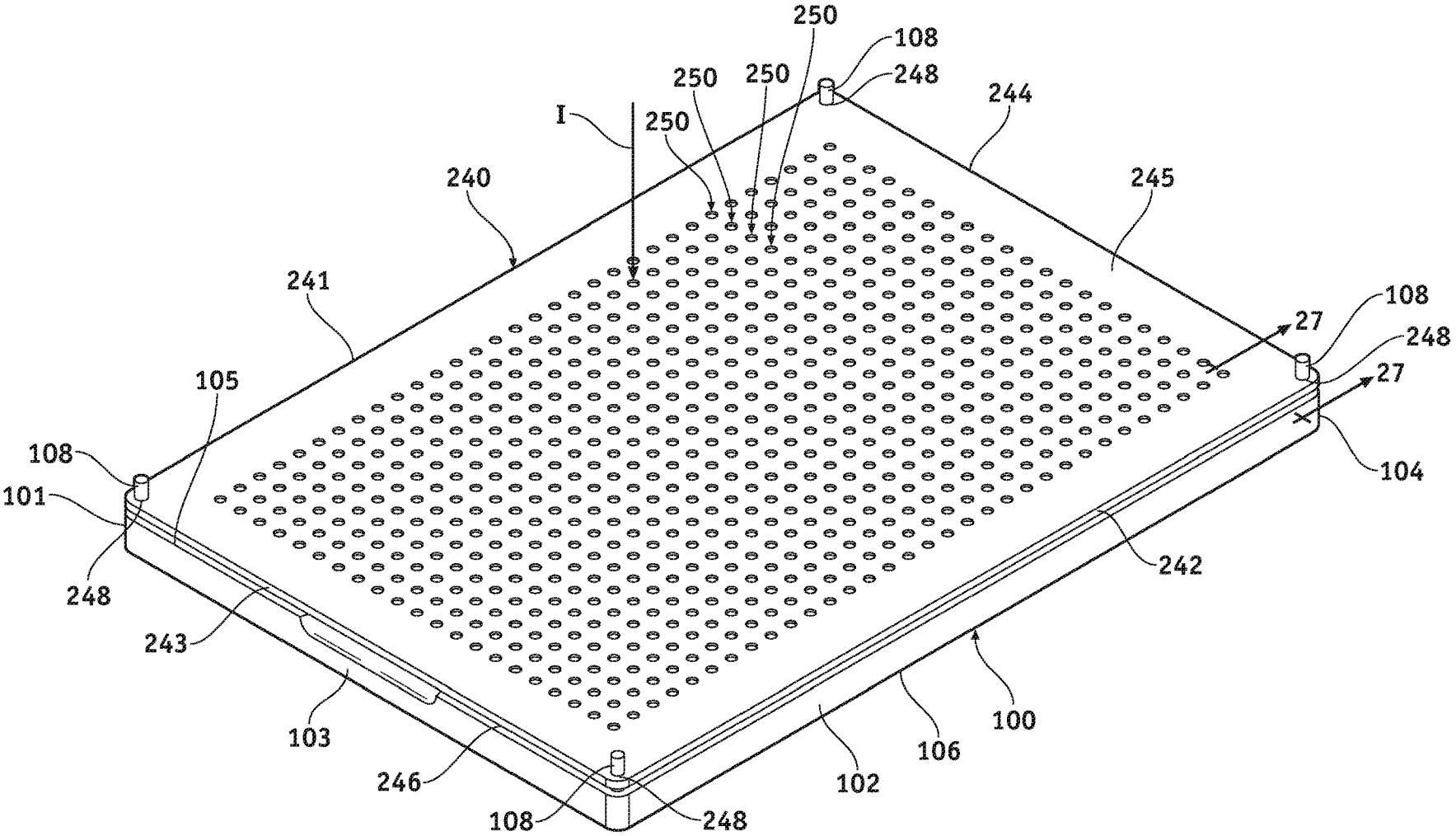
FIG. 26 is a perspective view of a masking plate positioned over the baseplate and the projectiles of the embodiment of FIG. 25.
Figure 27:
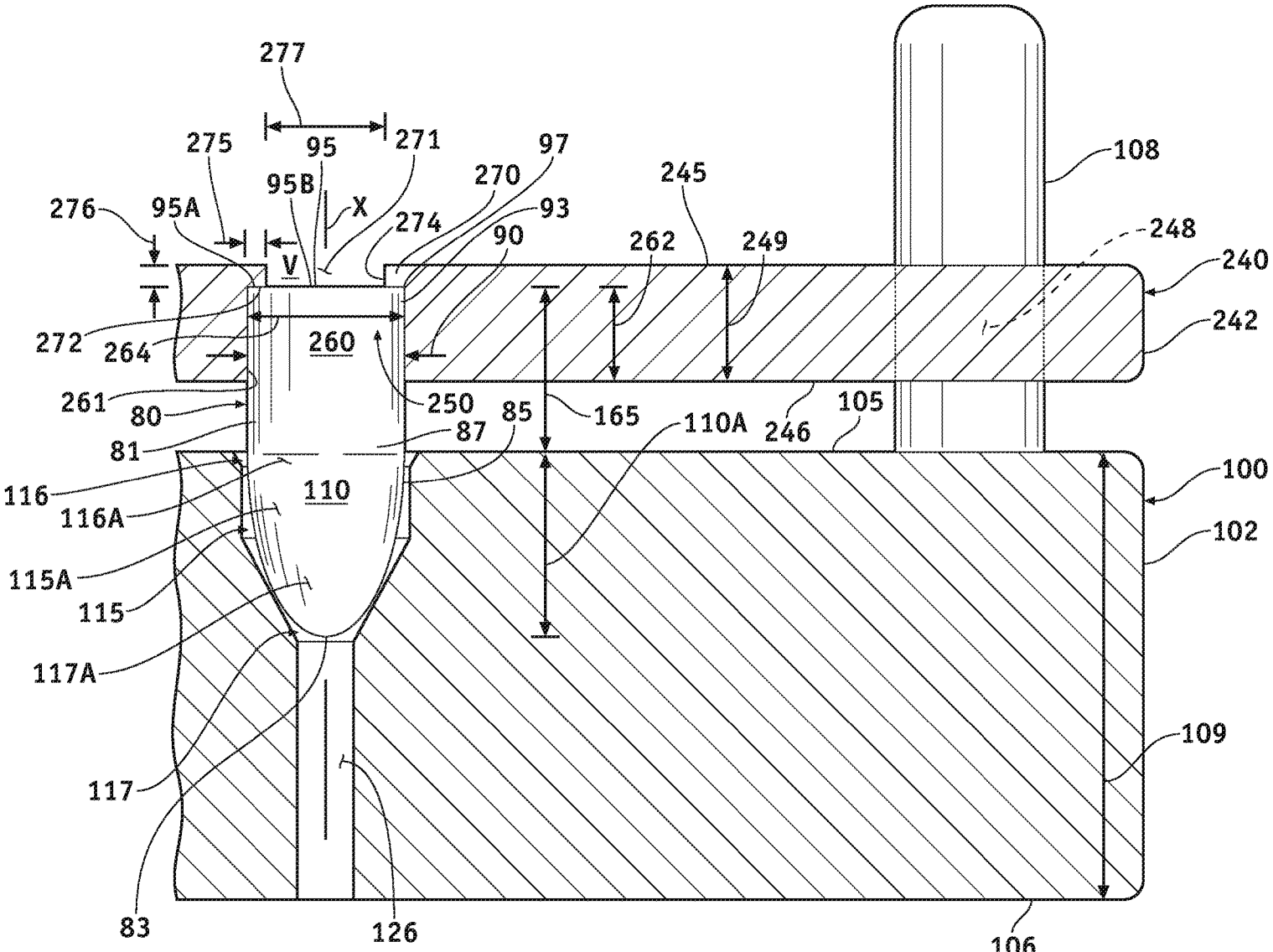
FIG. 27 is a section view taken along line 27-27 of FIG. 26 illustrating a projectile according to FIG. 1 loaded into the masking plate and the baseplate, the projectile (shown un-sectioned for illustrative purposes) being loaded nose down into a cavity of the baseplate and a receiving void formed through the masking plate, wherein the receiving void includes a socket, and end wall, and an opening, and the projectile is held in the nose down, trailing end up orientation, and extends upright from the cavity of the baseplate to into the socket to the trailing end received directly against an end wall locating the opening over a central area of the rear surface of the projectile thereby defining a volume over the central area of the rear surface.

Referring to FIGS. 26 and 27, depositing the quantity of the hardenable photoluminescent material centrally on rear surface 95 of each projectile 80 includes, in an exemplary embodiment, masking a circumferential area of each rear surface 95 extending radially outwardly toward perimeter edge 97 thereby inherently defining a central volume, generally indicated as V in FIG. 27, overlying a central area of rear surface 95 that is concentric with the circumferential area and perimeter edge 97 and symmetrical about axis X, and filling each volume with the quantity of the hardenable photoluminescent material, the quantity of the hardenable material contacting the central area of each rear surface 95, which are followed by unmasking each circumferential area. The volumes are identical in shape and in size to receive and define identical quantities of hardenable photoluminescent material. The described masking of projectiles 80 disables the quantities of the hardenable photoluminescent material filling each volume from flowing outwardly from each volume beyond the central area of rear surface 95 while the mask is in place.

According to an exemplary embodiment, which is inexpensive, efficient, and which does not require specialized skill or expensive equipment, masking includes providing masking plate 240 and stacking masking plate 240 over baseplate 100 and projectiles 80 as shown in FIGS. 26 and 27 to thereby automatically mask the circumferential area of each projectile 80. Masking plate 240 is configured to be repeatedly applied over or otherwise stacked onto baseplate 100 and over projectiles 80 for identically masking a circumferential area of each projectile 80, and unstacked or otherwise withdrawn from over baseplate 100 and projectiles 80, and without having to make modifications to either masking plate 240 or baseplate 100. Masking plate 240 can be manipulated by hand, or by mechanized handling equipment.

Masking plate 240 is portable, being able to be easily carried or moved about by hand, is fashioned of a material or combination of materials having inherently rigid, resilient, rugged, wear-resistant, chemical-resistant, and thermally-conductive material characteristics, such as anodized aluminum, steel, or other metal or metal composite. Masking plate 240 is broad, flat, and generally rectangular in overall shape in this example, substantially coextensive with respect to the previously-described stabilizer plate 180, and includes opposed, parallel, identical elongate sides 241 and 242 extending between opposed, parallel, and comparatively shorter identical elongate ends 243 and 244, and opposed, coextensive and parallel upper and lower surfaces 245 and 246. Sides 241 and 242 converge with ends 243 and 244 at four respective corners of masking plate 240. Identical guide holes 248 extend through thickness 249 (FIG. 27) of masking plate 240 from upper surface 245 to lower surface 246 proximate to the respective corners. Guide openings 248 of masking plate 240 are configured to receive therethrough guide pins 108 of baseplate 100 when masking plate 240 is applied over baseplate 100 in FIG. 13 for properly aligning masking plate 240 with baseplate 100. Thickness 249 of masking plate 240 in FIG. 25 from upper surface 245 to lower surface 246 is less than thickness 189 of the previously-described stabilizer plate 180, and is less than the previously-described distance 165, which is the length of a caliber section 87 of a projectile 80 loaded in baseplate 100 in the nose 83 down, trailing end 93 up orientation and extending downwardly from trailing end 93, including rear surface 95 and perimeter edge 97 thereof, to upper surface 105 of baseplate 100, according to the invention.

Masking plate 240 is configured with receiving voids 250. Receiving voids 250 are each configured to identically receive a trailing end 93 of a projectile 80 loaded nose 83 down, trailing end 93 up in baseplate 100. Receiving voids 250 are formed through thickness 249 of masking plate 240, are identical, and are equally spaced-apart. In this example, receiving voids 250 are numbered arranged/patterned identically to cavities 110 of baseplate 110, namely, in rows that are parallel relative ends 243 and 244 and perpendicular relative to sides 241 and 242. Each row from side 241 to side 242 includes twenty-one receiving voids 250, and there are thirty-two parallel rows of receiving voids 250 from end 243 to end 244. Accordingly, in this embodiment baseplate 100 incorporates a pattern of six-hundred and seventy-two cavities 110 each for identically receiving and holding a projectile in the nose down, trailing end up orientation, and masking plate 240 incorporates an identical pattern and number, six-hundred and seventy-two in this example, of receiving voids 250 each for identically receiving therein a trailing end 93 of a projectile 80 loaded nose 83 down, trailing end 93 up in baseplate 100. A masking plate 240 constructed and arranged in accordance with the principle of the invention can have less or more receiving voids to match the number of cavities of a baseplate constructed and arranged in accordance with the invention. Receiving voids 250 are identical. Accordingly, the details of one receiving void 250 are discussed in detail in conjunction with FIG. 27, with the understanding that the ensuing discussion of receiving void 250 in FIG. 27 applies in every respect to each receiving void 250 of masking plate 240 of FIG. 26.

Referring to FIG. 27, receiving void 250 is a hollow space milled, molded, or otherwise formed in thickness 249 of the material of masking plate 240 from upper surface 245 to lower surface 246. Receiving void 250 includes a socket 260 and annular end wall, lip, or flange 270 that defines opening 271. Flange 270 extends radially inwardly to opening 271, suitably having an upper surface formed as a part of masking plate 240 upper surface 245, an inwardly-directed annular/circular edge or surface 274 and a downwardly-facing lower surface 272. Socket 260 extends upwardly into masking plate 240 from lower surface 246 to flange 270 and opening 271, Flange 270, and thus opening 271, are coaxial with socket 260 and extend from socket 260 to upper surface 245 of masking plate 240.

Socket 260 is defined by a cylindrical inner surface 261 extending upright from lower surface 246 of masking plate 240 to lower surface 272 of flange 270. Socket 260 has a depth 262 from lower surface 272 of flange 270 to lower surface 246 of masking plate 240, and a diameter 264 defined by cylindrical inner surface 261. Depth 262 corresponds to a length of caliber section 87 extending downwardly from trailing end 93 of a projectile 80, and diameter 264 corresponds to caliber diameter 90 of caliber section of a projectile 80, with a chosen clearance e.g., of approximately five thousandths inch larger than the nominal caliber diameter 90 to enable the reception of a projectile 80. In this embodiment, diameter 264 of socket 260 is identical to diameter 121 of cylindrical hole 115A of each cavity 110 of baseplate 110, and depth 262 of socket 260 is less than distance 165, which is the distance that of a caliber section 87 of a projectile 80 loaded in baseplate 100 extends above baseplate upper surface 105 as described above.

Lower surface 272 of flange 270 extends radially inwardly a width 275 to edge 274. Edge 274 extends upright from lower surface 272 of flange 70 a depth 276 to upper surface 245 of masking plate 240 and defines opening 271 from socket 260 to upper surface 245 and, more specifically, from lower surface 272 of flange 270 to upper surface 245 of masking plate 240. Depth 276 of edge 274 defines the depth of opening 271, and diameter 277 of opening 271 that is open to socket 260. Diameter 277 of opening 271 is less than diameter 264 of socket 260 and diameter 98 of projectile rear surface 95.

When masking plate 240 is disposed/stacked over baseplate 100, each projectile 80 is received in a corresponding socket 260, such that lower surface 272 of flange 270 is brought into direct contact with the projectile rear surface 95. Flange 270 thus masks the underlying circumferential area of rear surface 95 extending radially inward from perimeter edge 97 by width 275. Opening 271 is thus centered over rear surface 95, defining a concentric area of rear surface 95 that is and symmetrical about axis X. Opening 271 cooperates with the central area of rear surface 95 to define a confining volume V overlying the central area. Like opening 271, defined volume V, is concentric with perimeter edge 97 and the masked circumferential area of rear surface 95, and is symmetrical about axis X, when caliber section 87 is installed trailing end 93 first into socket 260. How each projectile 80 identically interacts with a corresponding receiving void 250 is discussed in detail below in conjunction with FIG. 27.

Having provided masking plate 240, the step of masking further includes applying/stacking masking plate 240 over baseplate 100 with the trailing ends 93 of projectiles 80 secured by baseplate 100 received in sockets 260 of the respective receiving voids 250 such that flange lower surfaces 272 are in direct contact with the projectile rear surfaces 95. To do this, masking plate 240 is oriented parallel to and lower surface 246 down over upper surface 105 of baseplate 100 axially-aligning side 241 of loading plate 240 with side 101 of baseplate 100, side 242 of loading plate 240 with side 102 of baseplate 100, end 243 of loading plate 240 with end 103 of baseplate 100, end 244 of loading plate 240 with end 104 of baseplate 100, and guide openings 248 of loading plate 240 with guide pins 108 of baseplate 100. While maintaining this aligned position of masking plate 240 relative to baseplate 100, masking plate 240 is lowered/applied downwardly in the direction of arrow I in FIG. 26 over and onto baseplate 100 and projectiles 80 lowering guide holes 248 over the respective guide pins 108, which slide therethrough while masking plate 240 is lowered toward baseplate 100 in the direction of arrow I. Sockets 260 of receiving voids 250 are thus concurrently lowered over the respective projectiles 80, which slide therethrough trailing ends 93 first while masking plate 240 is lowered toward baseplate 100 in the direction of arrow I, until lower surfaces 272 of the respective flanges 270 come to rest directly atop and onto circumferential areas of rear surfaces 95 of projectiles. Projectiles 80 take up the inherent weight of baseplate 110 and support baseplate 100 at an elevated location over upper surface 105 of baseplate 100. With masking plate 240 positioned over baseplate 100 and stacked on and supported by trailing ends 93 of projectiles 80 secured by baseplate 100. As will be discussed, each opening 271 is disposed over the rear surface 95 of a corresponding projectile 80 and defines a respective confining volume V axially aligned with and overlying the central portion of the corresponding rear surface 95.

Reception of guide pins 108 in guide holes 248 provides precision alignment, automatically aligning sockets 260 of receiving voids 250 with the respective cavities 110 and projectiles 80 therein coaxially. This causes sockets 260 to accept the respective projectiles 80 therethrough, trailing ends 93 first, until lower surfaces 272 of the respective flanges 270 come in direct masking contact against circumferential areas of rear surfaces 95 of the respective projectiles 80. Projectile rear surfaces 95 directly support masking plate 240 at an elevated location above baseplate 100. The inherent weight of masking plate 240 supported by atop the circumferential areas of rear surfaces 95 of projectiles 80 seals and masks the circumferential areas of rear surfaces 95 of projectiles 80 by lower surfaces 272 of the respective flanges 270.

Guide pins 108 of baseplate 100 are one of guide elements and complemental guide elements, and guide holes 248 of masking plate 240 are the other one of the guide elements and the complemental guide elements, wherein the guide elements interact with the complemental guide elements coaxially aligning receiving voids 250 with the respective cavities 110 and trailing ends 93 coaxially in response to applying masking plate 240 over baseplate 100 and projectiles 80. Each guide pin 108 and corresponding guide hole 248 are complementing alignment pairs. Although for each alignment pair the guide pin 108 is carried by baseplate 100 and the guide hole 248 is carried by masking plate 240, this can be reversed.

The assembly of a projectile 80 and a corresponding receiving void 250 will now be discussed in conjunction with FIG. 27, with the understanding that the ensuing discussion applies in every respect to each projectile 80 and each corresponding receiving void 250. FIG. 27 is a section view taken alone line 27-27 of FIG. 26 illustrating masking plate 240 stacked over baseplate 100, and socket 260 of a receiving void 250 stacked coaxially over an underlying cavity 110 in baseplate 100 and applied over trailing end 93 of a projectile 80 loaded in the underlying cavity 110 of baseplate 100 in the nose 83 down, trailing end 93 up orientation. In FIG. 27, projectile 80 is seated in cavity 110 of baseplate 100, secured in a nose down tail end up orientation, extending upright beyond upper surface 105 of baseplate 100 to put rear surface 95 of trailing end 93 a distance 165 above upper surface 105 of baseplate 100 as previously described in conjunction with FIGS. 9-12. Caliber section 87 extends upright from upper surface 105 to into and through depth 262 of socket 260 from lower surface 246 of masking plate 246 elevated over baseplate 100 to rear surface 95 of trailing end 93, in which a circumferential area 95A of rear surface 95 of trailing end 93, having a width equal to width 275 of lower surface 272 of flange 270 in this example, is in direct sealing and masking contact against lower surface 272 of flange 270.

Circumferential area 95A extends radially outwardly to perimeter edge 97 from annular surface/edge 274 of flange 270 to cylindrical inner surface 261 of socket 260, is concentric with perimeter edge 97, and is symmetrical about axis X. Depth 262 and diameter 264 of socket 260 are such that a length of caliber section 87 from rear surface 95 of trailing end 93 to an intermediate location of caliber section 87 between rear surface of trailing end 93 and upper surface 105 of baseplate 100 extends therethrough, sufficient to secure and hold caliber section 87 and center opening 271 over a central area 95B of rear surface 95 that is concentric with circumferential area 95A of rear surface 95 and perimeter edge 97, symmetrical about axis X, and extends radially outwardly from axis X to annular surface 274 of flange 270. Opening 271, measured by its depth 276 and diameter 277, cooperates with the underlying central area 95B of rear surface 95 to define confining volume V that is precisely sized for receiving a corresponding and precise quantity of hardenable photoluminescent material therein and on central area 95B of rear surface 95. Volume V is, like opening 271, concentric with circumferential area 95A of rear surface 95 and perimeter edge 97 and is symmetrical about axis X, in which circumferential area 95A, perimeter edge 97, and volume V share axis X.

Figure 30:
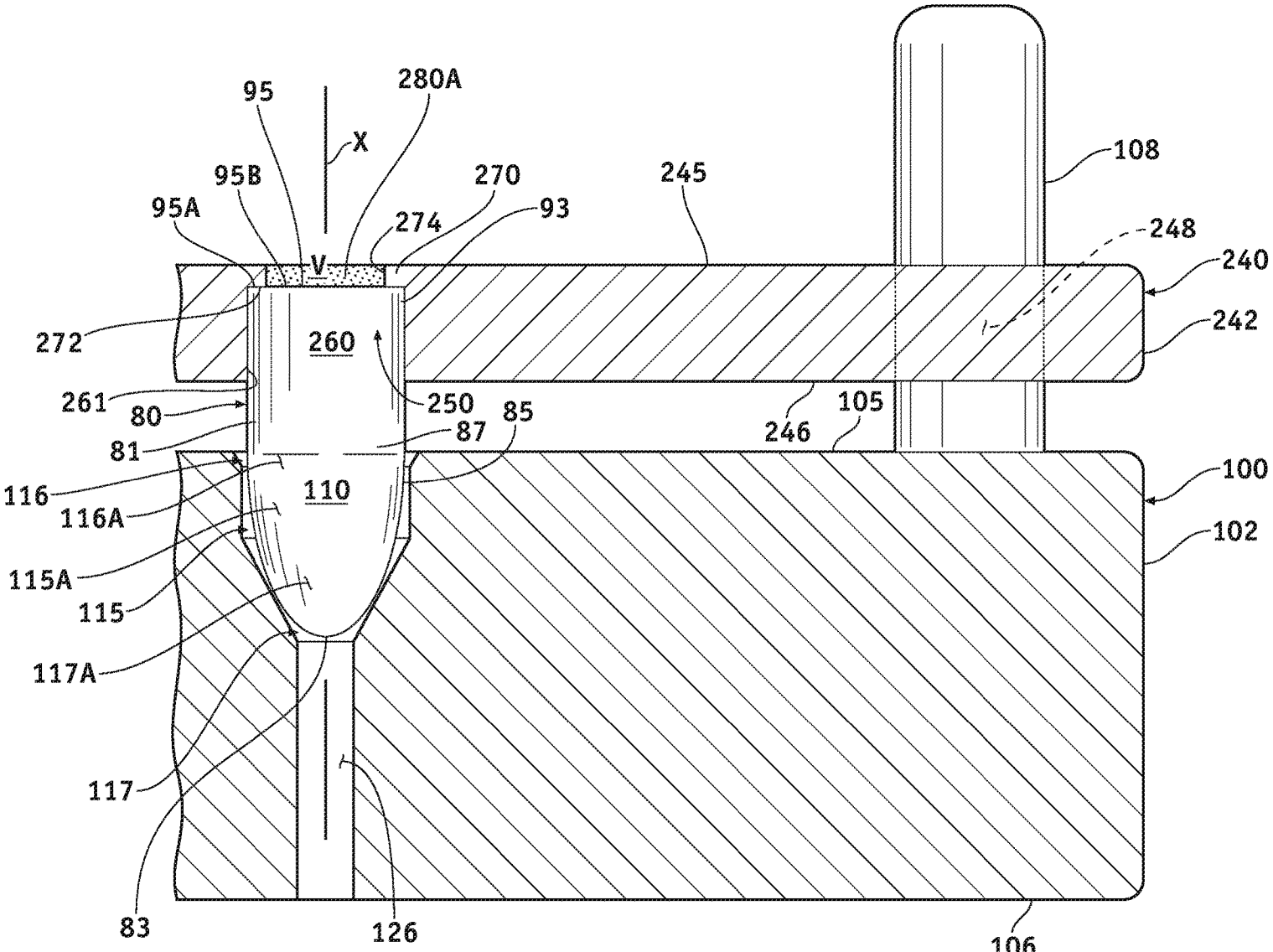
FIG. 30 is a view corresponding to FIG. 29 illustrating the volume filled with a quantity of the hardenable photoluminescent material deposited on the central area of the rear surface of the projectile (shown un-sectioned for illustrative purposes)

Volume V is a predetermined volume chosen in accordance with the diameter D of projectile rear surface 95 (FIG. 1). As best seen in FIG. 30, volume V is configured to receive therein and on central area 95B of rear surface a quantity 280A of a hardenable photoluminescent material 280.

Hardenable photoluminescent material 280 is a mixture of a photoluminescent material and a binder. Hardenable photoluminescent material 280 includes chosen percentages by weight of a binder, and a photoluminescent material to provide a desired operating viscosity at the chosen operating temperature. The binder is a chosen epoxy, and the photoluminescent material is a chosen phosphor. In an exemplary embodiment, the percentage can be 60% by weight of a binder and 40% by weight of a chosen photoluminescent material, and these percentages can vary. Preferably, any binder that is clear, heat resistant, capable of encapsulating the photoluminescent material against oxidation, and capable of adhering to projectile 80 rear surface 95 is utilized. The photoluminescent material is a standard quick charge, light activated material, having inherent material characteristics compatible with the chosen binder, and the particular propellant to be used with a projectile 80. Different phosphors inherently require different spectrums of light to charge the photoluminescence. Accordingly, the phosphor employed in hardenable photoluminescent material 280 is preferably matched with a propellent that creates the appropriate light spectrum during the burn process of the propellant. This is well-known in the art. In a particular embodiment, a pyrotechnic colorant that generates the necessary light spectrum can be included in the propellant. The specific quantity of hardenable photoluminescent material 280 is preferably established, made consistent with respect to all of projectiles 80 seated in baseplate 100, and repeatable from batch to batch, by precisely filling volumes V, which are identical and defined by and between each opening 271 and central area 95B of the corresponding rear surface 95.

Figure 28:
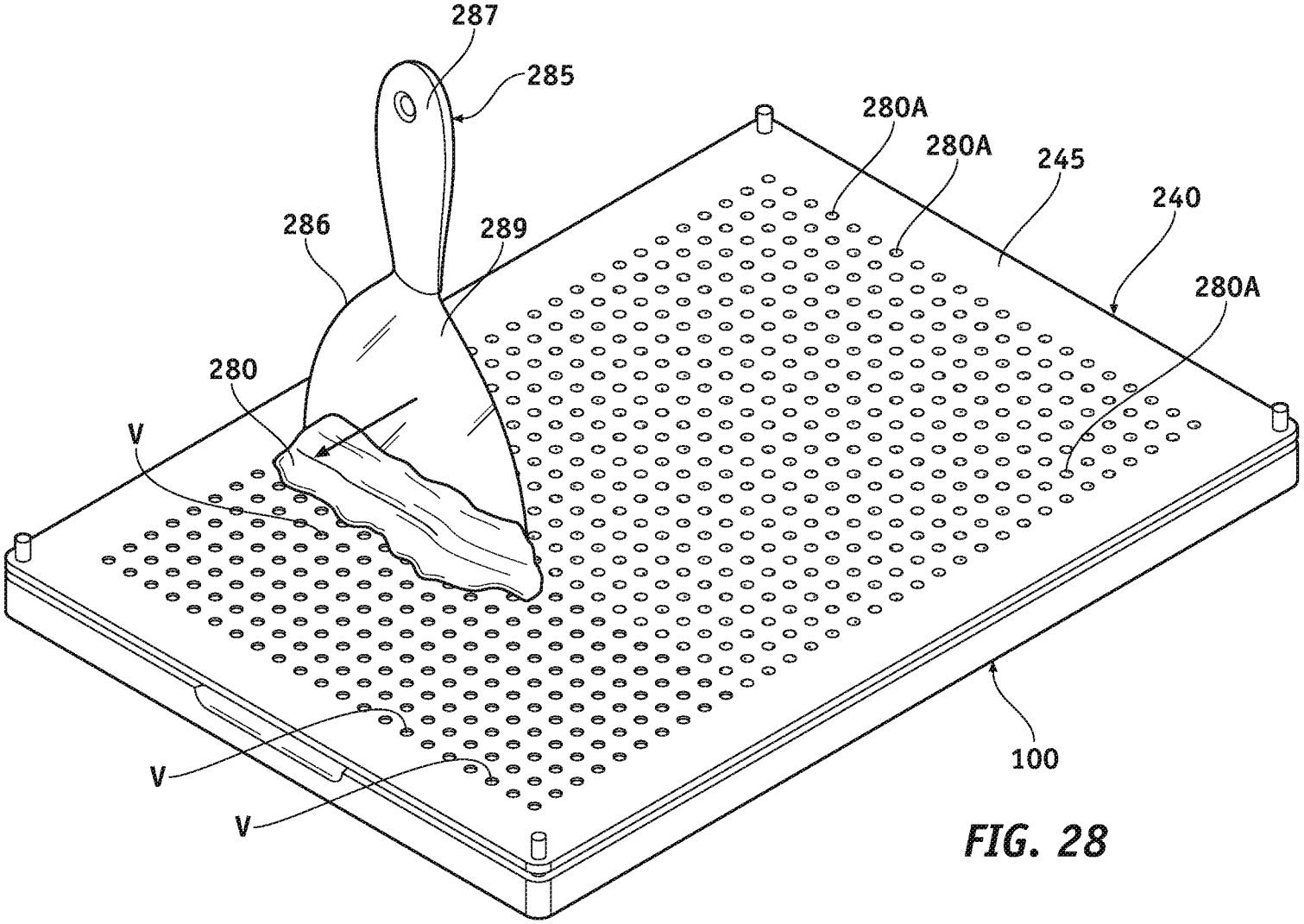
FIG. 28 is a perspective view corresponding to FIG. 26 illustrating a method of depositing a quantity of a hardenable photoluminescent material into each volume by spreading the hardenable photoluminescent material over the masking plate with a spreader.
Figure 29:
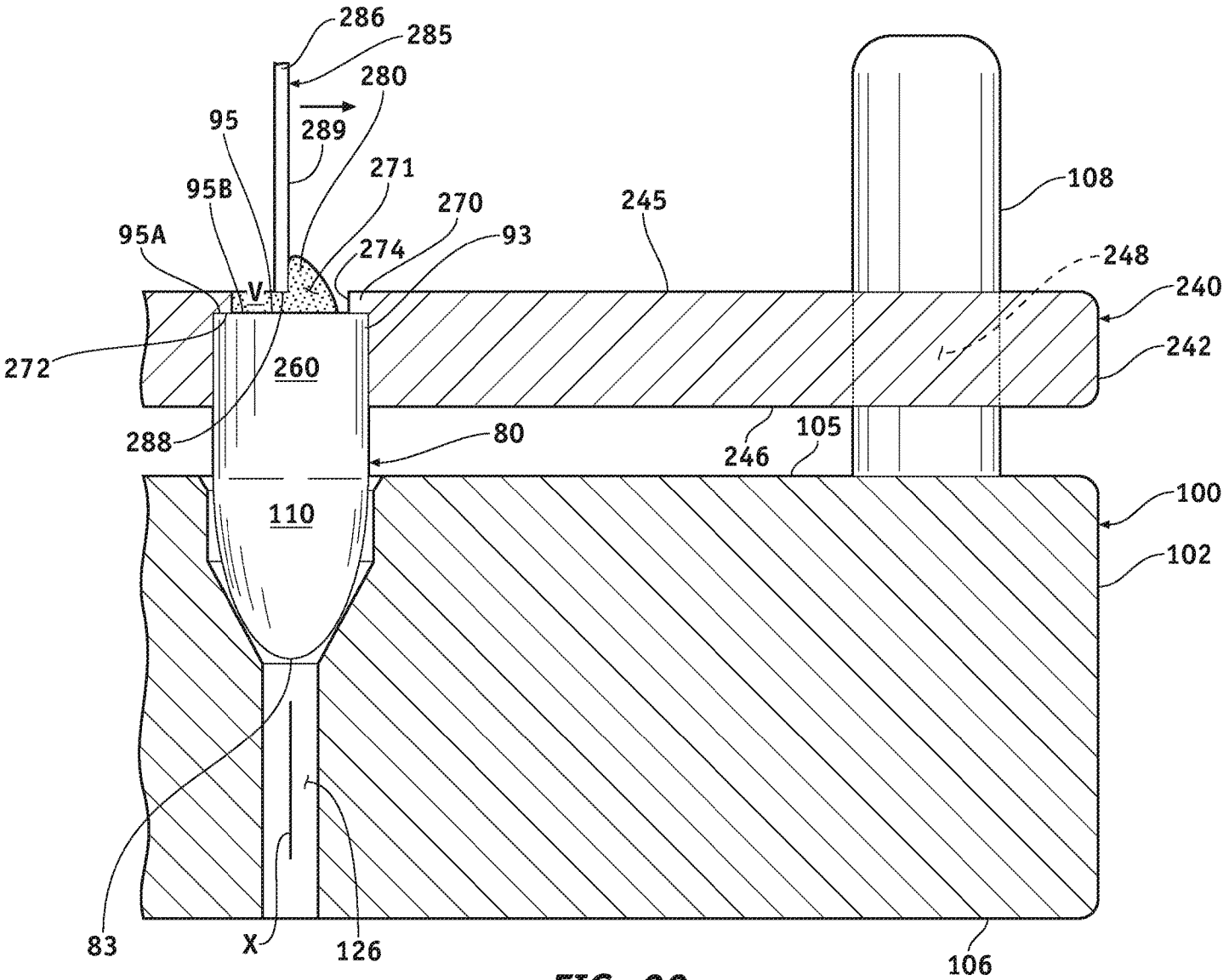
FIG. 29 is a view like FIG. 27 illustrating the spreading of the hardenable photoluminescent material over the masking plate according to FIG. 28 for depositing a quantity of the hardenable photoluminescent material into the volume and on the central area of the rear surface of the projectile (shown un-sectioned for illustrative purposes)

With projectiles 80 vertically upright, their rear surfaces 95 having been textured and cleaned, in the nose 83 down, trailing end 93 up orientation in baseplate 100 and masking plate 240 in place, each volume V is filled with quantity 280A of hardenable photoluminescent material 280. Referring to FIGS. 28, 29 and 30, in this specific example, this involves spreading hardenable photoluminescent material 280 over upper surface 245 of masking plate 240 and each volume V to fill each volume V with an identical quantity 280A of hardenable photoluminescent material 280 as shown in FIG. 30. The quantity 280A of hardenable material filling each volume V is in contact with central area 95B of rear surface 95. This is preferably done without pressing hardenable photoluminescent material 280 into each volume V. The masking of each projectile 80 by masking plate 240 disables each quantity 280A filling each volume V from flowing radially outwardly from each volume V beyond central area 95B to masked circumferential area 95A, importantly keeping circumferential area 95A free of hardenable photoluminescent material 280, while masking plate 240 is masking rear surface 95 of each projectile 80. Since each volume V is concentric with circumferential area 95A of rear surface 95 and perimeter edge 97 and is symmetrical about axis X, each quantity 280A filling and taking the shape of each volume V is identically concentric with circumferential area 95A of rear surface 95 and perimeter edge 97 and symmetrical about axis X.

In an exemplary embodiment, illustrated in FIG. 28, the step of spreading hardenable photoluminescent material 280 includes depositing a mass of hardenable photoluminescent material 280 on upper surface 245 of masking plate 240 sufficient to fill volumes V, and spreading the mass of hardenable photoluminescent material over upper surface 245 and volumes V with a spreader 285. Spreader 285, a hand-held spreader in this example, includes blade 286 having handled end 287, straight edge 288, and flat working surface 289 extending downwardly from handled end 287 to straight edge 288. In use, spreader 285 is positioned straight edge 288 down in direct contact against upper surface 245 of masking plate 245 and held upright confronting the mass of hardenable photoluminescent material 280 applied on upper surface 245 of masking plate 240 with working surface 289, which is preferably maintained perpendicular, i.e. at a 90-degree angle, relative to upper surface 245. While maintaining this described orientation of spreader 285, spreader 285 is advanced, by hand in this example, against the mass of hardenable photoluminescent material 280 with a force sufficient for scraping straight edge 288 over upper surface 245 of masking plate 240 and volumes V and at the same time for pushing the mass of hardenable photoluminescent material 280 by working surface 289 across upper surface 245 of masking plate 240 and volumes V. As the mass of the hardenable photoluminescent material 280 is pushed over upper surface 245 and volumes V and straight edge 288 is scraped over upper surface 245 over volumes V by the advancing spreader 285. As illustrated in FIG. 29 the hardenable photoluminescent material 280 sequentially and automatically drops into each volume V onto central area 95B of rear surface 95 thereof and straight edge 288 automatically scrapes excess hardenable photoluminescent material from upper surface 245 and over each volume V. Each volume V is thereby automatically filled with a quantity 280A of the hardenable photoluminescent material 280 that is rendered coplanar or otherwise flush with upper surface 245 of masking plate 240 as shown in FIG. 30. Advancing working surface 288 perpendicular to upper surface 245 against the mass of hardenable photoluminescent material 280 inherently prevents downward pressure on the mass of hardenable photoluminescent material 280 that could press hardenable photoluminescent material 280 into volumes V and possibly cause the hardenable photoluminescent material 280 to squeeze between flange lower surface 272 and projectile rear surface 95, outwardly and undesirably beyond each central area 95B into circumferential area 95A of rear surface 95, defeating the masking function of flange 270 and causing nonuniformities in the solid photoluminescent bodies formed on the respective projectiles, as will be described. Although spreader 285 is a hand-held implement in this example, being easily manipulated by hand during the spreading process, a mechanized spreader can also be used if so desired.

As explained above, the mass of hardenable photoluminescent material 280 is maintained at an operating viscosity while it is being spread and deposited into each volume V that is sufficient to enable the mass of hardenable photoluminescent material 280 to be consistently and evenly spread over upper surface 245 and volumes V of masking plate 245 by spreader 285, to consistently deposit into and be retained in quantity 280A by each volume V, and to be scraped from over each volume V by straight edge 280 as shown in FIG. 29, to thereby fill each volume V as shown in FIG. 30 with quantity 280A of hardenable photoluminescent material 280 that is coplanar or otherwise flush with respect to upper surface 245 of masking plate 240 and radially symmetrical with respect to axis X, and at the same time to disable quantity 280A in each volume V from flowing radially outwardly beyond central area 95B of rear surface 95 to the masked circumferential area 95A of rear surface 95 while masking plate 240 is in masking contact with rear surface 95. Preferably, hardenable photoluminescent material 280 has the operating viscosity during this spreading and filling of volumes V process within a range of 10,000-50,000 VCS K in response the chosen the process being carried out in the presence of the preferred operating temperature, which is from 67 to 73° F. as described herein. This operating temperature is also preferably maintained during the time period required for the photoluminescent material to harden into a solid photoluminescent body. If desired, the hardenable photoluminescent material may be deposited directly into each volume V, such as by a hand-operated or mechanized depositor, and excess hardenable photoluminescent material scraped away to thereby fill each volume V with quantity 280A of the hardenable photoluminescent material 280 that is coplanar or otherwise flush with upper surface 245 of masking plate 240 as shown in FIG. 30.

Figure 31:
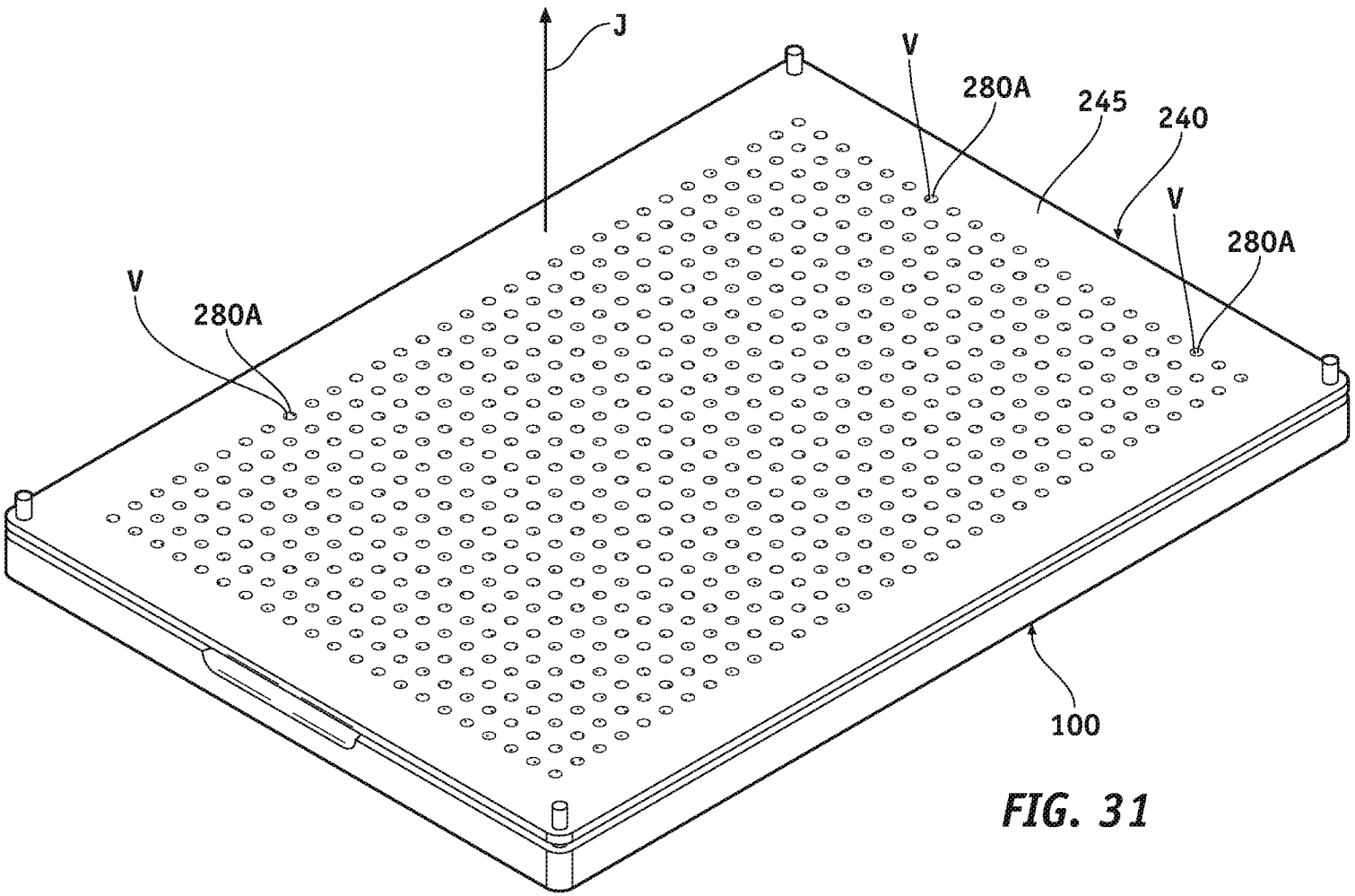
FIG. 31 is a view corresponding to FIG. 28 illustrating quantities of the hardenable photoluminescent material deposited into the volumes.
Figure 33:
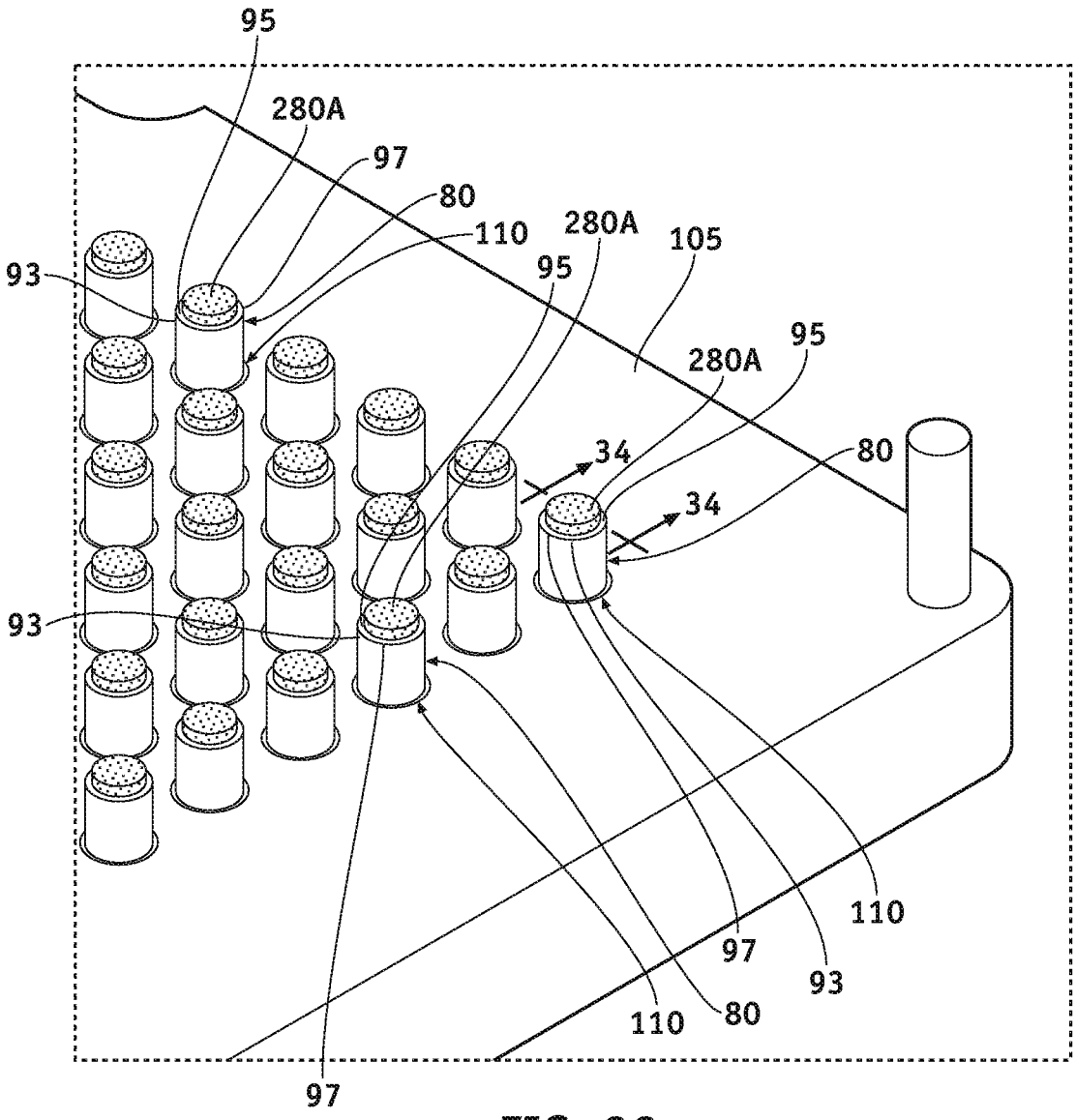
FIG. 33 is an enlarged, fragmentary view of an area designated by a dotted line box of FIG. 32 to better illustrate quantities of hardenable photoluminescent material deposited onto the rear surfaces of the projectiles held by the baseplate in the nose down, trailing end up orientation.
Figure 34:
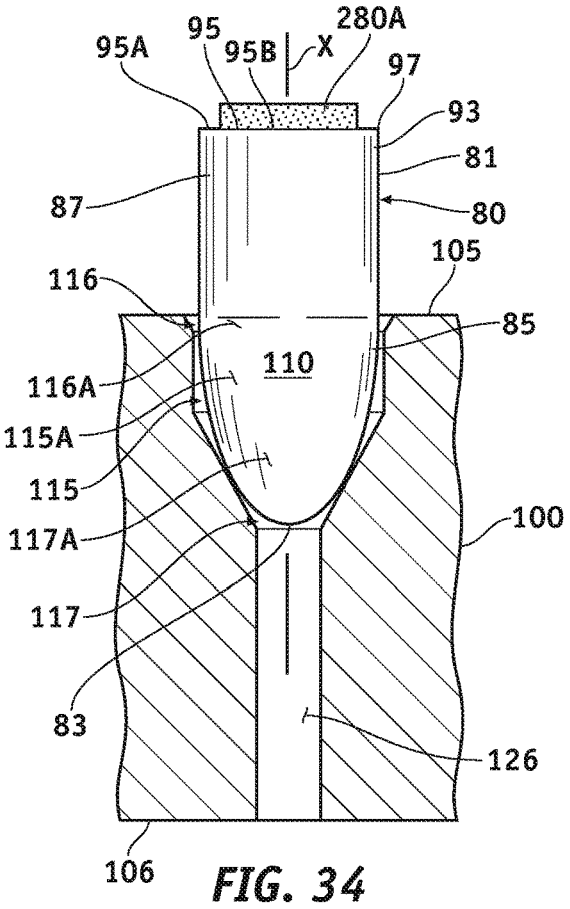
FIG. 34 is a section view taken along line 34-34 of FIG. 33 illustrating the projectile and a quantity of the hardenable photoluminescent material deposited onto the central area of the rear surface of the projectile, the projectile and photoluminescent material being shown in solid line and not sectioned for illustrative purposes.

FIG. 31 is a view corresponding to FIG. 28 illustrating volumes V each filled with quantity 280A of hardenable photoluminescent material, each quantity 280A having been deposited into a corresponding volume V as shown and described above in conjunction with FIGS. 29 and 30. Before each quantity 280A of the hardenable photoluminescent material hardens or least sufficiently hardens, the method importantly calls for unmasking circumferential area 95A of each projectile 80 in FIG. 32, in this example by withdrawing masking plate 240 from over baseplate 100 and from over projectiles 80 in the direction of arrow J in FIG. 31 thereby removing masking plate 240 from baseplate 100 and projectiles 80 and withdrawing each projectile 80 from a corresponding receiving void 250 while, at the same time, leaving projectiles 80 installed in baseplate 100 vertically upright in the nose 83 down, trailing end 93 up orientation with quantities 280A of hardenable photoluminescent material deposited on rear surfaces 95 thereof. The deposited photoluminescent material 280A is thus released from the confining volumes V. FIG. 32 is a view of the embodiment of FIG. 31 with masking plate 240 withdrawn. FIG. 33 is an enlarged, fragmentary view of an area designated by a dotted line box B2 of FIG. 32 to better illustrate quantities 280A of hardenable photoluminescent material deposited centrally onto rear surfaces 95 of projectiles 80 held by baseplate 100 in the nose 83 down, trailing end 93 up orientation immediately upon removal of masking plate 240. FIG. 34 is an enlarged section view taken along line 34-34 of FIG. 33 illustrating a projectile 80 and quantity 280A of hardenable photoluminescent material deposited onto central area 95B of rear surface 95 following unmasking. After unmasking, the processed projectiles 80 are identical, the details of which are now discussed in conjunction with FIGS. 34-36.

Figure 35:
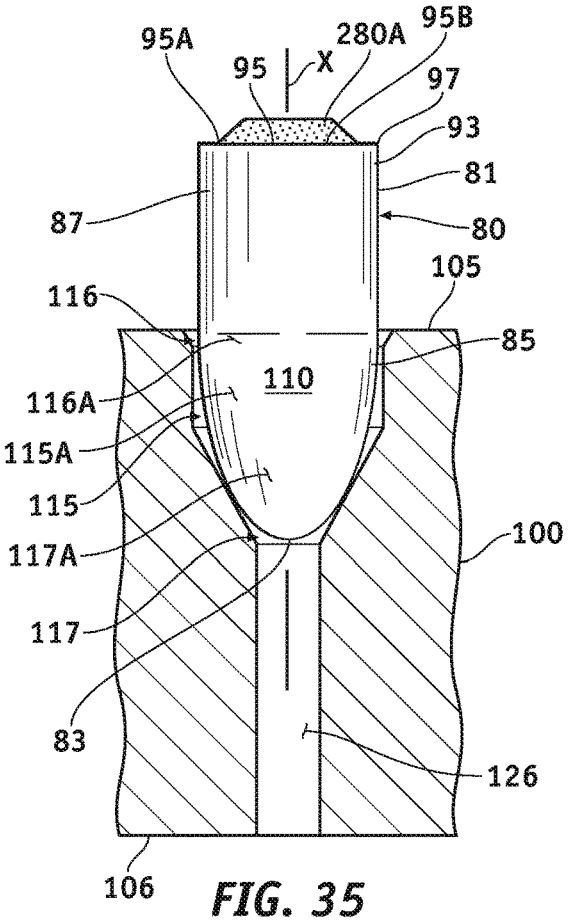
FIGS. 35 and 36 are views corresponding to FIG. 34 illustrate a sequence of a slumping and a hardening of the quantity of the hardenable photoluminescent material from being deposited onto the central area of the rear surface of the projectile from FIG. 34 to form a solid photoluminescent body on the rear surface of the projectile thereby forming a one-way luminescent projectile in FIG. 36, the projectile and photoluminescent material being shown in solid line and not sectioned for illustrative purposes.
Figure 36:
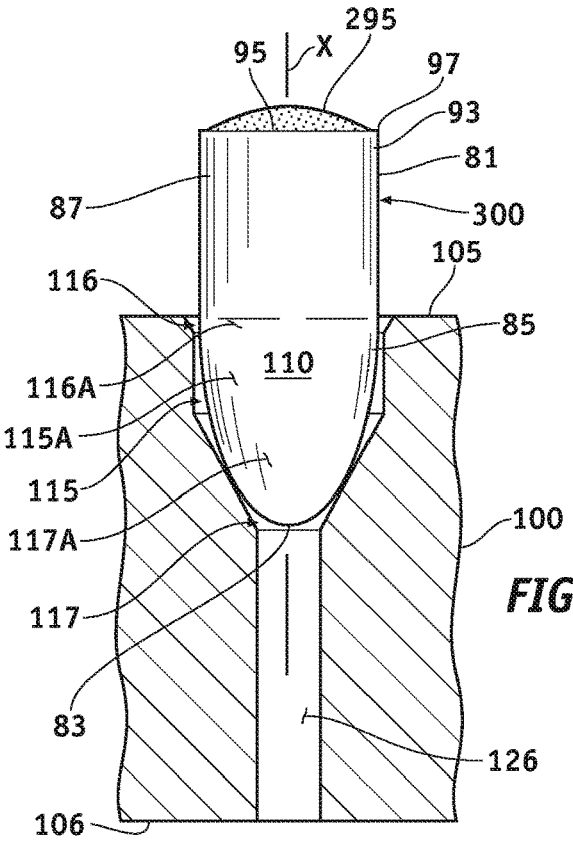

Referring to FIGS. 34-36, projectile 80, now free of masking plate 240, is seated in cavity 110 of baseplate 100, as previously described in conjunction with FIGS. 9-12, secured in a nose down tail end up orientation, extending upright beyond upper surface 105 of baseplate 100 to put rear surface 95 of trailing end 93 a distance 165 above upper surface 105 of baseplate 100 with quantity 280A of hardenable photoluminescent material 280 deposited centrally on rear surface 95, i.e. on central area 95B of rear surface 95, which is concentric with circumferential area 95A of rear surface 95 and perimeter edge 97 and is symmetrical about axis X. As previously noted, rear surface 95 is substantially level and coplanar with the rear surfaces of the other projectiles 80 secured in baseplate 100. Following unmasking and thereby freeing quantity 280A from volume V into which it was deposited and from the influence of masking plate 240, the described operating viscosity of the hardenable photoluminescent material is sufficient to cause quantity 280A to automatically permit the mixture to flow on the projectile rear surface, shown by way of illustration in FIGS. 35 and 36, to no further than perimeter edge 97 in FIG. 36 during the period of time required for quantity 280A of hardenable photoluminescent material 280 to sufficiently harden to form solid photoluminescent body 295 on rear surface 95 as shown in FIG. 36. Body 295 is concentric with, and extends radially outwardly from axis X no further than, perimeter edge 97, and is radially symmetrical relative to axis X, thereby forming a luminescent projectile in FIG. 36 denoted at 300 that is subsequently withdrawn from baseplate 100. Again, for consistency the steps of depositing and waiting with the orientation of projectiles 80 maintained while the hardenable photoluminescent material 280 hardens to form solid photoluminescent body 295 are carried out at the described operating temperature, such as in a temperature-controlled room, enclosed space, or other chosen temperature-controlled environment, wherein the depositing and waiting steps are temperature-controlled processes, according to the invention.

The described production of each projectile 80 to luminescent projectile 300 as in FIG. 36 ends the method of mass-producing luminescent projectiles, which may be consistently and efficiently repeated over and over as needed for consistently and repeatedly producing luminescent projectiles that are inherently consistent in weight, configuration, and balance, and thereby uniform and inherently suitable for precision shooting. Since projectiles 80 identically interact with the various plates and are identically processed throughout each of the various method steps, the methods disclosed herein are inherently efficient and easily repeatable. Further, the distribution of solid photoluminescent body 295 on rear surface 95 of each luminescent projectile 300 mass-produced according to this disclosure is inherently and importantly consistent from projectile to projectile, and from batch to batch.

In FIGS. 36 and 38, solid photoluminescent body 295 of the finished luminescent projectile 80, like each luminescent projectile consistently and efficiently mass-produced according to this disclosure, extends radially outward from axis X to inboard of perimeter edge 97, and otherwise extends outwardly no further than perimeter edge 97. This inherently disables solid photoluminescent body 295 from coming into direct contact against a firearm barrel through which the mass-produced luminescent projectile 300 is fired thereby eliminating any need to remove or shape the deposited solid photoluminescent body 295 to ensure none of it extends beyond perimeter edge 97. Again, volume V and width 275 of circumferential area 95A masked by masking plate 240 cooperate together to enable the deposited quantity 280A of hardenable photoluminescent material to slump and form solid photoluminescent body 295, which is rounded in this embodiment as illustrated, following unmasking and in response to the disclosed waiting step.

After the unmasking step, the waiting step while projectiles 80 remain held by baseplate 100 in the nose 83 down, trailing end 93 up orientation is at least a predetermined period of time, e.g. twelve hours, to ensure maximum adhesion and prevent deformation of the hardenable photoluminescent material 280 of each quantity 280A. Again, the method preferably includes maintaining the hardenable photoluminescent material 280 at the operating temperature during the waiting step for keeping consistent the inherent material characteristics of the hardenable photoluminescent material 280 while it hardens or otherwise cures. An additional time period, such as at least forty-eight hours, is suitably permitted for hardening/curing of quantities 280A before the finished luminescent projectiles are used to produce loaded ammunition.

Openings 271 of masking plate 240 cooperate with the central areas 95B of rear surfaces 95 to produce volumes V that are identical in size and in shape to facilitate formation of identical or otherwise uniform solid photoluminescent bodies on rear surfaces 95 of uniform projectiles 80 mass-produced into luminescent projectiles according to the teachings of this specification. Further, by providing the operating viscosity of the hardenable photoluminescent material and carrying out the method at the described operating temperature, from 67 to 73° F. in this example, a repeatable and consistent radially symmetrical flow pattern of the photoluminescent material is provided upon removal of masking plate 240 for inherently producing the resulting solid photoluminescent bodies that are each concentric with, and extend outwardly no further than, perimeter edge 97 and radially symmetrical relative to axis X. When masking plate 240 is installed over baseplate 100 and over trailing ends 93 of projectiles 80 secured by baseplate 100 identically in the nose 83 down, trailing end 93 up orientation, projectiles 80 are identically masked, the defined volumes V are identical when filled and leveled at upper surface 245 of masking plate 240 provide identical centered quantities of hardenable photoluminescent material rear surfaces 95, which results in the mass production of luminescent projectiles that are entirely uniform and suitable for precision shooting.

Luminescent projectiles mass-produced according to this disclosure and the various steps described herein and shown in the various illustrations are consistent and accurately produced from batch to batch, identical in every respect to luminescent projectile 300 in FIGS. 36 and 38, and are, again, inherently consistent in weight, configuration, and balance, and thereby uniform and inherently suitable for precision shooting. In FIGS. 36 and 38, luminescent projectile 300 includes the previously-described body 81 having nose 83, shoulder 85, cylindrical caliber section 87 having caliber diameter 90, base or trailing end 93 including rear surface 95 and perimeter edge 97, and additionally solid photoluminescent body 295 adhered centrally on rear surface 95. Body 81 is symmetrical about axis X that extends centrally through body 81 from nose 83 to rear surface 95. Rear surface 95 extends radially outward from axis X toward perimeter edge 97. Solid photoluminescent body 295 is concentric with, and extends outwardly no further than, perimeter edge 97, and is radially symmetrical relative to axis X, according to the invention.

In the present example, each bullet 80 is .45 caliber bullet, in which caliber diameter 90 and the diameter of rear surface 95 are each 0.45 of an inch. According to this size of chosen projectile 80, volume V and quantity 280A are each 0.0031912666 cubic inches, the diameter 277 of opening 271 of volume V is 0.368 of an inch, and the solid photoluminescent body 295 extends radially outwardly from axis X 0.215 inches. These values can vary depending on the caliber of the chosen projectile. For a hardenable photoluminescent material having an operating viscosity maintained in the range of from 10,000 to 50,000 VCS applied within the range of temperatures between 67 to 73° F., the following volumes V and diameters 277 illustrated by way of example can be used for various projectile calibers, resulting in solid bodies of photoluminescent material of the following diameters on the rear surfaces of the respective projectiles:

| Caliber | Mask Diameter (inches) | Volume (cubic inches) | Final Spread (Body) Diameter (inches) |
|---|---|---|---|
| .380 | 0.267 | 0.0016799253 | 0.325 |
| 38/9 mm | 0.271 | 0.0017306372 | 0.325 |
| .40 S&W | 0.316 | 0.0023531066 | 0.37 |
| .44 Mag. | 0.350 | 0.0028867125 | 0.40 |
| .223-.556 | 0.059 | 0.0000820298 | 0.169 |
| .308-7.62 | 0.099 | 0.0002309606 | 0.2415 |

Figure 37:
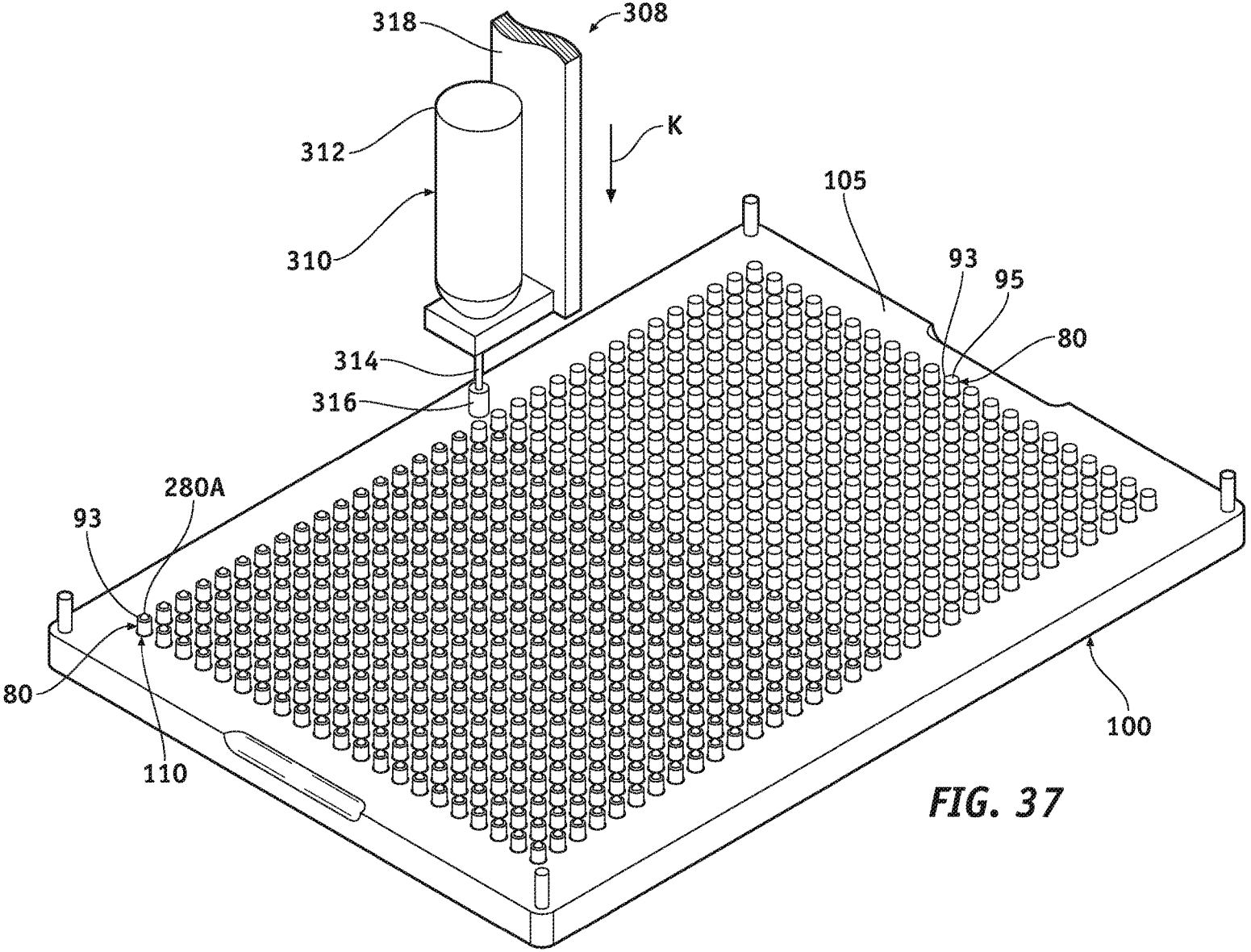
FIG. 37 is a view corresponding to FIG. 25 illustrating an alternate method of depositing a quantity of a hardenable photoluminescent material centrally on the rear surface of each of the projectiles.
Figure 37A:
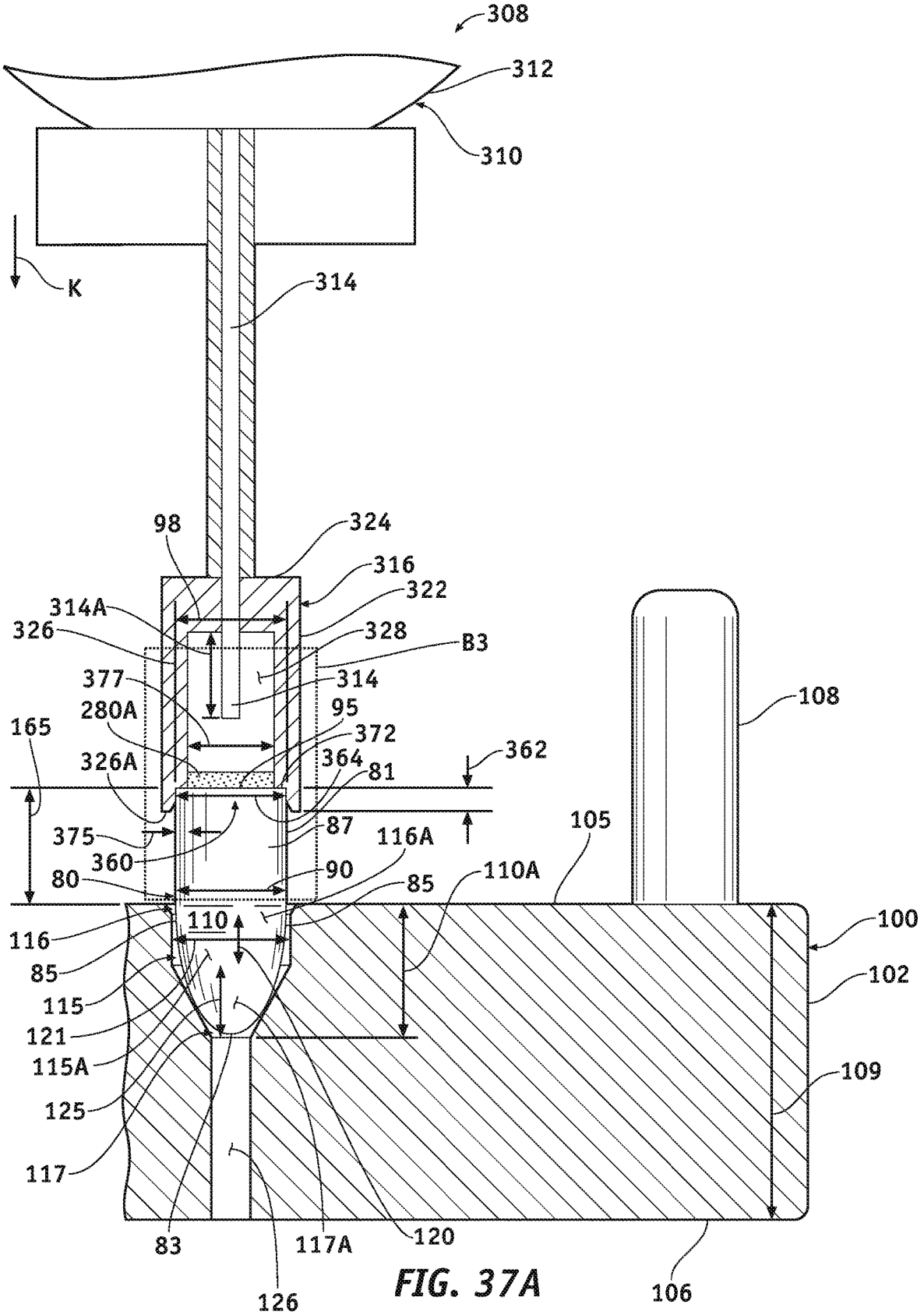
FIG. 37A is a vertical section view of the embodiment of FIG. 37.

The method described above discloses identically depositing a quantity of the hardenable photoluminescent material centrally on rear surface 95 of each projectile 80 using masking plate 240. In an alternate method, masking plate 240 is omitted and the step of depositing a quantity of the hardenable photoluminescent material centrally on the rear surface of each projectile includes, with reference to FIGS. 37 37A, employing a conventional mechanized indexed depositor system 308 to deposit, in turn, an identical individual blob 280A of the hardenable photoluminescent material 280 centrally on rear surface 95 of each projectile 80 secured by baseplate 100 in the vertically upright nose 83 down, trailing end 93 up orientation. Each blob 280A consists of an identical precise amount of hardenable photoluminescent material 280 with an identical predetermined initial configuration and central disposition on rear surface 95.

Figure 37B:
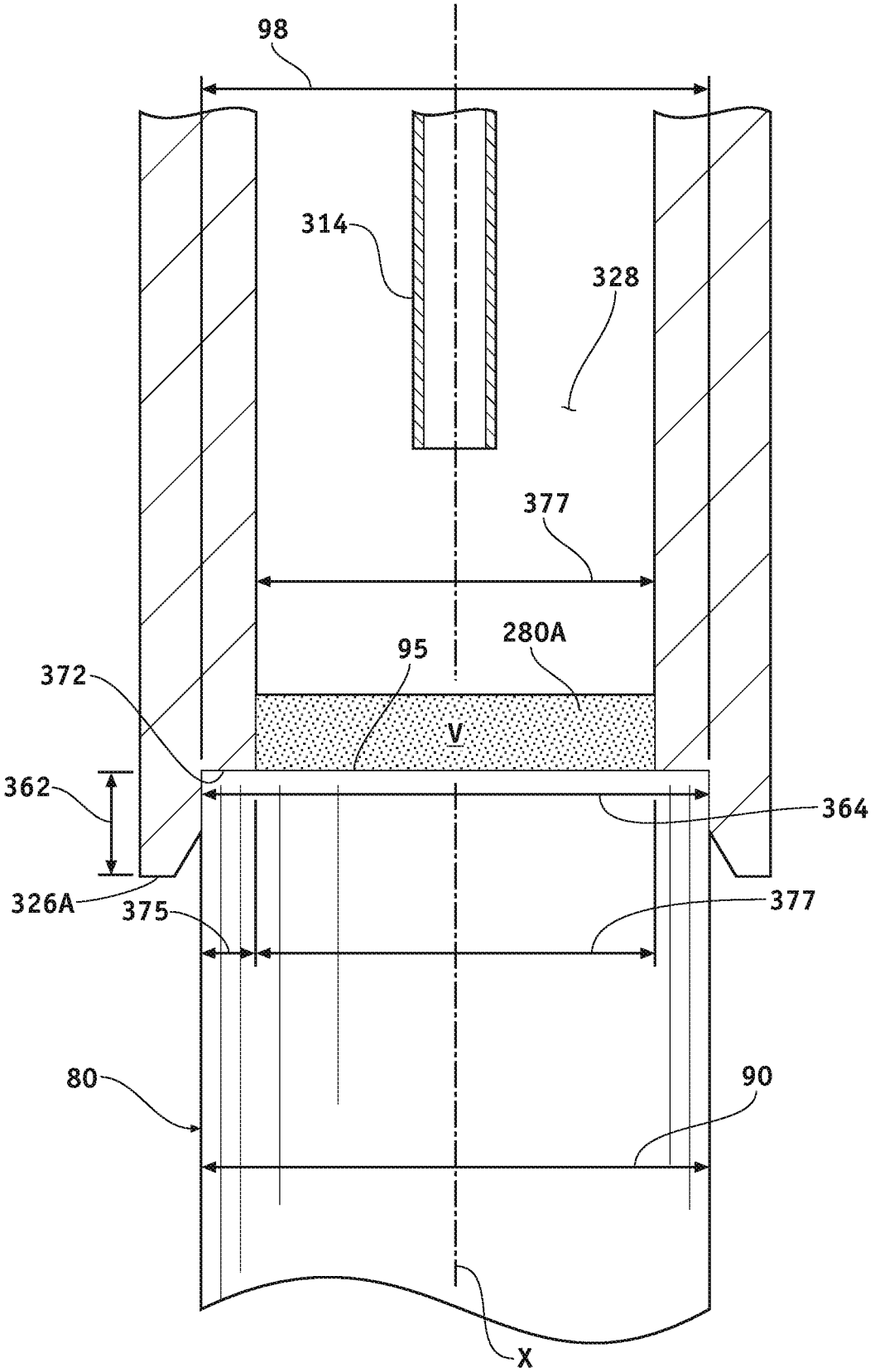
FIG. 37B is an enlarged, fragmentary view of an area designated by a dotted line box in FIG. 37A.

Depositor system 308 suitably comprises a mechanically actuated dispenser 310, cooperating with a placement fixture 316 and a conventional indexing system (generally indicated as 318). Dispenser 310 and fixture 316 are suitable mounted above baseplate 100 and cooperate with indexing system 318. Indexing system 318 can be any system capable of effecting relative movement between fixture 316 and baseplate 100, disposing fixture 316 in axial alignment above each of the projectiles 80 secured in baseplate 100 in turn. Indexing system 318 disposes fixture 316 in axial alignment above one of the projectiles 80 secured in baseplate 100. Fixture 316 is then lowered by indexing system 318, in the direction K, into engagement with projectile 80, also illustrated in FIG. 37B (an enlarged, fragmentary view of an area designated by a dotted line box B3 in FIG. 37A), to define, in cooperation with the projectile rear surface 95, a radially confined volume V overlying a central area of rear surface 95. The engagement with actuates dispenser 310, so that a predetermined amount of hardenable photoluminescent material is deposited on rear surface within volume V. The amount of hardenable photoluminescent material is sufficient to cover the central area of rear surface 95 and radially conforms to the volume, filling volume V to a predetermined distance above rear surface 95. Fixture 316 is then raised, to permit the hardenable photoluminescent material to slump under the influence of gravity, radially outward on the projectile rear surface 95, with concentricity and radial symmetry, extending to a predetermined radius, and no farther. After fixture 316 is raised, system 318 effects relative movement between fixture 316 and baseplate 100 to dispose fixture 316 in axial alignment above the next successive projectile 80 in baseplate 100, and the dispensing process repeated.

Dispenser 310, in this embodiment, comprises a reservoir 312, and a hollow depositor tube 314. Fixture 316 suitably comprises a hollow cylindrical body 322 having an upper cap 324 and a cylindrical wall 326 with a lower end 326A and a chosen inner diameter 377. The inner diameter of cylindrical wall 326 defines a downwardly opening interior cavity 328. A cylindrical downwardly opening socket 360, having a chosen diameter 364, is formed in the lower end 326A. Socket 360 opens at cylindrical wall lower end 326A and extends upwardly a chosen distance 362 to terminate in an annular end wall 372. Socket diameter 364 corresponds to caliber diameter 90 of caliber section 87 of a projectile 80, with a chosen clearance e.g., of approximately five thousandths inch larger than the nominal caliber diameter 90, to enable the reception of a projectile 80. Diameter 377 interior cavity 328 is less than diameter 364 of socket 360 and, and thus diameter 98 of projectile rear surface 95, by a predetermined distance 375. Socket 360 and annular end wall 372 are generally analogous to socket 260 and lower surface 272 of flange 270 of one of the receiving voids 250 of masking plate 240. When fixture 316 is lowered to engage with a projectile 80, and a projectile is received in socket 360, socket annular end wall 372 is brought into direct contact with projectile rear surface 95.

Depositor tube 314 is suitably coaxial with cylindrical body 318, extending through upper cap 324 and downwardly a chosen distance 314A into interior cavity 324. Tube 314 communicates with reservoir 312, suitably through a conventional actuation and metering mechanism (not shown) incorporated into reservoir 312. When annular end wall 372 is brought into contact with projectile rear surface 95, dispenser 310 is actuated to dispense a predetermined amount of hardenable photoluminescent material through tube 314. The amount of hardenable photoluminescent material is sufficient to cover the central area of rear surface 95 and radially conforms to the volume, filling cavity 328 to a predetermined distance above rear surface 95. The contact between annular end wall 372 and underlying circumferential area of rear surface 95 prevents flow of the material onto the underlying surface, confining the hardenable photoluminescent material to the volume defined by fixture cavity 328 over the central area rear surface 95.

Fixture 316 is then raised, leaving the deposited material 280A initially in a centrally aligned cylinder on project rear surface 95 and permitting the hardenable photoluminescent material to slump under the influence of gravity, radially outward on the projectile rear surface 95, with concentricity and radial symmetry, extending to a predetermined radius, and no farther. After fixture 316 is raised, system 318 effects relative movement between fixture 316 and baseplate 100 to dispose fixture 316 in axial alignment above the next successive projectile 80 in baseplate 100, and the dispensing process repeated.

In this embodiment, like the previously-described embodiment, the deposited hardenable photoluminescent material is of a consistent operating viscosity and temperature-control is maintained to cause the hardenable photoluminescent material of each blob 280A to automatically slump uniformly and radially outward on rear surface 95 as shown in FIGS. 35 and 36 from axis X to form solid photoluminescent body 295 in response to the previously-described waiting step. In this embodiment, each blob 280A is the quantity of the hardenable material, blobs 280A are identical, and each solid photoluminescent body on rear surface 95 formed from a corresponding blob 280A that is concentric with, and extends outwardly no further than, perimeter edge 97, and radially symmetrical relative to axis X in FIGS. 36 and 38.

Figure 37C:
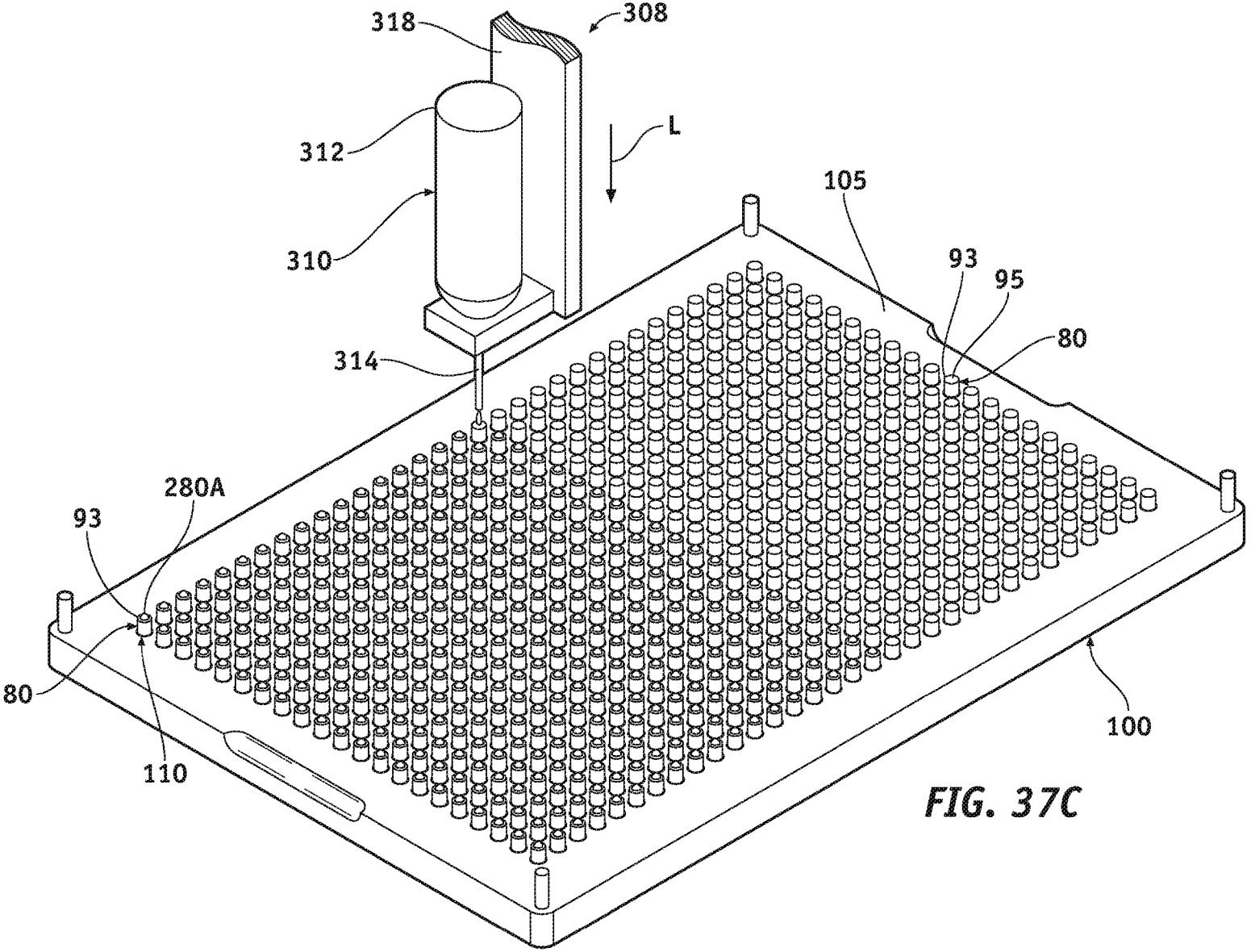
FIG. 37C is a view corresponding to FIG. 25 illustrating yet another method of depositing a quantity of a hardenable photoluminescent material centrally on the rear surface of each of the projectiles.

The method described above in reference to FIGS. 37, 37A, and 37B discloses identically depositing a quantity of the hardenable photoluminescent material centrally on rear surface 95 of each projectile 80 using depositor system 308 configured with placement fixture 316. In an alternate method, placement fixture 316 is omitted and the step of depositing a quantity of the hardenable photoluminescent material centrally on the rear surface of each projectile includes, with reference to FIG. 37C, employing depositor system 308 to deposit, in turn, an identical individual blob 280A of the hardenable photoluminescent material 280 centrally on rear surface 95 of each projectile 80 secured by baseplate 100 in the vertically upright nose 83 down, trailing end 93 up orientation. Each blob 280A consists of an identical precise amount of hardenable photoluminescent material 280 with an identical predetermined initial configuration and central disposition on rear surface 95.

Indexing system 318 disposes depositor tube 314 in axial alignment above one of the projectiles 80 secured in baseplate 100. Depositor tube 314 is then lowered by indexing system 318, in the direction L, toward projectile 80, and dispenser 310 actuates so that a predetermined amount of hardenable photoluminescent material is dispensed through tube 314 and is deposited on rear surface 95. Depositor tube 314 is then raised, to permit the hardenable photoluminescent material to slump under the influence of gravity, radially outward on the projectile rear surface 95, with concentricity and radial symmetry, extending to a predetermined radius, and no farther. After depositor tube 314 is raised, system 318 effects relative movement between depositor tube 314 and baseplate 100 to dispose depositor tube 314 in axial alignment above the next successive projectile 80 in baseplate 100, and the dispensing process repeated.

In this embodiment, like the previously-described embodiment, the deposited hardenable photoluminescent material is of a consistent operating viscosity and temperature-control is maintained to cause the hardenable photoluminescent material of each blob 280A to automatically slump uniformly and radially outward on rear surface 95 as shown in FIGS. 35 and 36 from axis X to form solid photoluminescent body 295 in response to the previously-described waiting step. In this embodiment, each blob 280A is the quantity of the hardenable material, blobs 280A are identical, and each solid photoluminescent body on rear surface 95 formed from a corresponding blob 280A that is concentric with, and extends outwardly no further than, perimeter edge 97, and radially symmetrical relative to axis X in FIGS. 36 and 38.

Figure 39:
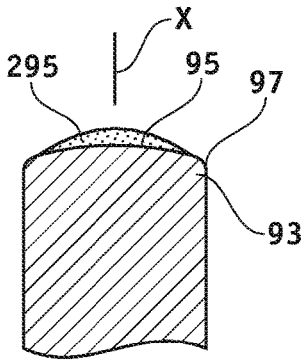
FIGS. 39-46 are vertical section views illustrating different configurations of projectile trailing ends each including a solid photoluminescent body deposited thereon according to the invention.
Figure 40:
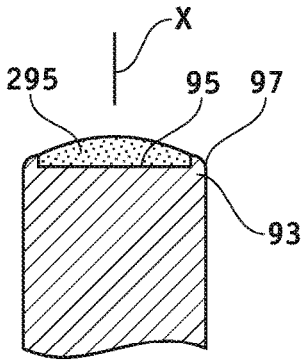
Figure 41:
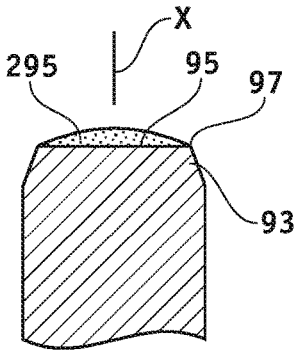
Figure 42:
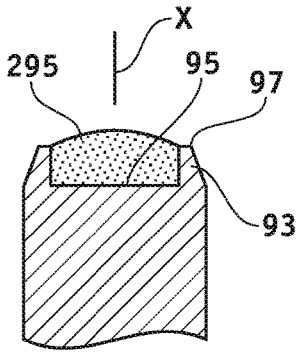
Figure 43:
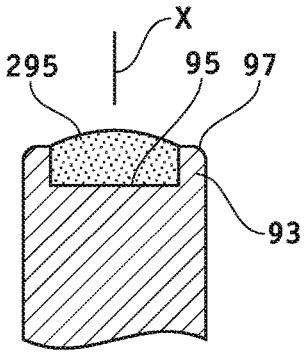
Figure 44:
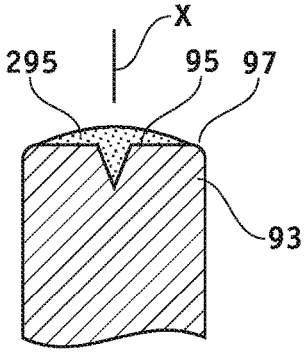
Figure 45:
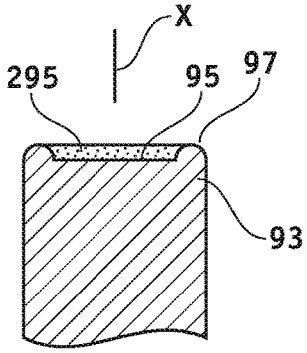
Figure 46:
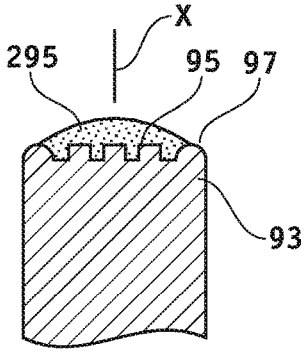

The methods disclosed with particularity herein are discussed by way of example in conjunction with projectiles 80 each having a trailing end 93 with rear surface 95 that is flat. The methods disclosed herein can be equally carried out with projectiles having trailing ends with rear surfaces having other configurations, such as rounded, recessed or cored, and the like, consistent with the teachings presented herein. As a matter of example, different projectile trailing end and rear surface configurations that can be employed in the various methods disclosed herein are shown in FIGS. 39-46 each having deposited thereon a solid photoluminescent body 295 that is radially symmetrical relative to axis X. For example, rear surface 95 of projectile trailing end 93 of FIG. 39 is rounded and solid photoluminescent body 295 deposited thereon is rounded and extends outwardly no further than perimeter edge 97. Rear surface 95 of projectile trailing end 93 of FIG. 40 is recessed and solid photoluminescent body 295 deposited thereon is rounded and extends outwardly no further than perimeter edge 97. Rear surface 95 of projectile trailing end 93 of FIG. 41 is flat and solid photoluminescent body 295 deposited thereon is rounded and extends outwardly no further than perimeter edge 97 and trailing end 93 has a boat tail configuration. Rear surface 95 of projectile trailing end 93 of FIG. 42 is cored and solid photoluminescent body 295 deposited thereon is rounded and extends outwardly no further than perimeter edge 97 and trailing end 93 has a boat tail configuration. Rear surface 95 of projectile trailing end 93 of FIG. 43 is cored and solid photoluminescent body 295 deposited thereon is rounded and extends outwardly no further than perimeter edge 97. Rear surface 95 of projectile trailing end 93 of FIG. 44 is indented to help adhere to rounded solid photoluminescent body 295 deposited thereon that extends outwardly no further than perimeter edge 97. Rear surface 95 of projectile trailing end 3 of FIG. 45 is recessed and solid photoluminescent body 295 deposited thereon is flat and extends outwardly no further than perimeter edge 97. Rear surface 95 of projectile trailing end 93 of FIG. 46 is toothed and solid photoluminescent body 295 deposited thereon is rounded and extends outwardly no further than perimeter edge 97. In the embodiments of FIGS. 39-46, the hardenable photoluminescent material can be deposited by masking or by depositing blobs as disclosed herein. With regard to masking, a masking plate constructed and arranged in accordance with the principle of the invention can be configured to accommodate all such projectile configurations. In each instance, lower surface 272 of flange 270 is configured to mask the projectile rear surface and concurrently form the volume by a cooperation between the opening 271 and the rear surface of the given projectile.

Figure 47:
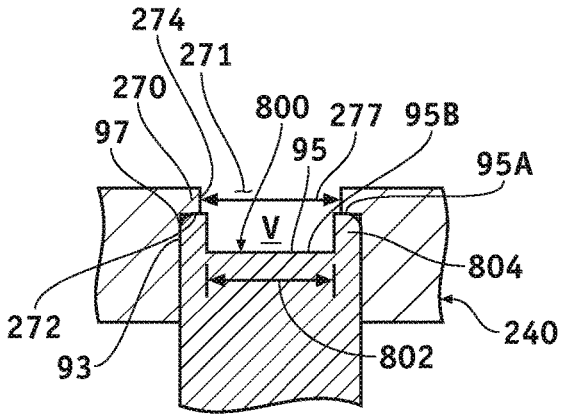
FIGS. 47-49 illustrate a sequence of steps of forming a cored projectile trailing end with photoluminescent material.
Figure 48:
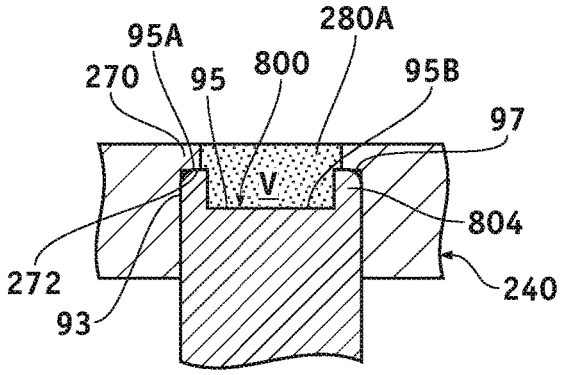
Figure 49:
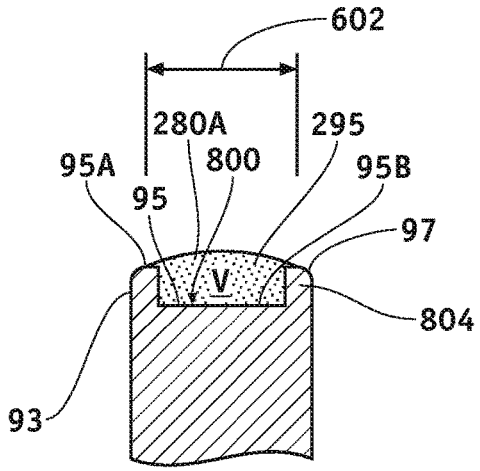

In the case of recessed (FIG. 40) or cored (FIG. 43) projectile trailing ends, the position of annular surface 272 relative to the edge of the recess or core, i.e., the diameter of opening 271 relative to the diameter of the recess or core, determines how the hardenable photoluminescent material is retained within the recess or core. For example, in FIGS. 47-49, rear surface 95 of projectile trailing end 93 defines core 800 having a diameter 802, and an annular rim 804 of trailing end 93 extending upright from core 800 to lower surface 272 of flange 270, in which core diameter 802 is less than the diameter 277 of opening 271 defined by flange 270. Annular surface/edge 274 of flange 270 resides over annular rim 804, and lower surface 272 of flange 270 directly contacts and masks circumferential area 95A of annular rim 804 extending circumferentially outward from core 800 to perimeter edge 97. In the process of configuring the modified projectile 80 in FIG. 47 with a solid photoluminescent body, hardenable photoluminescent material 280 is deposited over opening 271 and deposited therefrom into volume V defined by and between opening 271 and central area 95B of cored rear surface 95, namely, core 800 as defined by central area 95B of rear surface 95, to thereby fill volume V with the chosen quantity of hardenable photoluminescent material in FIG. 48. When masking plate 240 is removed, gravity causes hardenable photoluminescent material 280 filling volume V to flow radially outward on circumferential area 95A of rear surface 95 of annular rim 804 to radius 602 in FIG. 49 to form solid photoluminescent body 295 during the previously described waiting step.

Figure 50:
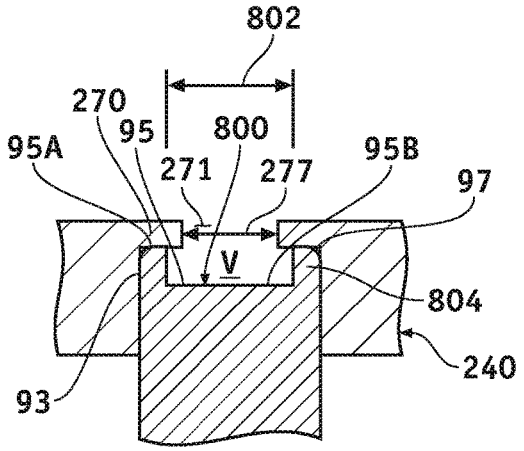
FIG. 50-52 illustrate another embodiment of a sequence of steps of forming a cored projectile trailing end with photoluminescent material.
Figure 51:
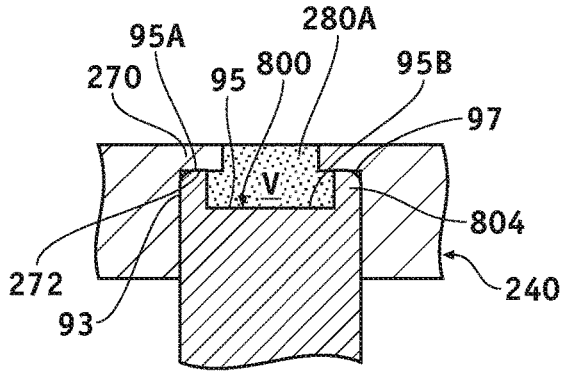
Figure 52:
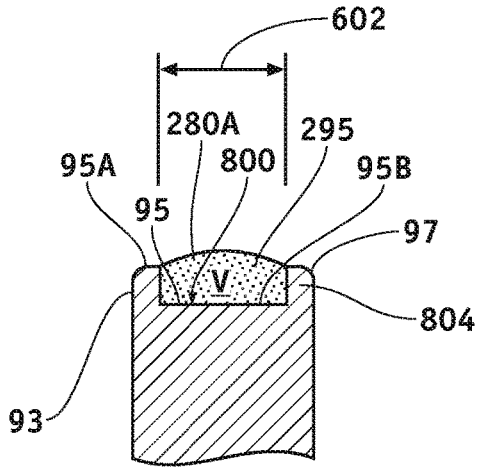

In FIG. 50, core diameter 802 is greater than opening 271 diameter 277, and flange 270 extends over core 800. Lower surface 272 of flange 270 however, directly contacts circumferential area 95A of annular rim 804. When hardenable photoluminescent material 280 is deposited over opening 271, the volume defined by core 800 and opening 271 is filled as shown in FIG. 51. When masking plate 240 is removed, gravity causes hardenable photoluminescent material 280 to flow radially outward. However, such flow is typically constrained within core 800, i.e., predetermined radius 602 is less than or equal to core radius 802 in FIG. 52.

Figure 53:
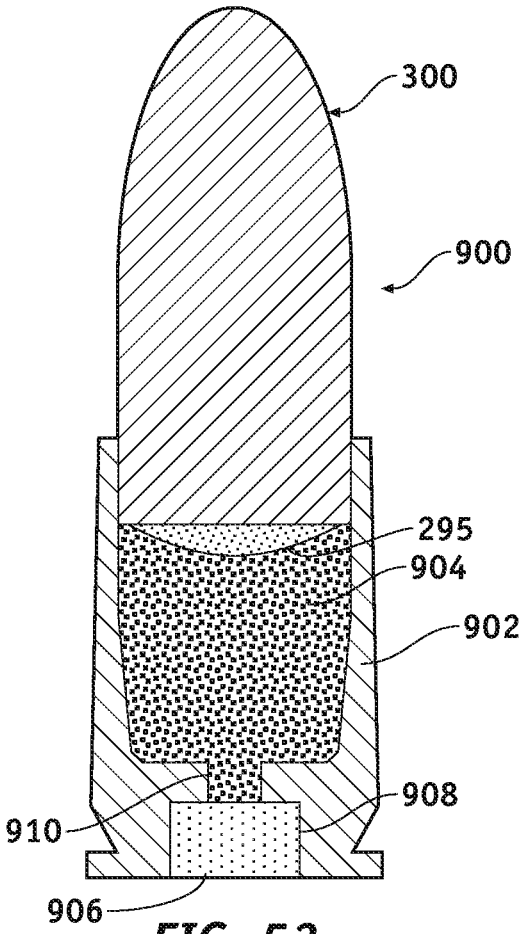
FIG. 53 is vertical section view of a cartridge incorporating a luminescent projectile mass-produced according to the invention.

As a matter of example, FIG. 53 shows the previously-described luminescent projectile 300 assembled together with a casing 902, propellant 904, and primer 906 into a cartridge 900 using conventional techniques. Casing 902 is formed of brass, steel, aluminum, polymer, or the like, and has a circular mouth having a diameter corresponding that of projectile 300, and a primer pocket 908 communicating with the interior of the casing through a flash hole 910. A measured charge of propellant 904 is disposed within the interior of casing 902, and primer 906 is received in primer pocket 908. Projectile 300 is pressed into the casing mouth, such that luminescent material 500 is received within the interior of casing 902. When primer 106 is actuated, it ignites propellant 904. Propellant 904 is chosen such that the burn process produces light having frequencies (e.g., color spectrum) corresponding to the frequencies of light required to charge (excite) solid photoluminescent body 295, which makes the projectile trajectory visible to the naked eye during nighttime and low-light conditions only from the perspective of the shooter viewing the intended target. The burning propellant also produces gas, which expands and creates pressure within the interior of casing 902. Because the material of solid photoluminescent body 295 of each luminescent projectile 300 is consistent in amount (and thus volume), concentricity and radially symmetrical configuration, for a given casing configuration and propellant, the pressure generated in the casing upon discharge is consistent from round to round.

Figure 54:
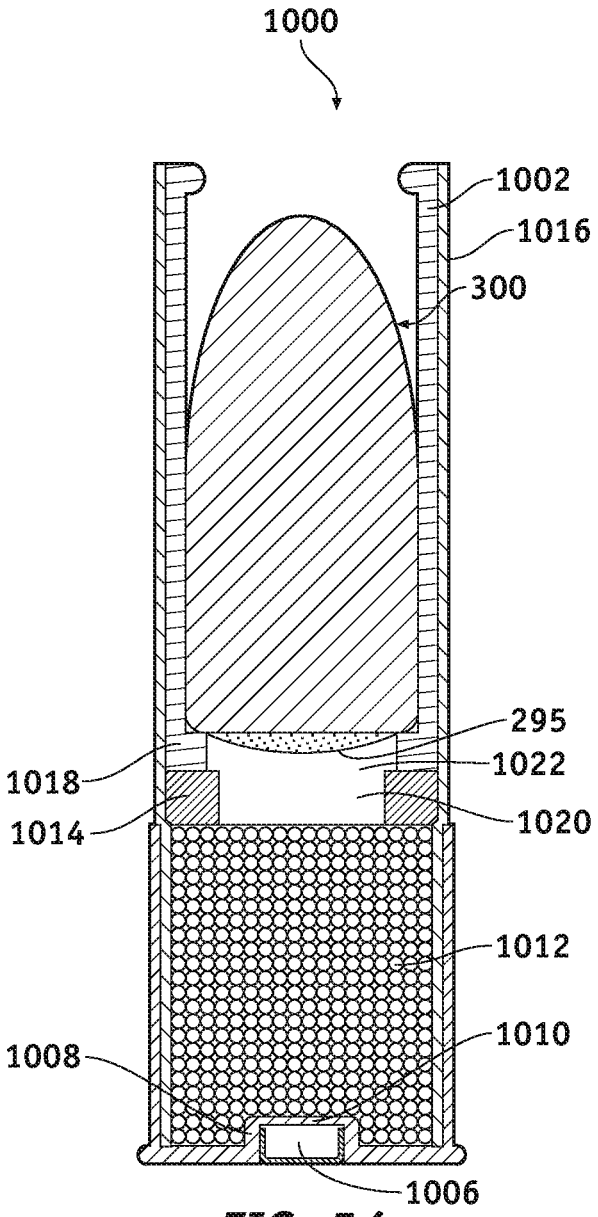
FIG. 54 is a vertical section view of a shotgun cartridge incorporating a luminescent projectile mass-produced according to the invention.

Luminescent projectiles 300 may also be used as slugs in shotgun cartridges. In FIG. 54, a shotgun slug cartridge 1000 is shown including projectile 300, a casing including a cylindrical husk 1002 formed of paper or plastic or the like and a base 1004 formed of brass with a cylindrical portion receiving the end of husk 1002, and a primer 1006 disposed in a primer pocket 1008 in base 1004 communicating with the interior of the base through a flash hole 1010. A measured charge of propellant 1010 is disposed within husk 1002. A spacer (washer) 1014 and wad including an upper cylindrical cup 1016 and a base 1018 are disposed over propellant 1010. Spacer 1014 and wad base 1018 each includes a central opening, 1020 and 1022, respectively, or a clear material of polypropylene or polyethylene or other chosen clear material, such that light generated by burning propellant 1010 during discharge is permitted to impinge upon, and excite, solid photoluminescent body 295 of projectile 300, which makes the projectile trajectory visible to the naked eye during nighttime and low-light conditions only from the perspective of the shooter viewing the intended target.

Those having ordinary skill in the art will readily appreciate that methods, efficient, cost-effective, and easily repeatable methods that do not require specialized skill, of mass-producing, i.e. mass-producing, one-way luminescent projectiles that are consistent in weight, configuration, and balance, and thereby uniform and inherently suitable for precision shooting, are disclosed herein. Various disclosed embodiments in various ordered combinations of method steps described in detail herein are now summarized in reference in relevant part to the various drawings.

The present invention is described above with reference to illustrative embodiments. However, those skilled in the art will recognize that changes and modifications may be made in the described embodiments without departing from the nature and scope of the present invention. For instance, in the examples discussed herein baseplate 100 is formed with six-hundred and seventy-two cavities 110 arranged in a particular pattern, loading plate 140 is formed with the same number and pattern of loading holes 150, stabilizer plate 180 is formed with the same number and pattern of stabilizer holes 190, and masking plate 240 is formed with the same number and pattern of receiving voids 250. These described numbers and the patterns disclosed herein are set forth by way of example, and can vary depending on the desired volume of mass-production and/or the size and/or shape of the projectiles to be mass-produced. Various other changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A method of mass-producing one-way luminescent projectiles, comprising steps of:

providing projectiles each comprising a body having a nose and a trailing end including a perimeter edge and a rear surface, wherein the body is symmetrical about an axis that extends centrally through the body from the nose to the rear surface and the rear surface extends radially outward from the axis toward the perimeter edge;

securing the projectiles each in a nose down, trailing end up orientation leaving each said rear surface exposed;

depositing a quantity of a hardenable photoluminescent material centrally on each said rear surface, the quantities being identical and hardening over a period of time; and maintaining the projectiles in the nose down, trailing end up orientation during at least said period of time such that each quantity of photoluminescent material forms an identical solid photoluminescent body adhered to the respective rear surface, that is concentric with, and extends outwardly no further than, the perimeter edge, and radially symmetrical relative to the axis.

2. The method according to claim 1, wherein the step of depositing the quantity of the hardenable photoluminescent material centrally on the rear surface of each said projectile comprises depositing a quantity of the hardenable photoluminescent material having a chosen operating viscosity causing each said quantity to automatically slump by gravity uniformly and radially outward on the rear surface from the axis to no further than the perimeter edge.

3. The method according to claim 2, additionally comprising establishing the chosen operating viscosity by maintaining the hardenable photoluminescent material at an operating temperature.

4. The method according to claim 3, wherein the operating temperature is from 67 to 73° F.

5. The method according to claim 2, wherein the step of depositing the quantity of the hardenable photoluminescent material centrally on the rear surface of each said projectile comprises depositing a blob consisting of a precise quantity of the hardenable photoluminescent material centrally on the rear surface of each said projectile.

6. The method according to claim 2, wherein the step of depositing the quantity of the hardenable photoluminescent material centrally on the rear surface of each said projectile comprises:

establishing a confining central volume on a central area of the rear surface of each projectile, the volume being concentric with the perimeter edge and symmetrical about the axis of the projectile;

filling each said volume with the quantity of the hardenable photoluminescent material, the quantity of the hardenable material contacting the central area of each said rear surface; and releasing the hardenable material from the confining volume.

7. The method according to claim 6, wherein the step of establishing a confining central volume comprises masking a circumferential area of each said rear surface extending radially outwardly to the perimeter edge defining the central volume in the interior of the masked circumferential area, and the releasing step comprises unmasking each said circumferential area.

8. The method according to claim 7, wherein the step of masking comprises:

providing a masking plate including an upper surface, a lower surface, and receiving voids formed through the masking plate from the lower surface to the upper surface, each said receiving void comprises a socket extending into the masking plate from the lower surface to an inwardly-directed annular end wall between the lower surface of the masking plate and the upper surface of the masking plate, and an opening extending from the annular end wall to the upper surface of the masking plate, wherein for each said projectile the annular end wall is configured to directly contact and mask the circumferential area of the rear surface, the socket is configured to center the opening over the central area of the rear surface, and the opening is configured to cooperate with the central area of the rear surface to define the volume, when the projectile is installed trailing end first into the socket; and applying the masking plate over the projectiles thereby installing the projectiles trailing ends first into the respective sockets.

9. The method according to claim 8, wherein the step of filling each said volume with the quantity of the hardenable photoluminescent material comprises spreading the hardenable photoluminescent material over the upper surface of the masking plate and each said volume.

10. The method according to claim 9, wherein the step of spreading the hardenable photoluminescent material comprises depositing a mass of the hardenable photoluminescent material on the upper surface of the masking plate and scraping a spreader over the upper surface of the masking plate and each said volume.

11. The method according to claim 10, wherein the step of unmasking the projectiles comprises withdrawing the masking plate from over the projectiles thereby withdrawing the projectiles from the receiving voids.

12. The method according to claim 1, additionally comprising texturizing each said rear surface uniformly before the depositing step.

13. The method according to claim 12, wherein the step of texturizing each said rear surface comprises roughening each said rear surface.

14. The method according to claim 13, wherein the step of roughening each said rear surface comprises abrasive-blasting each said rear surface.

15. The method according to claim 12, wherein the step of texturizing each said rear surface comprises cutting a texture into each said rear surface.

16. The method according to claim 15, wherein the step of cutting the texture into each said rear surface comprises laser-cutting the texture into each said rear surface.

17. The method according to claim 12, additional comprising cleaning each said rear surface after the texturizing step and before the depositing step.

18. The method according to claim 12, additionally comprising stabilizing the projectiles and isolating the trailing ends thereof before the step of texturing each said rear surface.

19. The method according to claim 18, wherein the step of stabilizing the projectiles and isolating the trailing ends thereof comprises:

providing a stabilizer plate including an upper surface, a lower surface, and stabilizer holes formed through the stabilizer plate from the upper surface to the lower surface, each of the stabilizer holes being configured to receive therethrough one of the projectiles between the nose and the trailing end; and applying the stabilizer plate over the projectiles inserting the projectiles trailing ends first into and through the respective stabilizer holes such that the projectiles extend through the respective stabilizer holes from the lower surface to the upper surface and the trailing ends extend upright beyond the upper surface.

20. The method according to claim 19, further comprising withdrawing the stabilizer plate from over the projectiles thereby withdrawing the projectiles from the stabilizer holes of the stabilizer plate after the texturizing step and before the depositing step.

21. One-way luminescent projectiles mass-produced according to the method of claim 1.

22. A method of mass-producing one-way luminescent projectiles, comprising steps of:

providing projectiles each comprising a body having a nose and a trailing end including a perimeter edge and a rear surface, wherein the body is symmetrical about an axis that extends centrally through the body from the nose to the rear surface and the rear surface extends radially outward from the axis toward the perimeter edge;

providing a baseplate including an upper surface and cavities that open upwardly to the upper surface, each of said cavities configured to receive and hold one of said projectiles in a nose down, trailing end up orientation;

depositing the projectiles nose down into the respective cavities, each said cavity holding one said projectile in the nose down, trailing end up orientation extending upright from the nose in the cavity to and beyond the upper surface to the trailing end and the rear surface exposed above the upper surface;

depositing a quantity of a hardenable photoluminescent material centrally on each said rear surface, the quantities being identical and hardening over a period of time; and maintaining the projectiles in the nose down, trailing end up orientation during at least said period of time such that each quantity of photoluminescent material forms an identical solid photoluminescent body adhered to the respective rear surface, that is concentric with, and extends outwardly no further than, the perimeter edge, and radially symmetrical relative to the axis.

23. The method according to claim 22, wherein the step of depositing the quantity of the hardenable photoluminescent material centrally on the rear surface of each said projectile comprises depositing a quantity of the hardenable photoluminescent material having a chosen operating viscosity causing each said quantity to automatically slump by gravity uniformly and radially outward on the rear surface from the axis to no further than the perimeter edge.

24. The method according to claim 23 additionally comprising establishing the chosen operating viscosity by maintaining the hardenable photoluminescent material at an operating temperature.

25. The method according to claim 24, wherein the operating temperature is from 67 to 73° F.

26. The method according to claim 23, wherein the step of depositing the quantity of the hardenable photoluminescent material centrally on the rear surface of each said projectile comprises depositing a blob consisting of a precise quantity of the hardenable photoluminescent material centrally on the rear surface of each said projectile.

27. The method according to claim 23, wherein the step of depositing the quantity of the hardenable photoluminescent material centrally on the rear surface of each said projectile comprises:

establishing a confining central volume on a central area of the rear surface of each projectile, the volume being concentric with the perimeter edge and symmetrical about the axis of the projectile;

filling each said volume with the quantity of the hardenable photoluminescent material, the quantity of the hardenable material contacting the central area of each said rear surface; and releasing the hardenable material from the confining volume.

28. The method according to claim 27, wherein the step of establishing a confining central volume comprises masking a circumferential area of each said rear surface extending radially outwardly to the perimeter edge defining the central volume in the interior of the masked circumferential area, and the releasing step comprises unmasking each said circumferential area.

29. The method according to claim 28, wherein the step of masking comprises:

providing a masking plate including an upper surface, a lower surface, and receiving voids formed through the masking plate from the lower surface to the upper surface, each said receiving void comprises a socket extending into the masking plate from the lower surface to an inwardly-directed annular end wall between the lower surface of the masking plate and the upper surface of the masking plate, and an opening extending from the annular end wall to the upper surface of the masking plate, wherein for each said projectile the annular end wall is configured to directly contact and mask the circumferential area of the rear surface, the socket is configured to center the opening over the central area of the rear surface, and the opening is configured to cooperate with the central area of the rear surface to define the volume, when the projectile is installed trailing end first into the socket; and applying the masking plate over the baseplate and the projectiles thereby installing the projectiles trailing ends first into the respective sockets.

30. The method according to claim 29, additionally comprising:

guide elements carried by the baseplate;

complemental guide elements carried by the masking plate; and the guide elements interacting with the complemental guide elements coaxially aligning the sockets with the respective trailing ends in response to applying the masking plate over the baseplate and the projectiles.

31. The method according to claim 29, wherein the step of filling each said volume with the quantity of the hardenable photoluminescent material comprises spreading the hardenable photoluminescent material over the upper surface of the masking plate and each said volume.

32. The method according to claim 31, wherein the step of spreading the hardenable photoluminescent material comprises depositing a mass of the hardenable photoluminescent material on the upper surface of the masking plate and scraping a spreader over the upper surface of the masking plate and each said volume.

33. The method according to claim 29, wherein the step of unmasking the projectiles comprises withdrawing the masking plate from over the baseplate and the projectiles thereby withdrawing the projectiles from the receiving voids.

34. The method according to claim 23, additionally comprising texturizing each said rear surface uniformly before the depositing step.

35. The method according to claim 34, wherein the step of texturizing each said rear surface comprises roughening each said rear surface.

36. The method according to claim 31, wherein the step of roughening each said rear surface comprises abrasive-blasting each said rear surface.

37. The method according to claim 34, wherein the step of texturizing each said rear surface comprises cutting a texture into each said rear surface.

38. The method according to claim 37, wherein the step of cutting the texture into each said rear surface comprises laser-cutting the texture into each said rear surface.

39. The method according to claim 34, additional comprising cleaning each said rear surface after the texturizing step and before the depositing step.

40. The method according to claim 34, additionally comprising stabilizing the projectiles and isolating the trailing ends thereof before the step of texturing the rear surface of each said projectile.

41. The method according to claim 40, wherein the step of stabilizing the projectiles and isolating the trailing ends thereof comprises:

providing a stabilizer plate including an upper surface, a lower surface, and stabilizer holes formed through the stabilizer plate from the upper surface to the lower surface, each of the stabilizer holes being configured to receive therethrough one of the projectiles between the nose and the trailing end; and applying the stabilizer plate over the baseplate and the projectiles inserting the projectiles trailing ends first into and through the respective stabilizer holes such that the projectiles extend through the respective stabilizer holes from the lower surface of the stabilizer plate to the upper surface of the stabilizer plate and the trailing ends extend upright beyond the upper surface of the stabilizer plate.

42. The method according to claim 41, additionally comprising:

guide elements carried by the baseplate;

complemental guide elements carried by the stabilizer plate; and the guide elements interacting with the complemental guide elements coaxially aligning the stabilizer holes with the respective trailing ends in response to applying the stabilizer plate over the baseplate and the projectiles.

43. The method according to claim 41, further comprising withdrawing the stabilizer plate from over the baseplate and the projectiles thereby withdrawing the projectiles from the stabilizer holes of the stabilizer plate after the texturizing step and before the depositing step.

44. One-way luminescent projectiles mass-produced according to the method of claim 22.

* * * * *